US008261986B2

(12) United States Patent
Chung et al.

(10) Patent No.: US 8,261,986 B2
(45) Date of Patent: Sep. 11, 2012

(54) SYSTEM AND METHOD FOR DECODING AN OPTICALLY READABLE MARKABLE SHEET AND MARKABLE SHEET THEREFOR

(76) Inventors: Kevin Kwong-Tai Chung, Princeton, NJ (US); Ernesto Dela Rosa Del Rosario, Rizal (PH)

( * ) Notice: Subject to any disclaimer, the term of this patent is extended or adjusted under 35 U.S.C. 154(b) by 84 days.

(21) Appl. No.: 12/905,583

(22) Filed: Oct. 15, 2010

(65) Prior Publication Data

US 2011/0089236 A1 Apr. 21, 2011

Related U.S. Application Data

(60) Provisional application No. 61/279,432, filed on Oct. 21, 2009.

(51) Int. Cl.

| | |
|---|---|
| ***G06F 17/00*** | (2006.01) |
| ***G06F 11/00*** | (2006.01) |
| ***G06K 17/00*** | (2006.01) |
| ***G06K 7/00*** | (2006.01) |
| ***G06K 7/14*** | (2006.01) |
| ***G07C 13/00*** | (2006.01) |
| ***G09B 19/00*** | (2006.01) |
| ***G09B 9/00*** | (2006.01) |
| ***B42D 15/00*** | (2006.01) |

(52) U.S. Cl. ..... 235/386; 235/375; 235/435; 235/454; 705/12; 434/306; 283/5

(58) Field of Classification Search ..... 235/375, 235/435, 454; 705/12; 434/306; 283/5
See application file for complete search history.

(56) References Cited

U.S. PATENT DOCUMENTS

| | | | |
|---|---|---|---|
| 3,163,758 | A | 12/1964 | Treacy |
| 3,648,022 | A | 3/1972 | Cook |
| 3,653,587 | A | 4/1972 | Hammond et al. |

(Continued)

FOREIGN PATENT DOCUMENTS

| | | |
|---|---|---|
| CN | 1804905 | 7/2006 |

(Continued)

OTHER PUBLICATIONS

*Transcript of Jury Trial, vol. I, Avante International Technology Corporation*, Plaintiff, v. *Premier Election Solutions, et al*, Defendants; United States Eastern District of Missouri Eastern Division: Case No. 4:06-CV-978 TCM, Feb. 2, 2009, 111 pages.

(Continued)

*Primary Examiner* — Daniel Walsh
(74) *Attorney, Agent, or Firm* — Clement A. Berard, Esq.; Dann, Dorfman, Herrell & Skillman, PC

(57) ABSTRACT

An optically readable markable sheet has selection mark spaces and has voiding mark spaces associated with the selection mark spaces. An apparatus and a method for reading the optically readable sheet may comprise a processor decoding a sheet identifier and the mark spaces from an image of the sheet and determining the mark spaces that are marked. Marking a voiding mark space voids a selection marked in the selection mark space with which the voiding mark space is associated. Sheet images and a record of marked mark spaces are stored in a memory, preferably a non-volatile memory. Sheet images may be provided by an optical imager that images the sheet and/or by an optical mark reader that reads the sheet.

29 Claims, 9 Drawing Sheets

U.S. PATENT DOCUMENTS 3,710,105 A 1/1973 Oxendine, Jr. et al.
3,722,793 A 3/1973 Aronoff
3,739,151 A 6/1973 Moldovan, Jr. et al.
3,790,072 A 2/1974 Moldovan, Jr.
3,900,961 A 8/1975 Sokolski et al.
3,941,976 A 3/1976 Huhn
3,944,788 A 3/1976 Comisar et al.
3,977,357 A 8/1976 O'Neal et al.
4,010,353 A 3/1977 Moldovan, Jr. et al.
4,015,106 A 3/1977 De Phillipo
4,021,780 A 5/1977 Narey et al.
4,101,784 A 7/1978 Key et al.
4,153,895 A 5/1979 Weisbrod et al.
4,300,123 A 11/1981 McMillin et al.
4,357,596 A 11/1982 Feilchenfeld
4,459,021 A 7/1984 Blazek
4,479,194 A 10/1984 Fogg et al.
4,641,240 A 2/1987 Boram
4,649,264 A 3/1987 Carson
4,724,307 A 2/1988 Dutton et al.
4,760,247 A 7/1988 Keane et al.
4,774,665 A 9/1988 Webb
4,807,908 A 2/1989 Gerbel
4,813,708 A 3/1989 Narey
4,968,873 A 11/1990 Dethloff et al.
5,038,392 A 8/1991 Morris et al.
5,073,700 A 12/1991 D'Onofrio
5,085,587 A * 2/1992 DesForges et al. ..... 434/355
5,103,490 A 4/1992 McMillan
5,126,731 A 6/1992 Cromers, Jr.
5,134,669 A 7/1992 Keogh et al.
5,164,601 A 11/1992 Nordstrom
5,191,525 A 3/1993 LeBrun et al.
5,213,373 A 5/1993 Ramos
5,218,528 A 6/1993 Wise et al.
5,221,831 A 6/1993 Geiszler
5,247,166 A 9/1993 Cannon et al.
5,248,872 A 9/1993 Stewart
5,257,011 A 10/1993 Beigel
5,272,318 A 12/1993 Gorman
5,278,753 A 1/1994 Graft, III
5,365,026 A 11/1994 Cromers, Jr. et al.
5,377,099 A 12/1994 Miyagawa
5,396,218 A 3/1995 Olah
5,400,248 A 3/1995 Chishom
5,416,308 A 5/1995 Hood et al.
5,452,379 A 9/1995 Poor
5,474,295 A 12/1995 Demshuk
5,495,532 A 2/1996 Kilian et al.
5,497,318 A 3/1996 Miyagawa et al.
5,548,326 A 8/1996 Michael
5,566,327 A 10/1996 Sehr
5,572,601 A 11/1996 Bloomberg
5,583,329 A 12/1996 Davis, III et al.
5,585,612 A 12/1996 Harp, Jr.
5,610,383 A 3/1997 Chumbley
5,612,870 A 3/1997 Welner
5,631,984 A 5/1997 Graf et al.
5,635,726 A 6/1997 Zavislan
5,640,200 A 6/1997 Michael
5,661,470 A 8/1997 Karr
5,672,060 A 9/1997 Poor
5,675,628 A 10/1997 Hokkanen
5,710,420 A 1/1998 Martin et al.
5,711,673 A 1/1998 Grundy, Jr.
5,719,386 A 2/1998 Hsieh et al.
5,732,222 A 3/1998 Miyagawa et al.
5,758,325 A 5/1998 Lohry et al.
5,769,715 A * 6/1998 Brown ..... 463/10
5,821,508 A 10/1998 Willard
5,875,432 A 2/1999 Sehr
5,878,399 A 3/1999 Peralto
5,936,527 A 8/1999 Isaacman et al.
5,978,466 A 11/1999 Quattrocchi
5,987,149 A 11/1999 Poor
6,005,680 A 12/1999 Luther et al.
6,014,438 A 1/2000 Quattrocchi
6,077,106 A 6/2000 Mish
6,078,928 A 6/2000 Schnase et al.
6,081,793 A 6/2000 Challener et al.
6,092,051 A 7/2000 Kilian et al.
6,097,301 A 8/2000 Tuttle
6,112,240 A 8/2000 Pogue et al.
6,173,154 B1 1/2001 Kucinski et al.
6,176,429 B1 1/2001 Reddersen
6,250,548 B1 6/2001 McClure et al.
6,287,765 B1 9/2001 Cubicciotti
6,366,777 B1 4/2002 Uusitalo
6,412,692 B1 7/2002 Miyagawa
6,418,372 B1 7/2002 Hofmann
6,427,073 B1 7/2002 Kortesalmi et al.
6,457,643 B1 * 10/2002 Way ..... 235/462.01
6,505,778 B1 1/2003 Reddersen et al.
6,540,138 B2 4/2003 Hall et al.
6,550,675 B2 4/2003 Davis et al.
6,581,824 B1 * 6/2003 McClure et al. ..... 235/51
6,607,126 B2 8/2003 Altini et al.
6,607,137 B2 8/2003 Morales
6,641,033 B2 11/2003 McClure et al.
6,662,998 B2 12/2003 McClure et al.
6,688,517 B1 2/2004 McClure et al.
6,726,090 B1 4/2004 Kargel
6,739,508 B2 5/2004 Ushioda et al.
6,741,738 B2 5/2004 Taylor
6,769,613 B2 8/2004 McDermott et al.
6,779,727 B2 8/2004 Warther
6,799,723 B2 10/2004 Kotob et al.
6,817,515 B2 11/2004 Winnett
6,854,644 B1 2/2005 Bolton et al.
6,865,543 B2 3/2005 Gibbs, Sr.
6,892,944 B2 5/2005 Chung
6,942,142 B2 * 9/2005 Barmettler et al. ..... 235/51
6,951,303 B2 * 10/2005 Petersen et al. ..... 235/386
6,968,999 B2 11/2005 Reardon
6,971,574 B1 12/2005 Herskowitz
7,032,821 B2 4/2006 McClure et al.
7,077,313 B2 7/2006 Chung
7,080,779 B2 7/2006 Cummings
7,100,828 B2 9/2006 Cummings
7,117,356 B2 10/2006 La Cous
7,128,263 B1 10/2006 Nguyen et al.
7,152,045 B2 12/2006 Hoffman
7,152,792 B2 12/2006 Gaston
7,178,730 B1 2/2007 Jamison et al.
7,222,787 B2 5/2007 Cummings
7,231,082 B2 6/2007 Lenoir
7,243,846 B2 7/2007 Reardon
7,344,071 B2 * 3/2008 Cummings et al. ..... 235/386
7,614,553 B2 11/2009 Chung et al.
7,635,087 B1 12/2009 Chung et al.
7,635,088 B2 * 12/2009 Chung et al. ..... 235/386
7,753,273 B2 * 7/2010 Cummings ..... 235/386
7,988,047 B2 * 8/2011 Chung et al. ..... 235/386
8,066,184 B2 * 11/2011 Chung et al. ..... 235/386
2001/0035455 A1 11/2001 Davis et al.
2002/0029163 A1 3/2002 Joao
2002/0066780 A1 6/2002 Balolia
2002/0072961 A1 6/2002 McDermott et al.
2002/0074399 A1 6/2002 Hall et al.
2002/0078358 A1 6/2002 Neff et al.
2002/0084325 A1 * 7/2002 Reardon ..... 235/386
2002/0091673 A1 7/2002 Seibel et al.
2002/0092908 A1 7/2002 Chumbley
2002/0133396 A1 9/2002 Barnhart
2002/0161628 A1 10/2002 Poor, Jr. et al.
2002/0169756 A1 11/2002 Biddulph
2002/0175514 A1 * 11/2002 Warther ..... 283/5
2002/0194060 A1 12/2002 Chernomorov
2003/0034393 A1 2/2003 Chung
2003/0042731 A1 3/2003 Li
2003/0062411 A1 4/2003 Chung
2003/0066872 A1 4/2003 McClure
2003/0173404 A1 * 9/2003 Chung et al. ..... 235/386
2004/0016802 A1 * 1/2004 Cummings ..... 235/386
2004/0016803 A1 1/2004 Cummings
2004/0020985 A1 * 2/2004 Cummings ..... 235/386
2004/0046021 A1 3/2004 Chung

| | | | | |
|---|---|---|---|---|
| 2004/0060983 | A1 | 4/2004 | Davis et al. | |
| 2004/0169077 | A1* | 9/2004 | Petersen et al. | 235/386 |
| 2004/0195322 | A1* | 10/2004 | Hurewitz | 235/386 |
| 2004/0195323 | A1 | 10/2004 | Vadura et al. | |
| 2004/0217168 | A1* | 11/2004 | Cummings | 235/386 |
| 2004/0259067 | A1* | 12/2004 | Cody et al. | 434/323 |
| 2005/0092835 | A1 | 5/2005 | Chung | |
| 2005/0139666 | A1* | 6/2005 | Chou | 235/386 |
| 2005/0161507 | A1 | 7/2005 | Openshaw, II et al. | |
| 2005/0211778 | A1 | 9/2005 | Biddulph | |
| 2005/0255439 | A1 | 11/2005 | Cody | |
| 2006/0000906 | A1 | 1/2006 | Reardon | |
| 2006/0202031 | A1 | 9/2006 | Chung et al. | |
| 2006/0255145 | A1 | 11/2006 | Chung et al. | |
| 2007/0170253 | A1 | 7/2007 | Chung et al. | |
| 2008/0135632 | A1* | 6/2008 | Haas et al. | 235/50 B |
| 2008/0277470 | A1 | 11/2008 | Gallaher et al. | |
| 2008/0308634 | A1* | 12/2008 | Bolton et al. | 235/386 |
| 2009/0020606 | A1 | 1/2009 | Chung et al. | |
| 2009/0037260 | A1 | 2/2009 | Felten et al. | |
| 2009/0072030 | A1 | 3/2009 | Cardone et al. | |
| 2009/0256703 | A1* | 10/2009 | Bolton | 340/540 |
| 2009/0289115 | A1* | 11/2009 | Chung et al. | 235/386 |
| 2009/0294533 | A1* | 12/2009 | Reardon | 235/386 |
| 2010/0170948 | A1 | 7/2010 | Chung et al. | |
| 2011/0145150 | A1* | 6/2011 | Onischuk | 705/50 |

FOREIGN PATENT DOCUMENTS

| | | |
|---|---|---|
| CN | 101086691 | 12/2007 |
| EP | 0199683 | 10/1986 |
| EP | 0556853 | 8/1993 |
| IT | 1234224 | 5/1992 |
| JP | 7-57014 | 3/1995 |
| JP | 9-160988 | 6/1997 |
| JP | 2005-25392 | 1/2005 |
| WO | 96/02044 | 1/1996 |
| WO | 00/79469 | 12/2000 |
| WO | 02/31629 | 4/2002 |

OTHER PUBLICATIONS

*Defendants' Witness, Larry Hyer, Transcript of Video Deposition Played to the Jury, Avante International Technology Corporation*, Plaintiff, v. *Premier Election Solutions, et al*, Defendants; United States Eastern District of Missouri Eastern Division: Case No. 4:06-CV-978 TCM, Feb. 2, 2009, 19 pages.

*Transcript of Jury Trial, vol. II-A, Avante International Technology Corporation*, Plaintiff, v. *Premier Election Solutions, et al*, Defendants; United States Eastern District of Missouri Eastern Division: Case No. 4:06-CV-978 TCM, Feb. 3, 2009, 112 pages.

*Transcript of Jury Trial, vol. II-B, Avante International Technology Corporation*, Plaintiff, v. *Premier Election Solutions, et al*, Defendants; United States Eastern District of Missouri Eastern Division: Case No. 4:06-CV-978 TCM, Feb. 3, 2009, 163 pages.

*Defendants' Witness, John Hanna, Transcript of Video Deposition Excerpts Played to the Jury, Avante International Technology Corporation*, Plaintiff, v. *Premier Election Solutions, et al*, Defendants; United States Eastern District of Missouri Eastern Division: Case No. 4:06-CV-978 TCM, Feb. 3, 2009, 16 pages.

*Defendants' Witness, Brian Clubb, Transcript of Video Deposition Played to the Jury, Avante International Technology Corporation*, Plaintiff, v. *Premier Election Solutions, et al*, Defendants; United States Eastern District of Missouri Eastern Division: Case No. 4:06-CV-978 TCM, Feb. 4, 2009, 12 pages.

*Transcript of Jury Trial, vol. III-A, Avante International Technology Corporation*, Plaintiff, v. *Premier Election Solutions, et al*, Defendants; United States Eastern District of Missouri Eastern Division: Case No. 4:06-CV-978 TCM, Feb. 4, 2009, 127 pages.

*Transcript of Jury Trial, vol. III-B, Avante International Technology Corporation*, Plaintiff, v. *Premier Election Solutions, et al*, Defendants; United States Eastern District of Missouri Eastern Division: Case No. 4:06-CV-978 TCM, Feb. 4, 2009, 81 pages.

*Defendants' Witness, Frank Kaplan, Transcript of Video Deposition Played to the Jury, Avante International Technology Corporation*, Plaintiff, v. *Premier Election Solutions, et al*, Defendants; United States Eastern District of Missouri Eastern Division: Case No. 4:06-CV-978 TCM, Feb. 4, 2009, 21 pages.

*Defendants' Witness, Stephen Knecht, Transcript of Video Deposition Played to the Jury, Avante International Technology Corporation*, Plaintiff, v. *Premier Election Solutions, et al*, Defendants; United States Eastern District of Missouri Eastern Division: Case No. 4:06-CV-978 TCM, Feb. 4, 2009, 7 pages.

*Plaintiff's Witness, Kevin Chung, Transcript of Video Deposition Played to the Jury, Avante International Technology Corporation*, Plaintiff, v. *Premier Election Solutions, et al*, Defendants; United States Eastern District of Missouri Eastern Division: Case No. 4:06-CV-978 TCM, Feb. 5, 2009, 6 pages.

*Plaintiff's Witness, Brian Clubb, Transcript of Video Deposition Played to the Jury, Avante International Technology Corporation*, Plaintiff, v. *Premier Election Solutions, et al*, Defendants; United States Eastern District of Missouri Eastern Division: Case No. 4:06-CV-978 TCM, Feb. 5, 2009, 9 pages.

*Plaintiff's Witness, Timothy Cordes, Transcript of Video Deposition Played to the Jury, Avante International Technology Corporation*, Plaintiff, v. *Premier Election Solutions, et al*, Defendants; United States Eastern District of Missouri Eastern Division: Case No. 4:06-CV-978 TCM, Feb. 5, 2009, 3 pages.

*Plaintiff's Witness, Herman Deutsch, Transcript of Video Deposition Played to the Jury, Avante International Technology Corporation*, Plaintiff, v. *Premier Election Solutions, et al*, Defendants; United States Eastern District of Missouri Eastern Division: Case No. 4:06-CV-978 TCM, Feb. 5, 2009, 2 pages.

*Plaintiff's Witness, Luis Diaz, Transcript of Video Deposition Played to the Jury, Avante International Technology Corporation*, Plaintiff, v. *Premier Election Solutions, et al*, Defendants; United States Eastern District of Missouri Eastern Division: Case No. 4:06-CV-978 TCM, Feb. 5, 2009, 5 pages.

*Transcript of Jury Trial, vol. IV-A, Avante International Technology Corporation*, Plaintiff, v. *Premier Election Solutions, et al*, Defendants; United States Eastern District of Missouri Eastern Division: Case No. 4:06-CV-978 TCM, Feb. 5, 2009, 102 pages.

*Transcript of Jury Trial, vol. IV-B, Avante International Technology Corporation*, Plaintiff, v. *Premier Election Solutions, et al*, Defendants; United States Eastern District of Missouri Eastern Division: Case No. 4:06-CV-978 TCM, Feb. 5, 2009, 89 pages.

*Plaintiff's Witness, Mauro Rivero, Transcript of Video Deposition Played to the Jury, Avante International Technology Corporation*, Plaintiff, v. *Premier Election Solutions, et al*, Defendants; United States Eastern District of Missouri Eastern Division: Case No. 4:06-CV-978 TCM, Feb. 5, 2009, 3 pages.

*Plaintiff's Witness, Eric Wall, Transcript of Video Deposition Played to the Jury, Avante International Technology Corporation*, Plaintiff, v. *Premier Election Solutions, et al*, Defendants; United States Eastern District of Missouri Eastern Division: Case No. 4:06-CV-978 TCM, Feb. 5, 2009, 4 pages.

*Transcript of Jury Trial, vol. V-A, Avante International Technology Corporation*, Plaintiff, v. *Premier Election Solutions, et al*, Defendants; United States Eastern District of Missouri Eastern Division: Case No. 4:06-CV-978 TCM, Feb. 6, 2009, 115 pages.

*Transcript of Jury Trial, vol. V-B, Avante International Technology Corporation*, Plaintiff, v. *Premier Election Solutions, et al*, Defendants; United States Eastern District of Missouri Eastern Division: Case No. 4:06-CV-978 TCM, Feb. 6, 2009, 62 pages.

*Transcript of Jury Trial, vol. VI, Avante International Technology Corporation*, Plaintiff, v. *Premier Election Solutions, et al*, Defendants; United States Eastern District of Missouri Eastern Division: Case No. 4:06-CV-978 TCM, Feb. 9, 2009, 88 pages.

*Exhibit List, Avante International Technology Corporation*, Plaintiff, v. *Premier Election Solutions, et al*, Defendants; United States Eastern District of Missouri Eastern Division: Case No. 4:06-CV-978 TCM, Feb. 2009, 6 pages.

Plaintiff's Exhibit 9, Consulting Invoices, admitted Feb. 2009, 5 pages.

Plaintiff's Exhibit 18, Correspondence, admitted Feb. 2009, 2 pages.

Plaintiff's Exhibit 19, Correspondence, admitted Feb. 2009, 2 pages.

Plaintiff's Exhibit 23, Correspondence, admitted Feb. 2009, 4 pages.

Plaintiff's Exhibit 32, County of Sacramento, admitted Feb. 2009, 39 pages.

Plaintiff's Exhibit 37, Declaration, admitted Feb. 2009, 69 pages.
Plaintiff's Exhibit 68, Email from Lancaster, admitted Feb. 2009, 3 pages.
Plaintiff's Exhibit 70, Resignation Email, admitted Feb. 2009, 1 page.
Plaintiff's Exhibit 127, US Patent 5610383, admitted Feb. 2009, 9 pages.
Plaintiff's Exhibit 152, U.S. Appl. No. 10/260,167, admitted Feb. 2009, 192 pages.
Plaintiff's Exhibit 191, U.S. Appl. No. 60/326,265, admitted Feb. 2009, 84 pages.
Plaintiff's Exhibit 201, Letter to Ewald from Diebold, admitted Feb. 2009, 5 pages.
Plaintiff's Exhibit 202, Interrogatories, admitted Feb. 2009, 2 pages.
Plaintiff's Exhibit 203, Interrogatories, admitted Feb. 2009, 5 pages.
Defendant's Exhibit A, Chung Patent 6,892,944, admitted Feb. 2009, 22 pages.
Defendant's Exhibit A-3, Report of Sacramento Election, admitted Feb. 2009, 13 pages.
Defendant's Exhibit A-8, Provisional Application, admitted Feb. 2009, 84 pages.
Defendant's Exhibit A-9, Action Summary, admitted Feb. 2009, 7 pages.
Defendant's Exhibit B, Chung Patent 7,077,313, admitted Feb. 2009, 35 pages.
Defendant's Exhibit B-1, Tulare County Ballot, admitted Feb. 2009, 2pages.
Defendant's Exhibit B-9, Amendment, admitted Feb. 2009, 24 pages.
Defendant's Exhibit C, File History 6,892,944, admitted Feb. 2009, 210 pages.
Defendant's Exhibit D-2, Letter from State of Alabama, admitted Feb. 2009, 2 pages.
Defendant's Exhibit D-4, Slipedit Program User Manual, admitted Feb. 2009, 7 pages.
Defendant's Exhibit E, File History 7,077,313, admitted Feb. 2009, 346 pages.
Defendant's Exhibit E-2, GEMS User Guide, admitted Feb. 2009, 41 pages.
Defendant's Exhibit E-4, Specification for Slipedit Editor, admitted Feb. 2009, 11 pages.
Defendant's Exhibit F-3, Letter from California, admitted Feb. 2009, 1 pages.
Defendant's Exhibit F-4, Specification of Pagescan II, admitted Feb. 2009, 42 pages.
Defendant's Exhibit F-7, Supplemental Declaration, admitted Feb. 2009, 2 pages.
Defendant's Exhibit F-8, Declaration of Clubb, admitted Feb. 2009, 66 pages.
Defendant's Exhibit G, McMillan Patent 4,300,123, admitted Feb. 2009, 14 pages.
Defendant's Exhibit G-4, PA Assoc. Marketing Strategy, admitted Feb. 2009, 26 pages.
Defendant's Exhibit G-7, Work Order, admitted Feb. 2009, 1 pages.
Defendant's Exhibit G-8, Action Summary, admitted Feb. 2009, 6 pages.
Defendant's Exhibit G-9, Declaration of Childers, admitted Feb. 2009, 28 pages.
Defendant's Exhibit H, Patent 5,103,490, admitted Feb. 2009, 14 pages.
Defendant's Exhibit H-1, Test Report from Wyle, admitted Feb. 2009, 265 pages.
Defendant's Exhibit H-2, Data Sheet for Vision Series 8000, admitted Feb. 2009, 2 pages.
Defendant's Exhibit H-4, Pagescan 280 Fact Sheet, admitted Feb. 2009, 2 pages.
Defendant's Exhibit H-7, Equipment Order, admitted Feb. 2009, 1 pages.
Defendant's Exhibit H-8, Response to Action Summary, admitted Feb. 2009, 43 pages.
Defendant's Exhibit I, Patent No. 5,134,669, admitted Feb. 2009, 16 pages.
Defendant's Exhibit I-1, Wyle Leter, admitted Feb. 2009, 26 pages.
Defendant's Exhibit I-4, Letter from Hanna to Chung, admitted Feb. 2009, 2 pages.
Defendant's Exhibit I-9, Email from Martin to Global, admitted Feb. 2009, 2 pages.
Defendant's Exhibit J, Patent No. 5,248,872, admitted Feb. 2009, 13 pages.
Defendant's Exhibit K, Patent No. 6,250,548, admitted Feb. 2009, 54 pages.
Defendant's Exhibit K-1, Ballot Production Handbook, admitted Feb. 2009, 50 pages.
Defendant's Exhibit K-3, GEMS FEC Compliance Overview, admitted Feb. 2009, 107 pages.
Defendant's Exhibit K-8, Duty of Disclosure, admitted Feb. 2009, 14 pages.
Defendant's Exhibit K-11, San Diego County Contract, admitted Feb. 2009, 209 pages.
Defendant's Exhibit L-1, Model 100 Hardware Specification, admitted Feb. 2009, 106 pages.
Defendant's Exhibit L-2, GEMS System Software Specifications, admitted Feb. 2009, 154 pg.
Defendant's Exhibit L-3, Global Certification Compliance Summary, admitted Feb. 2009, 13 pgs.
Defendant's Exhibit L-7, Developer's Guide, admitted Feb. 2009, 125 pages.
Defendant's Exhibit M-1, Model 100 Software Specification, admitted Feb. 2009, 110 pages.
Defendant's Exhibit M-2, Email from Knecht, admitted Feb. 2009, 2 pages.
Defendant's Exhibit M-3, Product Proposal by Martin, admitted Feb. 2009, 24 pages.
Defendant's Exhibit M-8, Action Summary, admitted Feb. 2009, 8 pages.
Defendant's Exhibit N-2, Video of Highspeed Central Count, admitted Feb. 2009, 1 pages.
Defendant's Exhibit N-3, Review of Sacramento Election, admitted Feb. 2009, 8 pages.
Defendant's Exhibit N-8, Response to Action Summary, admitted Feb. 2009, 20 pages.
Defendant's Exhibit O-2, Software Source Code, admitted Feb. 2009, 11 pages.
Defendant's Exhibit O-3,User Manual for Scanner, admitted Feb. 2009, 68 pages.
Defendant's Exhibit O-6, Video Demo of AccuVote, admitted Feb. 2009, 1 pages.
Defendant's Exhibit O-8, Notice of Allowance, admitted Feb. 2009, 5 pages.
Defendant's Exhibit P-3, Listing of Time Tracking for Martin, admitted Feb. 2009, 11 pages.
Defendant's Exhibit R-9, Sacramento Ballot, admitted Feb. 2009, 3 pages.
Defendant's Exhibit R-11, Contract Report Sep. 27, 2001, admitted Feb. 2009, 2 pages.
Defendant's Exhibit T-3, Memorandum from Meehan, admitted Feb. 2009, 2 pages.
Defendant's Exhibit T-4, Cummings Patent Application, admitted Feb. 2009, 36 pages.
Defendant's Exhibit T-11, Email from Lancaster to Martin, admitted Feb. 2009, 1 pages.
Defendant's Exhibit U-1, Invoice for Dallas Co. TX, admitted Feb. 2009, 3 pages.
Defendant's Exhibit U-3, Memo from Dobson, admitted Feb. 2009, 2 pages.
Defendant's Exhibit U-4, Cummings Patent Application, admitted Feb. 2009, 29 pages.
Defendant's Exhibit U-11, Peripheral Dynamics Letter, admitted Feb. 2009, 12 pages.
Defendant's Exhibit V-2, Memo from Dean to Ensiminger, admitted Feb. 2009, 3 pages.
Defendant's Exhibit V-3, Manufacturing Request, admitted Feb. 2009, 5 pages.
Defendant's Exhibit V-11, Peripheral Dynamics Email, admitted Feb. 2009, 4 pages.

Defendant's Exhibit W-3, Peripheral Dynamics Invoice, admitted Feb. 2009, 2 pages.
Defendant's Exhibit W-5, Patent No. 4,813,708, admitted Feb. 2009, 8 pages.
Defendant's Exhibit W-11 Sample Ballot, admitted Feb. 2009, 6 pages.
Defendant's Exhibit X-2, Proposal from Global to Sacramento, admitted Feb. 2009, 9 pages.
Defendant's Exhibit X-3, Specifications for PageScan II, admitted Feb. 2009, 52 pages.
Defendant's Exhibit X-11, Dr. Singh's Invoices, admitted Feb. 2009, 29 pages.
Defendant's Exhibit Y-7, Cummings Patent Application, admitted Feb. 2009, 32 pages.
Defendant's Exhibit Y-11, Small Binder of PDI, admitted Feb. 2009, 71 pages.
Defendant's Exhibit Z-2, Email from Martin, admitted Feb. 2009, 4 pages.
Defendant's Exhibit Z-3, PageScan User Manual, admitted Feb. 2009, 7 pages.
Defendant's Exhibit Z-7, Cummings Patent Application, admitted Feb. 2009, 12 pages.
*Order, Findings, and Conclusions on Inequitable Conduct, Avante International Technology Corporation*, Plaintiff, v. *Premier Election Solutions, et al*, Defendants; United States Eastern District of Missouri Eastern Division: Case No. 4:06-CV-0978 TCM, Document 649, Mar. 17, 2009, 14 pages.
*Order, Findings, and Conclusions on the Obviousness of the '944 and '313 Patents, Avante International Technology Corporation*, Plaintiff, v. *Premier Election Solutions, et al*, Defendants; United States Eastern District of Missouri Eastern Division: Case No. 4:06-CV-0978 TCM, Document 650, Mar. 17, 2009, 6 pages.
*Judgment, Avante International Technology Corporation*, Plaintiff, v. *Premier Election Solutions, et al*, Defendants; United States Eastern District of Missouri Eastern Division: Case No. 4:06-CV-0978 TCM, Document 651, Mar. 17, 2009, 2 pages.
*Written Offer of Proof, Avante International Technology Corporation*, Plaintiff, v. *Premier Election Solutions, et al*, Defendants; United States Eastern District of Missouri Eastern Division: Case No. 4:06-CV-978 TCM, Document 613, Feb. 9, 2009, 4 pages.
*Defendants' Proposed Findings of Fact and Conclusions of Law Re Inequitable Conduct in the Prosecution of the '313 and '944 Patents, Avante International Technology Corporation*, Plaintiff, v. *Premier Election Solutions, et al*, Defendants; United States Eastern District of Missouri Eastern Division: Case No. 4:06-CV-978 TCM, Document 615, Feb. 11, 2009, 12 pages.
*Plaintiff Avante International Technology Corp.'s Proposed Findings of Fact and Conclusions of Law That There Was No Inequitable Conduct, Avante International Technology Corporation*, Plaintiff, v. *Premier Election Solutions, et al*, Defendants; United States Eastern District of Missouri Eastern Division: Case No. 4:06-CV-978 TCM, Document 616, Feb. 11, 2009, 3 pages.
*Plaintiff's Proposed Findings of Fact and Conclusions of Law That There Was No Inequitable Conduct, Avante International Technology Corporation*, Plaintiff, v. *Premier Election Solutions, et al*, Defendants; United States Eastern District of Missouri Eastern Division: Case No. 4:06-CV-978 TCM, Document 616-2, Feb. 11, 2009, 13 pages.
*Plaintiff's Combined Post-Trial Motion and Memorandum for Judgment as a Matter of Law, or, in the Alternative, for a New Trial, Avante International Technology Corporation*, Plaintiff, v. *Premier Election Solutions, et al*, Defendants; United States Eastern District of Missouri Eastern Division: Case No. 4:06-CV-978 TCM, Document 642, Feb. 24, 2009, 23 pages.
*Plaintiff's Unopposed Motion to Withdraw Plaintiff's Combined Post-Trial Motion and Memorandum for Judgment as a Matter of Law, or, in the Alternative, for a New Trial, Avante International Technology Corporation*, Plaintiff, v. *Premier Election Solutions, et al*, Defendants; United States Eastern District of Missouri Eastern Division: Case No. 4:06-CV-978 TCM, Document 644, Feb. 26, 2009, 3 pages.
*Defendants' Renewed Motion for Judgment as a Matter of Law or, in the Alternative, for a New Trial that the '944 and '323 Patents are Unenforceable, Avante International Technology Corporation*, Plaintiff, v. *Premier Election Solutions, et al*, Defendants; United States Eastern District of Missouri Eastern Division: Case No. 4:06-CV-978 TCM, Document 661, Mar. 31, 2009, 2 pages.
*Memorandum in Support of Defendants' Renewed Motion for Judgment as a Matter of Law or, in the Alternative, for a New Trial That the '944 and '313 Patents are Unenforceable, Avante International Technology Corporation*, Plaintiff, v. *Premier Election Solutions, et al*, Defendants; United States Eastern District of Missouri Eastern Division: Case No. 4:06-CV-978 TCM, Document 662, Mar. 31, 2009, 14 pages.
*Exhibit a, Transcript of Videotaped Deposition of Larry Hyer, Avante International Technology Corporation*, Plaintiff, v. *Premier Election Solutions, et al*, Defendants; United States Eastern District of Missouri Eastern Division: Case No. 4:06-CV-978 TCM, Document 662-2, Mar. 31, 2009, 4 pages.
*Exhibit B, Transcript of Videotaped Deposition of John W. Hanna, Avante International Technology Corporation*, Plaintiff, v. *Premier Election Solutions, et al*, Defendants; United States Eastern District of Missouri Eastern Division: Case No. 4:06-CV-978 TCM, Document 662-3, Mar. 31, 2009, 4 pages.
*Defendants' Motion for a Finding that the Case is Exceptional Under 35 U.S.C. § 285 and for Attorney Fees on Multiple Grounds, Avante International Technology Corporation*, Plaintiff, v. *Premier Election Solutions, et al*, Defendants; United States Eastern District of Missouri Eastern Division: Case No. 4:06-CV-978 TCM, Document 664, Apr. 6, 2009, 3 pages.
*Defendants' Memorandum in Support of Their Motion for a Finding that the Case is Exceptional Under 35 U.S.C. § 285 and for Attorney Fees on Multiple Grounds, Avante International Technology Corporation*, Plaintiff, v. *Premier Election Solutions, et al*, Defendants; United States Eastern District of Missouri Eastern Division: Case No. 4:06-CV-978 TCM, Document 665, Apr. 6, 2009, 15 pages.
*Exhibit 1, Letter of James A. Oliff*, Feb. 9, 2007, *Avante International Technology Corporation*, Plaintiff, v. *Premier Election Solutions, et al*, Defendants; United States Eastern District of Missouri Eastern Division: Case No. 4:06-CV-978 TCM, Document 665-2, Apr. 6, 2009, 5 pages.
*Exhibit 2, Transcript of Videotaped Deposition of Steve Bolton, Avante International Technology Corporation*, Plaintiff, v. *Premier Election Solutions, et al*, Defendants; United States Eastern District of Missouri Eastern Division: Case No. 4:06-CV-978 TCM, Document 665-3, Apr. 6, 2009, 49 pages.
*Exhibit 3, Transcript of Videotaped Deposition of Peter Martin, Avante International Technology Corporation*, Plaintiff, v. *Premier Election Solutions, et al*, Defendants; United States Eastern District of Missouri Eastern Division: Case No. 4:06-CV-978 TCM, Document 665-4, Apr. 6, 2009, 37 pages.
*Exhibit 4, Defendant Premier's Requests for Admission to Plaintiff, Avante International Technology Corporation*, Plaintiff, v. *Premier Election Solutions, et al*, Defendants; United States Eastern District of Missouri Eastern Division: Case No. 4:06-CV-978 TCM, Document 665-5, Apr. 6, 2009, 7 pages.
*Motion for Bill of Costs by Counter Claimaint Sequoia, Avante International Technology Corporation*, Plaintiff, v. *Premier Election Solutions, et al*, Defendants; United States Eastern District of Missouri Eastern Division: Case No. 4:06-CV-978 TCM, Document 666, Apr. 6, 2009, 2 pages.
*Motion for Bill of Costs by Premier Election Solutions, Inc., Avante International Technology Corporation*, Plaintiff, v. *Premier Election Solutions, et al*, Defendants; United States Eastern District of Missouri Eastern Division: Case No. 4:06-CV-978 TCM, Document 667, Apr. 6, 2009, 2 pages.
*Defendants' Joint Memorandum in Support of Defendant's Bill of Costs, Avante International Technology Corporation*, Plaintiff, v. *Premier Election Solutions, et al*, Defendants; United States Eastern District of Missouri Eastern Division: Case No. 4:06-CV-978 TCM, Document 668, Apr. 6, 2009, 11 pages.
*Defendants' Reply in Support of Renewed Motion for Judgment as a Matter of Law, or in the Alternative for a New Trial, that the '944 and '313 Patents are Unenforceable, Avante International Technology Corporation*, Plaintiff, v. *Premier Election Solutions, et al*, Defendants; United States Eastern District of Missouri Eastern Division: Case No. 4:06-CV-978 TCM, Document 678 Apr. 20, 2009, 7 pages.
*Diebold Election Systems, Inc.'s Invalidity Contentions for the '944 and '730 Patents, Avante International Technology Corporation*, Plaintiff, v. *Diebold Election Systems, et al*, Defendants; United States Eastern District of Missouri Eastern Division: Case No. 4:06-cv-00978 TCM, Nov. 28, 2006, 71 pages.
*Defendant Election Systems and Software, Inc.'s Preliminary Invalidity Contentions, Avante International Technology Corporation*, Plaintiff, v. *Diebold Election Systems, et al*, Defendants; United States Eastern District of Missouri Eastern Division: Case No. 4:06-cv-00978 TCM, Nov. 30, 2006 , 34 pages.
*Sequoia Voting Systems' Preliminary Invalidity Contentions, Avante International Technology Corporation*, Plaintiff, v. *Diebold Election Systems, et al*, Defendants; United States Eastern District of Missouri Eastern Division: Case No. 4:06-cv-00978 TCM, Nov. 28, 2006, 46 pages.
Letter, Paul A. Lesko, (Simons Cooper) to Clement Berard, "*Avante International Technology Corporation* vs. *Diebold Election Software et al*, Cause No. 4:06-cv-00978 TCM" dated Dec. 5, 2006, 2 pages.
*Defendant Election Systems & Software, Inc.'s Preliminary Invalidity Contentions for U.S. Patent No. 7,077,313, Avante International Technology Corporation*, Plaintiff, v. *Diebold Election Systems, et al*, Defendants; United States Eastern District of Missouri Eastern Division: Case No. 4:06-cv-00978 TCM, Mar. 2, 2007, 22 Pages.
*Sequoia Voting System's Preliminary Invalidity Contentions for U.S. Patent No. 7,077,313, Avante International Technology Corporation*, Plaintiff, v. *Diebold Election Systems, et al*, Defendants; United States Eastern District of Missouri Eastern Division: Case No. 4:06-cv-00978 TCM, Mar. 2, 2007, 34 Pages.
*Diebold Election Systems, Inc.'s Invalidity Contentions for the '313 Patent, Avante International Technology Corporation*, Plaintiff, v. *Diebold Election Systems, et al*, Defendants; United States Eastern District of Missouri Eastern Division: Case No. 4:06-cv-00978 TCM, Mar. 5, 2007, 26pg.
*Defendants' Preliminary Claim Construction and Preliminary Identification of Extrinsic Evidence, Avante International Technology Corporation*, Plaintiff, v. *Diebold Election Systems, et al*, Defendants; United States Eastern District of Missouri Eastern Division: Case No. 4:06-cv-00978 TCM, Apr. 17, 2007, 3 pages.
*Defendants' Proposed Construction for 730 Patent, Avante International Technology Corporation9*, Plaintiff, v. *Diebold Election Systems, et al*, Defendants; United States Eastern District of Missouri Eastern Division: Case No. 4:06-cv-00978 TCM, Apr. 17, 2007, 23 pages.
*Defendants' Proposed Construction for '944 Patent, Avante International Technology Corporation*, Plaintiff, v. *Diebold Election Systems, et al*, Defendants; United States Eastern District of Missouri Eastern Division: Case No. 4:06-cv-00978 TCM, Apr. 17, 2007, 17 pages.
*Defendants' Proposed Construction for '313 Patent, Avante International Technology Corporation*, Plaintiff, v. *Diebold Election Systems, et al*, Defendants; United States Eastern District of Missouri Eastern Division: Case No. 4:06-cv-00978 TCM, Apr. 17, 2007, 6 pages.
*Defendants' Initial Claim Construction Brief, Avante International Technology Corporation, Plaintiff*, v. *Diebold Election Systems, et al*, Defendants; United States Eastern District of Missouri Eastern Division: Case No. 4:06-cv-00978 TCM, May 8, 2007, Document 161, 245 pages.
*Motion for Leave to File Amended Counterclaim and "Amended Answer and Counterclaim of Diebold Election Systems", Avante International Technology Corporation*, Plaintiff, v. *Diebold Election Systems, et al*, Defendants; United States Eastern District of Missouri Eastern Division: Case No. 4:06-cv-00978 TCM, May 14, 2007, Document 168, 40 pages.
*Defendant Election Systems & Software, Inc's Motion for Leave to File First Amended Answer to Plaintiff's Third Amended Complaint and Memorandum of Law in Support of Motion and First Amended Answer of Election Systems & Software, Inc. To Plaintiff's Third Amended Complaint and Amended Counterclaim of Election Systems & Software, Inc., Avante International Technology Corporation*, Plaintiff, v. *Diebold Election Systems, et al*, Defendants; United States Eastern District of Missouri Eastern Division: Case No. 4:06-cv-00978 TCM, May 14, 2007, Document 169, 30 pages.
*Defendant Sequoia Voting Systems' Motion for Leave to Amend Its Answer, Affirmative Defenses and Counterclaims to State Additional Facts Supporting Its Counterclaim for Inequitable Conduct and Amended Answer, Affirmative Defenses and Counterclaims of Sequoia Voting Systems, Avante International Technology Corporation*, Plaintiff, v. *Diebold Election Systems, et al*, Defendants; United States Eastern District of Missouri Eastern Division: Case No. 4:06-cv-00978 TCM, May 14, 2007, Document 170, 35 pages.
*Defendants' Response to Plaintiff Avante's Claim Construction Brief, Avante International Technology Corporation*, Plaintiff, v. *Diebold Election Systems, et al*, Defendants; United States Eastern District of Missouri Eastern Division: Case No. 4:06-cv-00978 TCM, May 21, 2007, Document 179, 64 pages.
*Joint Claim Construction and Prehearing Statement, Avante International Technology Corporation*, Plaintiff, v. *Diebold Election Systems, et al*, Defendants; United States Eastern District of Missouri Eastern Division: Case No. 4:06-cv-00978 TCM, Apr. 24, 2007, DN 150, 63pg.
*Motion for Partial Summary Judgment, Avante International Technology Corporation*, Plaintiff, v. *Diebold Election Systems, et al*, Defendants; United States Eastern District of Missouri Eastern Division: Case No. 4:06-cv-00978 TCM, Jun. 15, 2007, Document 197, 3 pages.
*Memorandum in Support of Election Systems & Software Inc.'s Motion for Partial Summary Judgment of Invalidity of Certain Claims of the '944 Patent* (*with Exhibits*), *Avante International Technology Corporation*, Plaintiff, v. *Diebold Election Systems, et al*, Defendants; United States Eastern District of Missouri Eastern Division: Case No. 4:06-cv-00978 TCM, Jun. 15, 2007, Document 198, 34 pages.
*Motion for Leave to File Suggestions in Support of Defendant Election Systems & Software Inc.'s Motion for Partial Summary Judgment and Diebold Election Systems Suggestions in Support of Defendant Election Systems & Software Inc. Motion for Partial Summary Judgment of Invalidity of Certain Claims of the '944 Patent* (*with Exhibit*), *Avante International Technology Corporation*, Plaintiff, v. *Diebold Election Systems, et al*, Defendants; United States Eastern District of Missouri Eastern Division: Case No. 4:06-cv-00978 TCM, Aug. 1, 2007, Document 259, 171 pages.
*Plaintiff's Opposition to Election Systems & Software Inc.'s Motion for Partial Summary Judgment of Invalidity of Certain Claims of the '944 Patent, Avante International Technology Corporation*, Plaintiff, v. *Diebold Election Systems, et al*, Defendants; United States Eastern District of Missouri Eastern Division: Case No. 4:06-cv-00978 TCM, Aug. 6, 2007, Document 266, 204 pages.
*Memorandum and Order on Claim Construction, Avante International Technology Corporation*, Plaintiff, v. *Diebold Election Systems, et al*, Defendants; United States Eastern District of Missouri Eastern Division: Case No. 4:06-cv-00978 TCM, Aug. 20, 2007, Document 276, 50 pages.
*Defendant Hart Intercivic, Inc.'s Preliminary Invalidity Contentions for U.S. Patent Nos. 6,892,944, 7,036,730, and 7,077,313, Avante International Technology Corporation*, Plaintiff and Counter-Defendant, v. *Hart Intercivic, Inc.*, Defendant and Counter-Plaintiff; United States Southern District of Illinois East St. Louis Division: Case No. 3:07-cv-00169-DRH-CJP, Sep. 10, 2007, 49 pages.
*Content Listing of Hart Intercivic's Invalidity Contentions, Exhibit F* (*disk*), *Avante International Technology Corporation*, Plaintiff and Counter-Defendant, v. *Hart Intercivic, Inc.*, Defendant and Counter-Plaintiff; United States Southern District of Illinois East St. Louis Division: Case No. 3:07-cv-00169-DRH-CJP, Sep. 10, 2007, 3 pages.
*Sequoia Voting Systems' Updated Invalidity Contentions, Avante International Technology Corporation*, Plaintiff, v. *Premier Election Solutions, et al*, Defendants; United States Eastern District of Missouri Eastern Division: Case No. 4:06-cv-00978 TCM, Oct. 22, 2007, 42 pages.
*Premier Election Solution, Inc.'s Invalidity Contentions for the '944 and '313 Patents, Avante International Technology Corporation*, Plaintiff, v. *Premier Election Solutions, et al*, Defendants; United States Eastern District of Missouri Eastern Division: Case No. 4:06-cv-00978 TCM, Oct. 23, 2007, 39 pages.

*Defendant Election Systems & Software, Inc.'s Updated Invalidity Contentions, Avante International Technology Corporation*, Plaintiff, v. *Premier Election Solutions, et al*, Defendants; United States Eastern District of Missouri Eastern Division: Case No. 4:06-cv-00978 TCM, Oct. 22, 2007, 32 pages.

*Defendant's Premier Election Solutions, Inc. And Election Systems & Software, Inc.'s Memorandum of Law in Support of its Motion for Summary Judgement of Non-Infringement on Claims 26-28, 30 and 49-51 of U.S. Patent No. 6,892,944, Avante International Technology Corporation*, Plaintiff, v. *Premier Election Solutions, et al*, Defendants; United States Eastern District of Missouri Eastern Division: Case No. 4:06-cv-00978 TCM, Document 334, Nov. 2, 2007, 14 pages.

*Memorandum in Support of Defendants' Joint Motion for Summary Judgement of Invalidity of Claims 26-28, 30 and 49-51 of U.S. Patent No. 6,892,944, Avante International Technology Corporation*, Plaintiff, v. *Premier Election Solutions, et al*, Defendants; United States Eastern District of Missouri Eastern Division: Case No. 4:06-cv-00978 TCM, Document 337, Nov. 2, 2007, 20 pages.

*Memorandum in Support of Defendants' Joint Motion for Summary Judgement of Invalidity of the Asserted Claims from U.S. Patent Nos. 6,892,944 and 7,077,313 Under 35 U.S.C. §§ 102 and 103, Avante International Technology Corporation*, Plaintiff, v. *Premier Election Solutions, et al*, Defendants; United States Eastern District of Missouri Eastern Division: Case No. 4:06-cv-00978 TCM, Document 339, Nov. 2, 2007, 26 pages.

*Statement of Uncontroverted Material Facts in Support of Defendants' Joint Motion for Summary Judgment that U.S. Patent Nos. 6,892,944 and 7,077,313 Are Invalid Under 35 U.S.C. §§ 102 and 103, Avante International Technology Corporation*, Plaintiff, v. *Premier Election Solutions, et al*, Defendants; United States Eastern District of Missouri Eastern Division: Case No. 4:06-cv-00978 TCM, Document 340, Nov. 2, 2007, 192 pages.

*Statement of Uncontroverted Material Facts in Support of Defendants' Election Systems and Software Inc. And Premier Election Solutions, Inc.'s Motion for Summary Judgment of Non-Infringement of Claims 26-28, 30 and 49-51 of U.S. Patent 6,892,944, Avante International Technology Corporation*, Plaintiff, v. *Premier Election Solutions, et al*, Defendants; United States Eastern District of Missouri Eastern Division: Case No. 4:06CV00978 TCM, Document 333, Nov. 2, 2007, 29 pages.

*Statement of Uncontroverted Material Facts in Support of Defendants' Joint Motion for Summary Judgment of Invalidity of Claims 26-28, 30 and 49-51 of U.S. Patent No. 6,892,944, Avante International Technology Corporation*, Plaintiff, v. *Premier Election Solutions, et al*, Defendants; United States Eastern District of Missouri Eastern Division: Case No. 4:06CV00978 TCM, Document 336, Nov. 2, 2007, 95 pages.

*Motion for Summary Judgment of Invalidity of the Asserted Claims from U.S. Patent Nos. 6,892,944, and 7,077,313 Under 35 U.S.C. §§ 102 and 103, Avante International Technology Corporation*, Plaintiff, v. *Premier Election Solutions, et al*, Defendants; United States Eastern District of Missouri Eastern Division: Case No. 4:06CV00978 TCM, Document 338, Nov. 2, 2007, 3 pages.

*Declaration of Michael I. Shamos, Ph.D., J.D. In Support of Defendants' Joint Motion for Summary Judgment that U.S. Patent Nos. 6,892,944, and 7,077,313 are Invalid Under 35 U.S.C. §§ 102(b) and 103(a), Avante International Technology Corporation*, Plaintiff, v. *Premier Election Solutions, et al*, Defendants; United States Eastern District of Missouri Eastern Division: Case No. 4:06CV00978 TCM, Document 342, Nov. 2, 2007, 332 pages.

*Plaintiff Avante International Technology, Corporation's Memorandum in Opposition to Defendants' Joint Motion for Summary Judgment of Invalidity of Claims 26-28, 30 and 49-51 of U.S. Patent No. 6,892,944, Avante International Technology Corporation*, Plaintiff, v. *Premier Election Solutions, et al*, Defendants; United States Eastern District of Missouri Eastern Division: Case No. 4:06CV00978 TCM, Document 388, Dec. 14, 2007, 180 pages.

*Defendants' Response to Plaintiff Avante International Technology Corporation's Statement of Uncontroverted Facts in Support of its Motion for Summary Judgment that U.S. Patent Nos. 6,892,944 and 7,077,313 are not Invalid, in View of Defendants' References or 35 U.S.C. §112 Arguments, Avante International Technology Corporation*, Plaintiff, v. *Premier Election Solutions, et al*, Defendants; United States Eastern District of Missouri Eastern Division: Case No. 4:06CV00978 TCM, Document 395, Dec. 14, 2007, 90 pages.

*Premier Voting Solutions, Inc.'s Memorandum in Opposition to Avante International Technology Corporation's Motion for Summary Judgment that Premier Election Solutions, Inc.'s Equipment Infringes U.S. Patent Nos. 6,892,944 and 7,077,313, Avante International Technology Corporation*, Plaintiff, v. *Premier Election Solutions, et al*, Defendants; United States Eastern District of Missouri Eastern Division: Case No. 4:06CV00978 TCM, Document 396, Dec. 14, 2007, 10 pages.

*Sequoia Voting Systems' Opposition to Plaintiff's Motion for Summary Judgment that Sequoia's Equipment Infringes U.S. Patent Nos. 6,892,944 and 7,077,313, Avante International Technology Corporation*, Plaintiff, v. *Premier Election Solutions, et al*, Defendants; United States Eastern District of Missouri Eastern Division: Case No. 4:06CV00978 TCM, Document 417, Jan. 9, 2008, 151 pages.

*Avante International Technology Corporation's Reply in Support of its Motion for Summary Judgment that Diebold Election Systems, Inc.'s Equipment Infringes U.S. Patent Nos. 6,892,944 and 7,077,313, Avante International Technology Corporation*, Plaintiff, v. *Premier Election Solutions, et al*, Defendants; United States Eastern District of Missouri Eastern Division: Case No. 4:06CV00978 TCM, Document 425, Jan. 11, 2008, 14 pages.

*Defendants' Reply in Support of Their Joint Motion for Summary Judgment of Invalidity of Claims 26-28, 30 and 49-51 of U.S. Patent No. 6,892,944 Based on 35 U.S.C. §112 ¶ 1, Avante International Technology Corporation*, Plaintiff, v. *Premier Election Solutions, et al*, Defendants; United States Eastern District of Missouri Eastern Division: Case No. 4:06CV00978 TCM, Document 428, Jan. 11, 2008, 101 pages.

*Defendants Premier Election Solutions, Inc. and Election Systems & Software, Inc.'s Reply in Support of Their Motion for Summary Judgment of Non-Infringement of Claims 26-28, 30 and 49-51 of U.S. Patent No. 6,892,944, Avante International Technology Corporation*, Plaintiff, v. *Premier Election Solutions, et al*, Defendants; United States Eastern District of Missouri Eastern Division: Case No. 4:06CV00978 TCM, Document 429, Jan. 11, 2008, 17 pages.

*Defendant Hart Intercivic, Inc.'s Response to Plaintiff's Claim Construction Brief for U.S. Patent Nos. 6,892,944, 7,036,730, and 7,077,313, Avante International Technology, Inc.*, Plaintiff, v. *Hart Intercivic, Inc.*, Defendant; United States Southern District of Illinois East St. Louis Division: Case No. 3:07-cv-00169-DRH-CJP, Document 58, Feb. 1, 2008, 304 pgs.

*Avante International Technology, Inc.'s Reply in Support of its Claim Construction Brief for U.S. Patent no. 7,036,730, U.S. Patent No. 6,892,944, and U.S. Patent No. 7,077,313, Avante International Technology, Inc.*, Plaintiff, v. *Hart Intercivic, Inc.*, Defendant; United States Southern District of Illinois East St. Louis Division: Case No. 3:07-cv-00169-DRH-CJP, Document 60, Feb. 8, 2008, 71 pgs.

*Avante International Technology, Inc.'s Claim Construction Brief for U.S. Patent No. 7,036,730, U.S. Patent No. 6,892,944, and U.S. Patent No. 7,077,313, Avante International Technology, Inc.*, Plaintiff, v. *Hart Intercivic, Inc.*, Defendant; United States Southern District of Illinois East St. Louis Division: Case No. 3:07-cv-00169-DRH-CJP, Document 57, Jan. 18, 2008, 364 pgs.

*Declaration of Peter G. Martin Filed in Support of Defendants' Joint Motion for Summary Judgment of Invalidity of the Asserted Claims from U.S. Patent Nos. 6,892,944 and 7,077,313 Under 35 U.S.C. §§ 102 and 103, Avante International Technology Corporation*, Plaintiff, v. *Premier Election Solutions, et al*, Defendants; United States Eastern District of Missouri Eastern Division: Case No. 4:06CV00978 TCM, Document 341, Nov. 2, 2007, 105 pages.

*Defendants' Memorandum in Opposition to Avante International Technology Corporation's Motion for Summary Judgment that U.S. Patent Nos. 6,892,944 and 7,077,313 Are Not Invalid in View of Defendants' References or 35 U.S.C. § 112 Arguments, Avante International Technology Corporation*, Plaintiff, v. *Premier Voting Solutions, Inc., et al*, Defendants; United States Eastern District of Missouri Eastern Division: Case No. 4:06CV00978 TCM, Document 394, Dec. 14, 2007, 199 pages.

*Defendant Premier Voting Solutions, Inc.'s Response to Statement of Uncontroverted Facts in Support of Avante International Technology Corporation's Motion for Summary Judgment that Premier Voting Solutions, Inc. Equipment Infringes U.S. Patent Nos. 6,892,944 and 7,077,313 and Additional Facts in Support of Its Opposition to Avante's Motion for Summary Judgement, Avante International Technology Corporation*, Plaintiff, v. *Premier Voting Solutions, Inc., et al*, Defendants; United States Eastern District of Missouri Eastern Division: Case No. 4:06CV00978 TCM, Document 399, Dec. 15, 2007, 197 pgs.

*Defendants' Response to Avante International Technology Corporation's Statement of Material Facts in Support of Its Opposition to Defendants' Joint Motion for Summary Judgment That U.S. Patent Nos. 6,892,944 and 7,077,313 Are Invalid Under 35 U.S.C. §§ 102 and 103, Avante International Technology Corporation*, Plaintiff, v. *Premier Voting Solutions, et al*, Defendants; United States Eastern District of Missouri Eastern Division: Case No. 4:06CV00978 TCM, Document 430, Jan. 11, 2008, 68 pages.

*Defendants' Reply in Support of Their Joint Motion for Summary Judgment of Invalidity of the Asserted Claims From U.S. Patent Nos. 6,892,944 and 7,077,313 Are Invalid Under 35 U.S.C. §§ 102 and 103, Avante International Technology Corporation*, Plaintiff, v. *Premier Election Solutions, et al*, Defendants; United States Eastern District of Missouri Eastern Division: Case No. 4:06CV00978 TCM, Document 431, Jan. 11, 2008, 66 pages.

*Notice of Allowance of U.S. Appl. No. 11/709,449 which has Bearing on Pending Summary Judgement Motions, Avante International Technology Corporation*, Plaintiff, v. *Premier Voting Solutions, et al*, Defendants; United States Eastern District of Missouri Eastern Division: Case No. 4:06CV00978 TCM, Document 467, Mar. 18, 2008, 4 pages.

*Defendants' Memorandum Regarding Plaintiff's Notice, Avante International Technology Corporation*, Plaintiff, v. *Premier Voting Solutions, et al*, Defendants; United States Eastern District of Missouri Eastern Division: Case No. 4:06CV00978 TCM, Document 469, Mar. 24, 2008, 6 pages.

*Avante's Response to Defendant's Memorandum, Avante International Technology Corporation*, Plaintiff, v. *Premier Voting Solutions, et al*, Defendants; United States Eastern District of Missouri Eastern Division: Case No. 4:06CV00978 TCM, Document 470, Mar. 26, 2008, 3 pages.

*Defendant's Supplemental Responses and Objections to Plaintiff's First Requests for Admission, Avante International Technology, Inc.*, Plaintiff, v. *Hart Intercivic, Inc.*, Defendant; United States Southern District of Illinois East St. Louis Division: Case No. 3:07-cv-00169-DRH-CJP, Document 102, Jun. 4, 2008, 6 pages.

*Defendant's Supplemental Responses to Plaintiff's First Set of Interrogatories, Avante International Technology, Inc.*, Plaintiff, v. *Hart Intercivic, Inc.*, Defendant; United States Southern District of Illinois East St. Louis Division: Case No. 3:07-cv-00169-DRH-CJP, Jun. 4, 2008, 88 pgs.

*Premier Election Solutions, Inc.'s Response to Plaintiff's Fourth Set of Interrogatories, Avante International Technology Corporation*, Plaintiff, v. *Premier Election Solutions, et al*, Defendants; United States Eastern District of Missouri Eastern Division: Case No. 4:06CV00978 TCM, Jul. 15, 2008, 16 pages.

*Response to Plaintiff's Fifth Set of Interrogatories to Defendant Election Systems and Software, Avante International Technology Corporation*, Plaintiff, v. *Premier Election Solutions, et al*, Defendants; United States Eastern District of Missouri Eastern Division: Case No. 4:06CV00978 TCM, Jul. 15, 2008, 15 pages.

*Sequoia Voting Systems' Objections and Response to Plaintiff's Sixth Set of Interrogatories, Avante International Technology Corporation*, Plaintiff, v. *Premier Election Solutions, et al*, Defendants; United States Eastern District of Missouri Eastern Division: Case No. 4:06CV00978 TCM, Jul. 15, 2008, 10 pages.

*Memorandum and Order, Avante International Technology Corporation*, Plaintiff, v. *Premier Election Solutions, et al*, Defendants; United States Eastern District of Missouri Eastern Division: Case No. 4:06CV00978 TCM, Document 486, Jul. 16, 2008, 33 pages.

*Written Report of John D. Bakker, Avante International Technology Corporation*, Plaintiff, v. *Premier Election Solutions, et al*, Defendants; United States Eastern District of Missouri Eastern Division: Case No. 4:06CV00978 TCM, Sep. 5, 2008, 8 pages.

*Report of J. Michael Thesz, Pursuant to Rule 26, Federal Rules of Civil Procedure, Avante International Technology Corporation*, Plaintiff, v. *Premier Election Solutions, et al*, Defendants; United States Eastern District of Missouri Eastern Division: Case No. 4:06CV00978 TCM, Sep. 9, 2008, 48 pages.

*Report of Peter G. Martin, Avante International Technology Corporation*, Plaintiff, v. *Premier Election Solutions, et al*, Defendants; United States Eastern District of Missouri Eastern Division: Case No. 4:06CV00978 TCM, Sep. 9, 2008, 35 pages.

*Report of Defendants' Expert Michael Ian Shamos, Ph.D., J.D. Concerning Inequitable Conduct, Avante International Technology Corporation*, Plaintiff, v. *Premier Election Solutions, et al*, Defendants; United States Eastern District of Missouri Eastern Division: Case No. 4:06CV00978 TCM, Sep. 9, 2008, 15 pages.

*Report of Defendants' Expert Michael Ian Shamos, Ph.D., J.D. Concerning Invalidity, Avante International Technology Corporation*, Plaintiff, v. *Premier Election Solutions, et al*, Defendants; United States Eastern District of Missouri Eastern Division: Case No. 4:06CV00978 TCM, Sep. 9, 2008, 53 pages.

*Premier Election Solutions, Inc.'s Supplemental Responses Avante's Interrogatories, Avante International Technology Corporation*, Plaintiff, v. *Premier Election Solutions, et al*, Defendants; United States Eastern District of Missouri Eastern Division: Case No. 4:06CV00978 TCM, Sep. 11, 2008, 9 pages.

*Supplemental Responses to Interrogatory Nos. 1, 2, 3, 4 and 20 from Plaintiff's Interrogatories to Defendant Election Systems and Software, Avante International Technology Corporation*, Plaintiff, v. *Premier Election Solutions, et al*, Defendants; United States Eastern District of Missouri Eastern Division: Case No. 4:06CV00978 TCM, Sep. 17, 2008, 9 pages.

*Plaintiff Election Systems & Software, Inc.'s Answers to Defendant's First Set of Interrogatories to Plaintiff, Election Systems & Software, Inc.*, Plaintiff, v. *Avante International Technology Corporation*, Defendant; United States Eastern District of Missouri Eastern Division: Case No. 4:08-CV-695-TCM, Sep. 22, 2008, 46 pages.

*Supplemental Report of Defendant's Expert Michael I. Shamos, Ph.D., J.D. Concerning Invalidity, Avante International Technology Corporation*, Plaintiff, v. *Premier Election Solutions, et al*, Defendants; United States Eastern District of Missouri Eastern Division: Case No. 4:06CV00978 TCM, Nov. 6, 2008, 8 pages.

*Exhibit 4 to Defendants' Expert Report on Invalidity, Invalidity Analysis of Chung et al. '944 and '313, Avante International Technology Corporation*, Plaintiff, v. *Premier Election Solutions, et al*, Defendants; United States Eastern District of Missouri Eastern Division: Case No. 4:06CV00978 TCM, Nov. 6, 2008, 6 pages.

Frontline Solutions, "RFID Standards Buoy Packaging", Jul. 2001, 3 pages.

Frontline Solutions, "Packagers Think Outside the Box", May 2001, 3 pages.

Frontline Solutions, "RFID Baggage Tracking Solution Helps Keep SFIA Secure", Jul. 2001, 4 pg.

Frontline Solutions, "Standard Response", Jul. 2001, 1 page.

Avante International Technology, Inc., "How Does LEADS-TRAKKER Work to Enhance the Values for Exhibitors and Visitors?", 2002, 3 pages.

Leads-Trakker Web Pages, http:/www.leads-trakker.com/Printed Nov. 18, 2002, 17 pages.

International Search Report, PCT/US01/42563, Sep. 18, 2002, 5 pages.

T. Costlow, "Computer Kiosk Expedites Voter Registration", IEEE Spectrum, Oct. 2002, 2 pgs.

AccuVote-TS, http://www.gesn.com/AccuVote-TS/accuvote-TS.html, Global Election Systems, Inc., Not Dated, ©2000, 4 pages.

NEDAP, "Voting System", ©2000, 4 pages.

Hart Intercivic, "eSlate Electronic Voting System", http://www.worldwideelection.com/GoveSlate.cfm, ©1998-2000, 2 pages.

Alan Dechert, "The Voter Certified Ballot", Granite Bay, CA, http://www.go2zero.com/voterform.html, Feb. 13, 2001, 15 pages.

Robert Wright, "Recasting the Voting Process", www.varbusiness.com, Mar. 5, 2001, 4 pages.

Rebecca Mercuri, "A Better Ballot Box?", IEEE Spectrum, Oct. 2002, pp. 46-50.
Michael Stanton, "The importance of Recounting Votes", http://www.notablesoftware.com/Press/electronic_voting_in_brasil.html, Nov. 13, 2000, 3 pg.
Bruce Schneier, "Voting and Technology", Crypto-Gram, http://www.notablesoftware.com/Press/Schneier.html, Dec. 15, 2000, 3 pages.
Holli Riebeek, "Brazil Holds All-Electronic National Election", Oct. 15, 2002, 1 page.
Mike He, Rogerio Almeida and Edson Gissoni, "National Semiconductor and Unisys Equip Brazil with New Voting Machines for Fast and Accurate Election Results in the Fall", National Semiconductor, http://www.national.com/news/item/0,735,757,00.html, May 6, 2002, 2 pages.
Peter G. Neumann, "Security Criteria for Electronic Voting", http://www.csl.sri.com/users/neumann/ncs93.html, ©1993, 7 pages.
E-mail message from: R. Mercuri [notable@mindspring.com] To: Clement Berard; plesko @simmonscooper.com, "Avante Patent 7036730 and infringement suit", Jul. 13, 2006, 4 pages.
Rebecca Mercuri, "Electronic Voting", http://web.archive.org/web20010201193800/http://www.notablesoftware.com/; updated Jan. 28, 2001; 11 pages.
Bruce Schneier, Crypto-Gram Newsletter, Dec. 15, 2000, http://www.counterpane.com; 17 pages (from www.schneier.com/crypto-gram-0012.html).
Rebecca Mercuri, Explanation of Voter-Verified Ballot Systems, The Risks Digest, ACM Comm. on Computers & Public Policy, vol. 22: 17, Jul. 24, 2002, 15:54:47-0400, 2 pages.
Yahoo Finance, Press Release, Inventor of Electronic Voting Verification System Takes Industry Giants to Court for Patent Infringement; Wed., Jul. 12, 2006 11:19 am, 2 pages.
Rebecca Mercuri, "Why Computers Shouldn't Count Votes", Princeton ACM/IEEE Computer Society Chapters, Nov. 2000 Joint Meeting, Thurs. Nov. 16, 2000, 8:00 pm, 2 pages.
Rebecca Mercuri, "Electronic Vote Tabulation Checks & Balances", Dissertation, 2001, Presented to Faculty of Univ. of Pennsylvania, 235 pages.
Rebecca Mercuri, The FEC Proposed Voting Systems Standard Update, A Detailed Comment, Submitted to Fed. Election Commission, Sep. 10, 2001, FEC Not Sep. 2001 vol. 66, No. 132, 8 pages.
Terri Gauchat, [Abstract] Computer Assisted Vote Tallying, An Overview of the Problems, Implications, and Solutions, Univ. of Waterloo, Term Res Project, Apr. 11, 1991, 14 pages.
Ltr. to Paul Lesko, Esq. Jun. 28, 2006, Re: U.S. Appl. No. 10/255,348, "Electronic Voting Apparatus, System and Method", From Nancy L. Reeves, Walker & Jocke, 5 pages.
Document submitted to Patent Office, Archive Date Jul. 11, 2000, ACCUVote-TS, http://web.archive.org/web/20000711160152/www.globalelection.com., 5 pages.
AccuVote TS reference, Archive Date Oct. 12, 1999, http://web.archive.org/web/19991012074217/www.gesn.com/Product..., 3 pages.
Roy G. Saltman, Accuracy, Integrity, and Security in Computerized Vote-Tallying, Computer Science & Technology, NBS Special Pub. 500-158, Aug. 1998, 109 pages.
Michael Ian Shamos, CFP'93-Electronic Voting-Evaluating the Threat, Mar. 1993, CPSR, http://web.archive.org/web20011224071421/www.cpsr.org/conference.., 9 pages.
Description of AccuVote OS, Archived Oct. 12, 1999, "The AccuVote" http://web.archive.org/web/19991012093810/www.gesn.com/Product. 4 pages.
Description of GEMS, Archived Nov. 9, 1999, "Global Election Management System," http://web.archive.org/web/19991109003219/www.gesn.com/Product.. 5 pages.
Excerpts from current AccuVote TSX Pollworkers Guide, AccuVote-TSX Pollworker's Guide, DIEBOLD Election Systems, Revision 5.0, Mar. 22, 2005, 3 pages.
CALTECH-MIT, "Voting What is What Could Be", Jul. 2001, 95 pages.
Rebecca Mercuri, "Rebecca Mercuri's Statement on Electronic Voting", http://www.notablesoftware.com/RMstatement.html, ©2001, 2 pages.
Rebecca Mercuri, "Electronic Voting", http://www.notablesoftware.com/evote.html, Oct. 15, 2001, 8 pages.
Bruce Schneier, "Voting and Technology," from Crypto-Gram Newsletter, Dec. 15, 2000, http://www.notablesoftware.com/press/schneier.html; 3 pages.
Rebecca Mercuri, *Voting-Machine Risks*, Nov. 11, 1992, 2 pages.
*The Risks Digest*, vol. 2, Issue 22, Mar. 5, 1986, 4 pages, includes inter alia: Michael McGlaughlin, Voting Receipt, http://catless.ncl.ac.uk/Risks/2.22.html Tom Benson, Computerized Voting, http://catless.ncl.ac.uk/Risks/2.22.html.
*The Risks Digest*, vol. 2, Issue 24, Mar. 8, 1986, 4 pages, includes inter alia: Kurt Hyde, Progress Report on Computerized Voting, http://catless.ncl.ac.uk/Risks/2.24.html.
*The Risks Digest*, vol. 10, Issue 78, Jan. 22, 1991, 6 pages, includes inter alia: Evan Ravitz, Voting by Phone, http://catless.ncl.ac.uk/Risks/10.78.html.
Strini Giorgio, *Data Capture and Processing Device, Particularly for Voting and Associated Polling*, Abstract of IT No. 1234224, Patent for Industrial Invention, Date: May 6, 1992, 1 page.
Bruce Schneier, *Applied Cryptography*, Second Edition ©1996, Cover and title pages, Chapter 6, pp. 125-147, 170-175 185-187 and 587.
Rebecca Mercuri, Physical Verifyability of Computer Systems, *Secure Networks*, Proceedings: Fifth International Computer Virus & Security Conference, 1992, 11 pages.
*The Risks Digest*, vol. 2, Issue 23, Mar. 6, 1986, 5 pages.
*The Risks Digest*, vol. 16, Issue 52, Oct. 31, 1994, 11 pages.
*The Risks Digest*, vol. 21, Issue 10, Nov. 7, 2000, 10 pages.
*The Risks Digest*, vol. 22, Issue 66, Apr. 1, 2003, 11 pages.
*The Risks Digest*, vol. 22, Issue 54, Feb. 3, 2003, 11 pages.
*Granite Creek Technology Incorporated Report No. OR9202*, "Certification Tests of the OPTECH IV-C Model 400 Central Ballot Tabulator", Jul. 7, 1992, 14 pages (S003596-S003609).
Granite Creek Technology Incorporated Report No. KS9305, "Certification Tests of the OPSCAN 5/TeamWork Electronic Voting System", Dec. 15, 1993, 10 pages (S003656-S003655).
"OPTECH IV-C Central Ballot Counter Operator's Manual", Jul. 29, 1990, 46 pages (S003610-S003655).
Federal Election Commission, "Performance and Test Standards for Punchcard, Marksense, and Direct Recording Electronic Voting Systems" Jan. 1990, 204 Pages.
CJvK Translation 10206 It:Eng Patent Application No. 1234224; prepared May 6, 1992; 22 pages.
A. Riera, J. Borrell, J. Rifa, "An uncoercible verifiable electronic voting protocol," Proceedings of IFIP SEC '98, Online, Sep. 4, 1998, XP002272039, 10 Pages.
D. Dill, R. Mercuri, P. Neumann, D. Wallach, "Frequently Asked Questions about DRE Voting Systems", http://www.verifiedvoting.org/drefaq.asp, printed Aug. 24, 2004, 7 pages.
The Open Voting Consortium, "Frequently Asked Questions (FAQ)", ©2004 http://www.openvotingconsortium.org/faq.html, printed Aug. 24, 2004, 17 pages.
Verified Voting Foundation, "E-Voting Misconceptions", http://www.verifiedvoting.org/article.asp?id+2609, printed Aug. 24, 2004, 3 pages.
A. Dechert, "Statement at Utah State Capital", Jul. 13, 2004, http://www.openvotingconsortium.org/ad/alan-ut-7-13.html, printed Aug. 24, 2004, 2 pages.
M. Shamos, "Paper v. Electronic Voting Records—An Assessment", Apr. 2004, http://euro.ecom.cmu.edu/people/faculty/mshamos/paper.htm, printed Aug. 24, 2004, 20 pages.
A. Dechert, "OVC Response to Paper v. Electronic Voting Records—An Assessment, by Michael Ian Shamos", Jul. 30, 3004, http://gnosis.python-hosting.com/voting-project/July.2004/0240.html, printed Aug. 24, 2004, 6 pages.
K. Zetter, "California Bans E-Vote Machines", Apr. 30, 2004, http://www.wirednew.com/news/evote/0,2645,63298,00.html?tw=wn_story_page_prev2, printed Jun. 22, 2004, 3 pages.
Associated Press "Prototype E-Vote Printer Fails to Satisfy", ©2005, Feb. 3, 2005, 2 pages, http://start.earthlink.net/channel/news/print?guid=20050203/4201afd0_3ca6_15526200502....
R. Mercuri, "Computer Security Act and Computerized Voting Systems", Nov. 27, 1992, Risks Digest vol. 14: Issue 11, pp. 3-4.

Westinghouse DataScore Systems, "Optical Mark Reader Systems", no date marked; prior to Mar. 30, 2007; 13 pages.
Tallone, "Business Point of View: A Better Voting System", ca. 2004, 2 pages.
Election Systems & Software, "Integrated Hardware Solutions", ©2001 (on last sheet, but date "Oct. 6, 2004" on sheet AV-17423), 14 pages.
National Computer Systems, "Precept Image System", ©1991 or 1992, 10 pages.
*The Risks Digest*, vol. 21: Issue 23; Jan. 30, 2001; 12 pages.
Global Election Systems, Inc., "AccuVote-TS", http://www.archive.org/web/20000830141622/http:/www.gesn.com/AccuVote-TS/accuvot..., Web Archive date 20000830, 4 pages.
VoteHere, Inc., "November Election in Arizona and California will be first-ever cooperative trial of online voting", "VoteHere Platinum" and "VoteHere Gold", http://web.archive.org/web/20001019071003/votehere.net/VH-Content-v2.0/default.htm, Web Archive date 20001019, 5 pages.
Diebold Election Systems, "Election Solutions Diebold Election Systems Solutions", "Election Solutions AccuVote-TS", "Election Solutions AccuVote-OS", and "Election Solutions Global Election Management System—GEMS", http://web.archive.org/web/20020811050628/www.diebold.com/solutions/election/solutio..., Web Archive date 20021003, 10 pages.
Peripheral Dynamics, Inc., "Pagescan II", no date marked; prior to Mar. 29, 2007; 2 pages.
Avante International Technology, Inc., "Optical Vote-Trakker: A "Mark-Sense" Absentee & Precinct-Based Voting System that Minimizes Both Voter and System Errors", Jan. 2004, 7pg.
European Patent Office, "Communication Pursuant to Article 96(2) EPC", Application No. 01273930.6, May 8, 2004, 10 pages.
European Patent Office, "Communication Pursuant to Article 96(2) EPC", Application No. 01273930.6, Jun. 20, 2005, 10 pages.
European Patent Office, Communication, Application No. 01273930.6, Oct. 15, 2004, 8 pages.
D. Dixon, "Technology & the Polls: Rebecca Mercuri", Nov. 15, 2000, 8 pages.
Internet Archive Wayback Machine, VoteHere.net, The Secure Internet Voting Company, http://web.archive.org/web/*/http"//votehere, HL00068-HL00092, allegedly Oct. 19, 2000, printed May 8, 2007, 25 pages.
Avante International Technology, Inc., "Optical Vote-Trakker™: A "Mark-Sense" Absentee & Precinct Based Voting System that Minimizes Both Voter and System Errors", link available at http://www.vote-trakker.com/optical.html, Jan. 2004, 10 pages.
Avante International Technology, Inc., "Avante Optical VOTE-TRAKKER™", © 2001-2004, 2 pages, printed Jun. 11, 2007.
Avante International Technology, Inc., "Avante VOTE-TRAKKER™"and "Avante VOTE-TRAKKER™ Overview", Mar. 16, 2004, 6 pages, printed Jun. 11, 2007.
Avante International Technology, Inc., "Avante VOTE-TRAKKER™ EVC308-SPR"and "Avante VOTE-TRAKKER™ EVC308-SPR-FF", © 2001-2004, 6 pages, printed Jun. 11, 2007.
Avante International Technology, Inc., "Accessible Voting Integrating the Touch-Screen Accessibility of DRE System with the Optical Scanning Paper Ballots", © 2001-2004, certain parts updated Mar. 16, 2004, Apr. 8, 2004 and May 18, 2004, 17 pages, printed Jun. 11, 2007.
Federal Election Commission, "Voting Systems Performance and Test Standards" Overview and vols. I & II, 2002, 307 pages.
Ramin Safarl-Foroushani, "Form Registration: A Computer Vision Approach", © 1997, 121 pages.
Ashraf Nasr Sayed, "Extraction and Photogrammetric Exploitation of Features in Digital Images", Aug. 1990, 263 pages.
Scientific Translation Services, "*Novel Voting Process and Means for Carrying Out Same*," [EPO 0 419 335 A1] English Translation of coloum 1-10, (Translated May 2004), 8 pages.
Benaloh J et al, "Receipt-Free Secret-Ballot Elections (Extended Abstract)," Proceedings of the Annual ACM Symposium on the Theory of Computing, XX, XX, 1994, pp. 544-551, XP002099996.
Roy G. Saltman, "Effective Use of Computing Technology in Vote-Tallying", Mar. 1975, 139 pgs.
Douglas Jones, "A Brief Illustrated History of Voting", 2001, 18 pages.
North American Professional Technologies, "Vote Tally System Ballot Production Guide", Jun. 1989, 16 pages.
Michael I. Shamos, "American Information Systems, AIS 115 and 315 Vote Tabulation Systems, An Evaluation", Dec. 1989, 9 pages.
Michael I. Shamos, "American Information Systems, AIS 150 and 550 Mark-Sense Vote Tabulation Systems and Election Reporting System (ERS), An Evaluation", Mar. 1994, 5 pages.
Michael I. Shamos, "Business Records Corporation, Optech IV-C Model 200 Mark-Sense Central Tabulation Unit, An Evaluation", Nov. 1991, 8 pages.
Michael I. Shamos, "American Information Systems, AIS 315 Ballot Counter, An Evaluation", Nov. 1983, 5 pages.
Michael I. Shamos, "The Sequoia Pacific Datavote System, An Evaluation", Jun. 1984, 7 pages.
Michael I. Shamos, "Shoup Corporation, Shouptronic Direct Recording Electronic Voting System, An Evaluation", Jul. 1991, 3 pages.
American Information Systems, Inc., AIS Model 150 Central Ballot Scanner Operator's Manual Version 5.6.1.7, ©1997, Apr. 1997, 64 pages.
Peripheral Dynamics, Inc., "Manufacturing Request", Oct. 3, 2001, 1 page.
Peripheral Dynamics, Inc., "Specification No. 3-1308-7071D for Peripheral Dynamics, Inc., Pagescan II Full-Page Image Scanner", Sep. 6, 2000, 52 pages.
Peripheral Dynamics, Inc., "SlipEdit User Manual No. 3-1305-7034B", Undated, 5 pages.
Intellectual Property Office of the People's Republic of China, "Search Report for Hong Kong Short-Term Patent Application No. 10103450.5", including a brief translation, Jul. 15, 2010, 6 pages.
Industrial Property Digital Library—Japanese Patent Office, "Machine Translation of Japanese Patent Publication No. 2005-025392", published Jan. 27, 2005, 14 pages.
State Intellectual Property Office of the People's Republic of China, "Machine Translation of Chinese Patent Publication No. 1804905", published Jul. 19, 2006, 8 pages.
State Intellectual Property Office of the People's Republic of China, "Machine Translation of Chinese Patent Publication No. 101086691", published Dec. 12, 2007, 24 pgs.

* cited by examiner

SYSTEM AND METHOD FOR DECODING AN OPTICALLY READABLE MARKABLE SHEET AND MARKABLE SHEET THEREFOR

This Application claims the benefit of:
U.S. Provisional Application Ser. No. 61/279,432 filed Oct. 21, 2009, which is hereby incorporated herein by reference in its entirety.

The present invention relates to a system, method and sheet, and in particular, to a system and method for decoding an optically readable sheet and to an optically readable decodable sheet, of a sort that may be employed for voting or testing or other purposes.

Current election laws and regulations in certain jurisdictions require a paper record of a voter's voting selections made on a paper ballot, e.g., a conventional "mark-sense" ballot, and that such ballot and/or sheet must be preserved. Perhaps more commonly, a paper voting record or ballot may be utilized for absentee voting and/or for provisional voting. Absentee voting is where a voter who will be absent from the jurisdiction or otherwise unable to be present at a designated polling location during the time for voting is issued a paper ballot in advance of the election and votes by completing and submitting the paper absentee ballot by hand, mail, messenger, or other permitted means. Provisional voting is where a voter who is unable to establish his eligibility to vote at a polling place during an election is issued a paper ballot and is permitted to vote thereby "provisionally," i.e. by sealed paper provisional ballot that is only opened and counted if the eligibility of the provisional voter to vote is established by election officials after the time for voting ends.

The prevalent paper ballot is an optically read or optically scanned paper ballot on which a voter marks his voting selections by darkening or otherwise marking one or more regions typically indicated by an outline in the shape of a circle, oval, rectangle, square or other desired closed shape. The marking areas of such conventional "mark-sense" ballots are typically arranged to be read by a conventional ballot reading machine. A different paper ballot, i.e. a customized ballot, is typically required to be prepared for each election and jurisdiction, e.g., voting district or precinct, and so a corresponding decoding template is provided for each different paper ballot.

When a person marking such ballot or sheet either marks a space different from the one he intended to mark or changes his mind as to which space to mark, he must somehow "correct" the unwanted mark. One way is to erase the first mark and make a new mark in a different mark space. If the original mark is completely erased, then the sheet will likely be decoded properly by the optical reader, however, the sheet still contains the erasure which could also evidence tampering in changing the selection made. But making a complete erasure can be quite difficult, if not practically impossible. Moreover, in certain instances erasures may not be permitted because after the fact it cannot be determined whether the erasure was made by the person marking the sheet or is an indication of tampering with the sheet.

For this and other reasons, a mis-marked sheet may be required to be turned in for a replacement sheet, e.g., to request a replacement ballot in an election context, rather than to be changed by erasing. The turned in ballot/sheet is typically marked as "VOID" so that it is not processed as a valid ballot/sheet. Controlling and accounting for each sheet, e.g., original sheets and replacement sheets, where such is either required or desired, e.g., as for ballots in an election context, can become burdensome. Moreover, it requires that a larger number of sheets/ballots be printed and distributed than would otherwise be needed, which not only adds to the cost, but also can increase the possibility of someone "acquiring" one of the extra sheets and fraudulently marking and submitting it. It is believed that in some countries the election laws do not permit excess ballots to be printed so as to avoid the potential fraud issue.

Further, if replacement sheets/ballots are not available, a voter must use erasure to correct his ballot, and so incomplete erasure can lead to other problems. If a mark on the markable sheet is not completely erased, then the optical reader may read the "erased" mark as a valid mark resulting in recording a selection other than the selection intended or in recording plural markings which could, in the case where the sheet is utilized as an election ballot, result in the intended mark being disregarded or in the selection, and possibly the complete ballot, being voided as being "over-voted." The incomplete erasure problem is more prevalent where ballots must be marked in ink, principally for security against unauthorized changes and permanency, and not in pencil which is erasable. Moreover, some optical scanners are understood to not recognize pencil marks, and so require ink markings.

Both the availability of extra ballot sheets and the marking of ballots with a non-permanent marking can increase the possibility of voting fraud committed by changing (tampering with) valid ballots and/or submitting extra ballots ("stuffing" the ballot box).

Similarly, in testing and/or surveys, for example, sheets having mark spaces thereon for marking selections are provided for the person being tested or surveyed to mark his selections in the mark spaces thereon. Such test and survey sheets are "read" by conventional sheet reading machines. Similarly to balloting, when a person marks an incorrect space and/or desires to change a space marked, he must either attempt to erase the erroneous mark or remark his selections on a new sheet, with the attendant problems.

Accordingly, it would be desirable to have a markable sheet, and a system and method for decoding the markable sheet, such as an optically scanned or optically read sheet, wherein the person marking the sheet has the ability to easily change a marked selection without needing a new sheet and without erasing, and wherein such change may be accurately decoded.

To this end, apparatus for reading an optically readable markable sheet having selection mark spaces thereon and having voiding mark spaces associated with the selection mark spaces, wherein the voiding mark space associated with that selection mark space is markable for voiding a selection marked therein, the apparatus may comprise: a memory storing an image of the markable sheet; a processor decoding a sheet identifier for selecting a template and decoding the selection mark spaces and the voiding mark spaces in accordance with the selected template; the processor determining marked selection mark spaces and marked voiding mark spaces in accordance with the selected template, the processor voiding a selection marked in a selection mark space if the voiding mark space associated therewith is marked; and wherein a record of at least the unvoided determined marked selection mark spaces is stored in the memory.

In another aspect, a method for decoding an optically readable markable sheet having selection mark spaces thereon and having voiding mark spaces thereon, wherein each voiding mark space is associated with one of the selection mark spaces, and wherein a voiding mark space associated with a selection mark space may be marked for voiding the selection marked therein, the method may comprise:

storing an image of the markable sheet including the selection mark spaces and the voiding mark spaces in a memory;

decoding a sheet identifier for selecting the template and decoding the selection mark spaces and the voiding mark spaces in accordance with the selected template;

determining marked selection mark spaces and marked voiding mark spaces in the in accordance with the selected template, voiding a selection marked in a selection mark space if the voiding mark space associated therewith is marked; and storing a record of at least the determined marked selection mark spaces that are not voided in a memory.

In yet another aspect, an optically readable markable sheet may comprise:

a sheet of material having selection mark spaces and voiding mark spaces thereon, wherein the selection mark spaces are markable for making selections and each voiding mark space is markable for voiding the marking of an associated selection mark space, wherein marking a voiding mark space associated with a selection mark space indicates not making that selection; and wherein the selection mark spaces and the voiding mark spaces are in defined locations on the optically readable markable sheet, and the selection mark spaces and the voiding mark spaces are optically readable.

BRIEF DESCRIPTION OF THE DRAWING

The detailed description of the preferred embodiments of the present invention will be more easily and better understood when read in conjunction with the FIGURES of the Drawing which include.

Figure 1:
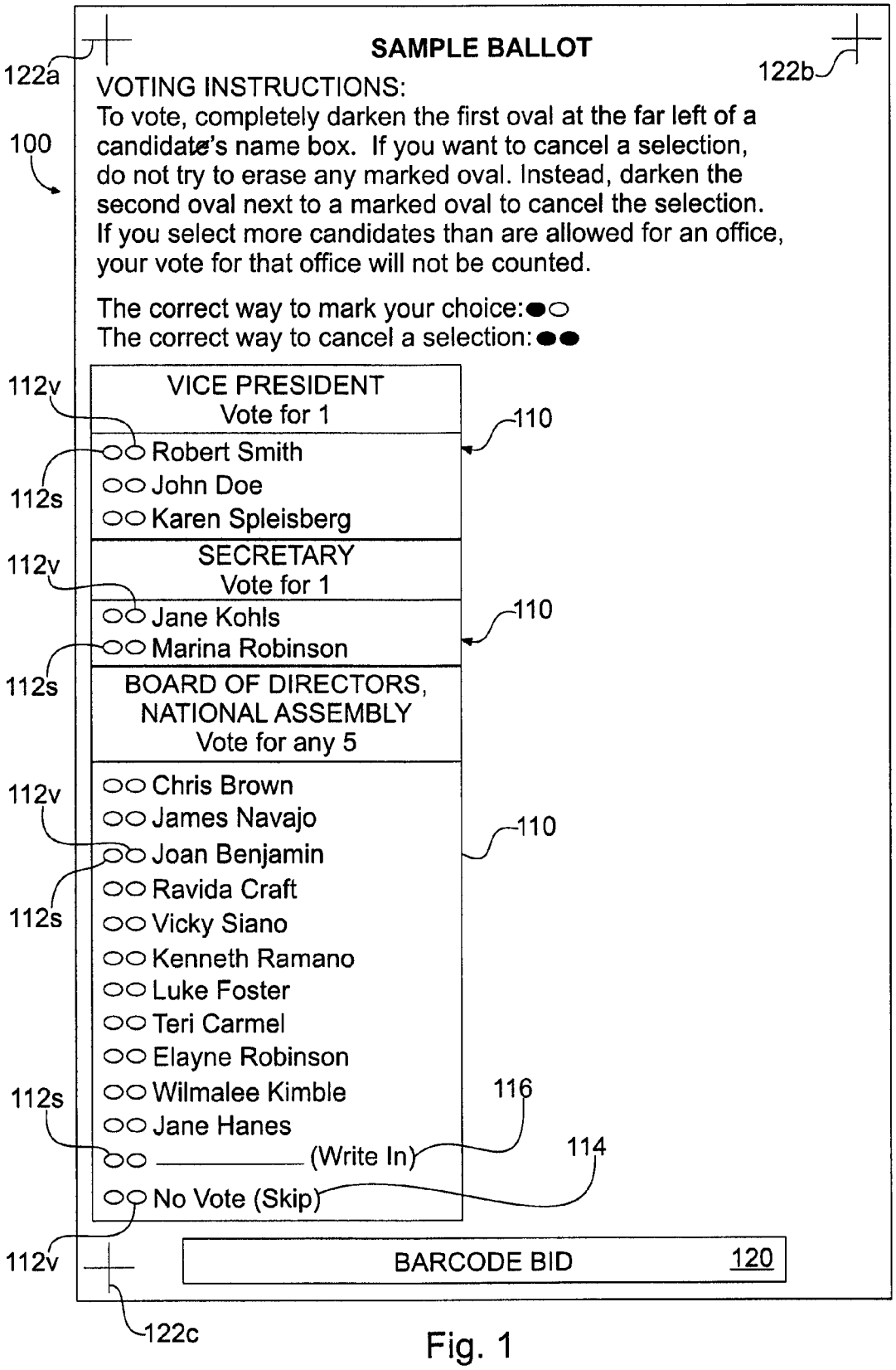
FIG. 1 is a schematic diagram illustrating an example markable sheet formatted as a ballot that is intended to be read by an optical reader.

In the Drawing, where an element or feature is shown in more than one drawing figure, the same alphanumeric designation may be used to designate such element or feature in each figure, and where a closely related or modified element is shown in a figure, the same alphanumerical designation primed may be used to designate the modified element or feature. Similarly, similar elements or features may be designated by like alphanumeric designations in different figures of the Drawing and with similar nomenclature in the specification, but in the Drawing are followed by a character unique to the embodiment described. It is noted that, according to common practice, the various features of the drawing are not to scale, and the dimensions of the various features are arbitrarily expanded or reduced for clarity

DESCRIPTION OF THE PREFERRED EMBODIMENT(S)

The arrangement of the present application may operate in conjunction with an electronic voting machine, also referred to as electronic voting apparatus and/or as a direct recording electronic (DRE) voting apparatus, and/or an optical voting system or optically scanned ballot system of many different types. Examples of suitable voting apparatus and systems, and methods employed therewith, are described, for example, in U.S. Pat. No. 7,036,730 entitled "Electronic Voting Apparatus, System and Method" issued May 2, 2006, in U.S. Pat. No. 7,431,209 entitled "Electronic Voting Apparatus, System and Method" issued Oct. 7, 2008, in U.S. Pat. No. 6,892,944 entitled "Electronic Voting Apparatus and Method for Optically Scanned Ballot" issued May 17, 2005, in U.S. Pat. No. 7,077,313 entitled "Electronic Voting Method for Optically Scanned Ballot" issued Jul. 18, 2006, in U.S. Pat. No. 7,635,087 entitled "Method for Processing a Machine Readable Ballot and Ballot Therefor" issued Dec. 22, 2009, in U.S. Patent Publication 2006/0202031 entitled "Reader for an Optically Readable Ballot" dated Sep. 14, 2006, and in U.S. Patent Publication 2009/0289115 entitled "Optically Readable Marking Sheet and Reading Apparatus and Method Therefor" dated Nov. 26, 2009, which patents and patent publications are hereby incorporated herein by reference in their entireties.

FIG. 1 is a diagram illustrating an example markable sheet 100 formatted as a ballot that is intended to be read by an optical reader. Example ballot sheet 100 includes four regions 110 each containing information pertaining to a particular election contest or question and a number of marking regions or mark spaces 112 therein in which a voter makes a mark to select one or more voting selections for the particular election contest or question. Mark spaces 112 may be any convenient closed shape and provide a defined area in a defined location in which a voter marks his voting selections by darkening or otherwise marking therein. Mark spaces 112 are typically indicated by an outline in the shape of a circle, oval, rectangle, square or other desired closed shape. After the ballot 100 is marked by the voter, it is voted (e.g., deposited in a ballot box or otherwise submitted) and is read and tabulated, typically by a reading machine or reader that optically reads or senses the defined mark spaces to determine whether each mark space 112 is marked or unmarked, thereby indicating a voting selection. The reading machine is programed to define a "template" corresponding to the locations on the ballot sheet where each of the contests/questions 110 and the respective mark spaces 112 therefor are located.

In the example illustrated, a first region 110 designated "VICE PRESIDENT Vote for 1" contains the names, and optionally party affiliations, of candidates for "Vice President" and a mark space 112 for each candidate, as well as optional mark spaces 112 for a "Skip Contest" or "No Vote"

(abstain) selection 114 and optionally for a write-in candidate selection 116. A second region 110 designated "SECRETARY Vote for 1" contains the names, and optionally party affiliations, of candidates for "Secretary" and a mark space 112 for each candidate, as well as optionally mark spaces 112 for a "Skip Contest" or "No Vote" (abstain) selection 114 and optionally for a write-in candidate selection 116. A third region 110 designated "BOARD OF DIRECTORS, NATIONAL ASSEMBLY Vote for any 5" contains the names, and optionally party affiliations, of candidates for "State Senator" and a mark space 112 for each candidate, as well as mark spaces 112 for a "Skip Contest" or "No Vote" (abstain) selection 114 and for a write-in candidate selection 116.

For each possible selection, the mark space 112 includes a selection mark space 112S for making the selection and an associated voiding mark space 112V for voiding the selection made in the associated selection mark space 112S. Preferably, the voiding mark space 112V is near to, and preferably adjacent to, its associated selection mark space 112S. If the person marking the sheet 100 marks a selection mark space 112S and desires to change that selection, e.g., because the mark space 112S was marked in error or because of a change in intention, that selection made is voided by marking the associated voiding mark space 112V and then making another selection by marking a different selection mark space 112S on the same sheet 100. Thus, the person may change the selection made without having to erase the original selection or obtain another sheet 100.

In addition, each ballot preferably includes a ballot number 120, also known as a ballot identifier number or ballot style identifier, commonly abbreviated as "BID." Identifier or BID 120 is preferably located at a predefined location on ballot 100, e.g., near the bottom center as illustrated. BID 120 may be provided in any convenient machine readable format, including but not limited to a bar code, two-dimensional bar code, a prescribed font, optical character recognition (OCR) characters, alphanumeric characters, non-alphanumeric characters, symbols, and the like. Typically, however, a human-readable number 120N and an equivalent simple machine-readable bar code 120C are satisfactory.

Example sheet 100 is intended to be read by an optical reader, and may optionally include a number of orientation indicia or fiducial marks 122 that are located in predetermined asymmetric positions that when read by a ballot reader may be utilized to define the orientation of sheet 100. Although only one indicia or fiducial mark 122 is necessary to define sheet orientation, and will satisfactorily define the orientation of sheet 100 for reading by an automatic ballot reader, plural (at least two or more) indicia or fiducial marks 122 are preferred so that the orientation of sheet 100 may be determined even when sheet 100 is not properly and precisely aligned for reading by a sheet reader and so that the scale of the sheet may be determined.

In particular, orientation indicia or fiducial mark 122*a* near the upper corner of sheet 100 and orientation indicia or fiducial marks 122*b* and 122*c* near the lower edge, e.g., near the right-hand and left-hand corners of sheet 100 define the orientation of sheet 100 and, because the predetermined positional locations of indicia or fiducial marks 122*a*, 122*b* and 122*c* are precisely known, i.e. they are spaced apart a predetermined distance, orientation indicia or fiducial marks 122 also define the scale and/or size of sheet 100. Further, each mark space 112 is in a predetermined position relative to indicia or fiducial marks 122, and so the relative locations of all mark spaces 112, as well as any other location on sheet 100, can be determined from fiducial marks 122, whether or not a mark space 112 has been marked. Where sheets 100 are imaged, the positions of each indicia or fiducial mark 122 and of each mark space 112 is defined in the same coordinate system as are the pixels of the sheet image, e.g., in X-Y coordinates, thereby to facilitate the "reading" of the ballot via its sheet image, e.g. to determine which mark spaces 112 are marked to indicate a selection. Where sheets 100 are read by an optical mark reader, the presence of fiducial marks may be determined by their being located in positions readable by the optical mark reader.

Comparing the predetermined relative positions and/or spacings of indicia or fiducial marks 122 with the imaged positions thereof permits the scale/size of the sheet image and the position of each mark space 112 to be determined. This is helpful for normalizing the ballot image provided by the sheet reader as well as for locating the proper positions of sheet identifier 120 and of marking areas 112 as defined by the appropriate sheet template. Scaling and/or normalizing the size of the sheet image can be utilized to compensate for small changes in the size of sheets, e.g., due to stress, moisture content and the like, thereby to avoid any inaccuracy that might otherwise result therefrom.

Suitable indicia or fiducial marks include, for example, cross-hair lines, cross-hair lines in a circle, targets, bulls-eye shapes, bullets, "+" marks, "X" marks, boxes, any of the foregoing with one or more black, darkened or contrasting adjacent sections, and/or any combination thereof. Symmetrical indicia or fiducial marks that uniquely define their own center are preferred. Indicia or fiducial marks 122 and/or the pattern thereof may be standardized for all sheets and/or may be different for different sheets and defined by the template therefor. Indicia or fiducial marks 122 may located be any location(s) suitable for defining the orientation, and preferably also defining the scale/size, of sheet 100. To this end, an odd-number of indicia or fiducial marks 122 disposed in an asymmetric pattern are preferred. Where a two-sided or plural sheet form is utilized, each sheet and/or side includes marking indicia or fiducial marks 122.

In addition, where a ballot or form is too long to be provided on one sheet, plural sheets may be provided with a page number identifier on each sheet that is read and utilized to select the proper sheet template or to determine the portion of a selected sheet template applicable to each sheet of the ballot or form. Preferably, page number identifiers are human-readable and machine-readable, such as a numeral in a font easily read by a computer reader.

Further, in an election context, so-called "summary" ballots may be utilized wherein the candidates and questions are provided in a booklet, and each candidate and/or response is identified in the booklet by a number; in this case, the mark spaces 112 of the summary ballot are each associated with one of the numbers set forth in the booklet. mark spaces 112 for each selection include a selection mark space 112S and an associated voiding mark space 112V. In addition, a candidate name and/or response selection (e.g., a "yes" or "no") may be printed on the summary ballot with the number.

Figure 2:
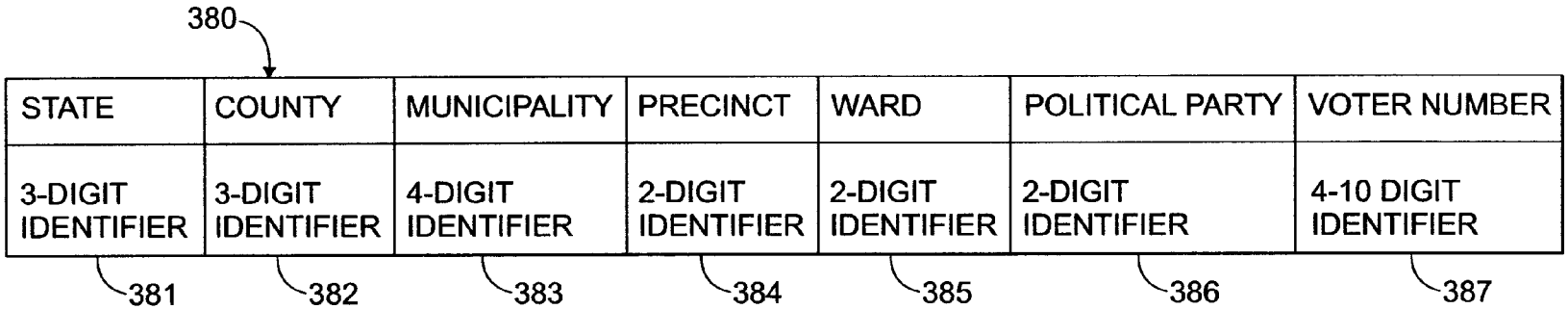
FIG. 2 is a schematic diagram illustrating an example format for a ballot identifier (BID)

FIG. 2 is a schematic diagram illustrating an example format 380 for a ballot identifier (BID) 120. BID 120 is a sequence of numbers or other alphanumeric characters or symbols that uniquely identify a sheet 100 and provide voting information relating to the sheet that may be utilized in determining the information marked on the sheet 100, e.g., in a voting context by a voting machine or by a ballot reading machine or by election officials. BID format 380 includes, for example, six different informational fields 381-386. In a voting context, field 381 includes a number of characters, typically 3, that uniquely identify the state of voter residence to which sheet 100 pertains and field 382 includes a number of characters, typically 3, that uniquely identify the county of voter residence to which sheet 100 pertains. Fields 381-386 may be used for automatic reading and tabulation of different sheets/ballots without manual or other sorting prior to their being read and tabulated, as well as for absentee and provisional voting. While a three-digit numerical field is typical, providing up to 999 different entries, two-digit fields may be utilized where a lesser number (i.e. 99 or less) of possible entries are needed, as in the United States where there are only 50 states. Any field may be of greater or lesser number of characters as is convenient.

Field 383 includes a number of characters, typically 4, that uniquely identify, e.g., in a voting context, the municipality of voter residence, field 384 includes a number of characters, typically 2, that uniquely identify the voting precinct or district within the county or municipality, and field 385 includes a number of characters, typically 2, that uniquely identify the voting ward, if any, within the voting precinct or district. Field 386 includes a number of characters, typically 2, that may uniquely identify the political party affiliation of the contests 110 on a ballot sheet 100 if, e.g., separate ballot sheets are provided for the different parties in a party primary election. Even where a single ballot sheet is used for all parties, if any affiliation has been declared by the voter, field 386 may be utilized for correlating a selection of a party with the declared political party for voting in a party primary election or for straight party voting, where permitted.

Field 387 includes a number of characters, typically 4-10, that uniquely identifies the particular ballot sheet in the applicable county, voting precinct, district and/or ward, as the case may be, or may identify the particular sheet independently of the county, precinct, etc. to which it may pertain. The random generated number, field 387, is a randomly-generated unique identifier that is printed on a ballot prior to the election, and may or may not be traceable to the identity of a particular voter, as desired for security and privacy. The same unique identifiers as are printed on paper ballots, e.g., for absentee and/or provisional voting, may be stored in a voting machine or in a vote tabulating machine for verifying the authenticity and uniqueness of ballot when it is tabulated.

In the United States, voting is typically conducted on a state by state basis, and most states delegate to its counties the conduct of elections. In local voting, i.e. voting wherein a particular voting machine is dedicated for voting by voters of a particular county, municipality, precinct, district or ward, fields 382-385 may be utilized by the voting machine or vote tabulating machine to verify that the voter is using the proper ballot form before the voting session is initiated and/or before the voting selections marked on the ballot are tabulated, e.g., in voter review of a marked ballot and/or in provisional voting. Typically in local voting, the voting machine is situated in a location in a particular precinct, district or ward and voters from that particular voting precinct, district or ward come to that location to vote, and provisional and/or absentee voters may vote using such voting machines even though their voting selections are then reproduced on a printed ballot, e.g., as printed by a printer associated with the voting machine.

Data from fields 381-386 may be utilized to select the voting screens and/or voting contests to be presented on a voting machine and/or on one or more printed ballot sheets that together comprise a proper complete election ballot for that voter in a given election. Each voting machine may generate on a voter-by-voter basis a complete election ballot by selectively combining, for example, a "general ballot" including one or more voting contests 110 that are to be presented to all voters, a "residence-specific ballot" including one or more voting contests 110 to be presented to voters according to their residence, and/or a "party-specific ballot" including one or more voting contests 110 to be presented to voters in a party primary election according to their party affiliation. Thus, a voting machine and/or ballot printer is not constrained or limited to local voting, but may be utilized for county-wide or state-wide or nation-wide voting, for regional voting, and/or for remote voting.

Where voters are issued a chip card or smart card containing his unique voter identifier (VID) number and an electronic voting machine is utilized for printing paper ballots, the voting machine may be responsive to voting jurisdiction information of fields 381-386 read from each voter's chip card for providing a ballot to the voter and may retain the chip card for the writing of the voter's voting selections therein and then may collect the chip card in a collection container or may allow an election official to have the chip card. Optionally, the voting machine and/or vote tabulating machine may reject the chip card and/or the paper ballot 100 if the voter registration information 381-386 and/or the unique identifier 387 read therefrom do not match corresponding information stored in the voting machine and/or vote tabulating machine, and may return or collect the chip card. In either case, the chip card once inserted into the voting machine may be retained in a way that the voter may not retrieve the chip card, e.g., for securing the card against use to vote more than once. For provisional voting, the chip card may be likewise retained until the voting selections of a provisional voter are stored therein, and then may be returned to the provisional voter and/or a voting official, e.g., with a proper authorization. Unique identifiers 387 once used for an election may be "retired" and not used in one or more subsequent elections as a means to reduce the likelihood of fraudulent in a future election, e.g., either as a BID number 120 and/or by a counterfeit smart card.

Figure 3B:
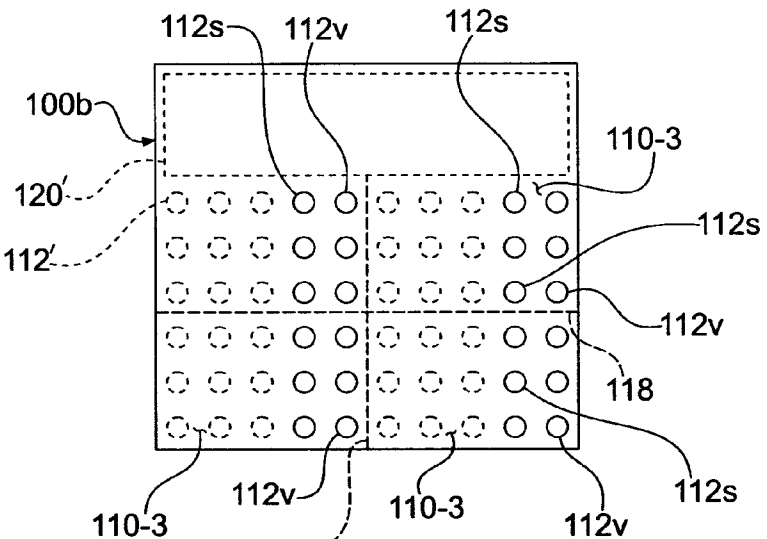
FIGS. 3A and 3B are schematic diagrams illustrating a generalized example ballot intended to be read by an optical reader.
Figure 3A:
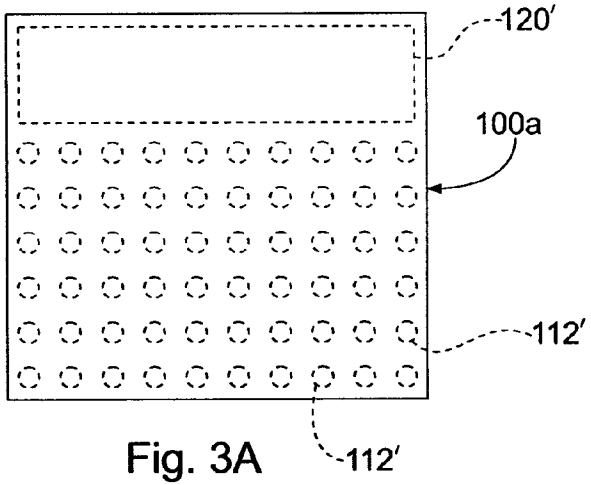

FIGS. 3A and 3B are schematic diagrams illustrating a generalized example ballot 100 intended to be read by an optical reader. Generalized ballot format 100*a* of FIG. 3A has a plurality of locations 112' at which mark spaces 112 may be provided and has a region 120' in which a BID number 120 may be represented. Ballot format 100*a* is generalized in that it illustrates example possible mark space locations 112' and a relatively large region 120' in which a BID number 120 representation may be provided. In practice, mark spaces 112 and BID 120 may be located in any position compatible with the optical imager or optical mark reader that will produce the image of marked sheet 100 and with the decoder that will decode the image of sheet 100 to determine the selections marked thereon, however, any particular producer of sheets 100 may choose to limit such positions 112', 120' to achieve a particular style or "look." An actual ballot format will typically be on a standardized paper or other sheet, such as an 80-column machine readable card or an 8½×11 inch or an A4 size paper, and have many more possible mark space locations 112'. When sheet 100 is to be read by an optical mark reader, mark spaces 112 and BID marks 120 will be located in positions that can be read by the optical mark reader.

In any particular ballot 100, less than all of the possible mark space locations 112' will be utilized as mark spaces 112 and less than the entire region 120' will typically be utilized for providing the BID number 120 representation. Generalized ballot format 100*a* represents an example ballot pattern from which particular ballots 100 and areas for particular contests 110, each utilizing specific selected ones of mark space locations 112', according to a template, may be provided.

FIG. 3B illustrates an example ballot 100*b* which is provided from a ballot format 100*a* on which contest regions 110 are defined by dashed lines 118 in the region having the possible mark spaces 112' and in which ones of possible mark spaces 112' to be utilized for marking voting selections are mark spaces 112S, 112V defined by solid line circles, although other shapes may be utilized. The dashed lines 118 defining contest regions 110 and the mark spaces 112' that may be utilized together define a template for ballot 100*b*, i.e. define the pattern by which selections will be marked for each of plural contests as well as the pattern by which selections will be read by a vote tabulating machine or reader for each of the voting contests 110 in tabulating the selections. The template of example sheet 100*b* defines four contest areas 110 of the same size, with each having three active selection mark spaces 112S and three associated voiding mark spaces 112V. Each three mark space contest 110-3 might be utilized, e.g., for a contest among three candidates, or for a contest among three candidates where mark spaces are provided for a "No Vote" selection and a write-in selection, or for a public question or other "Yes-No" response matter where a mark space is provided for a "No Vote" or "Abstain" selection.

Figure 4:
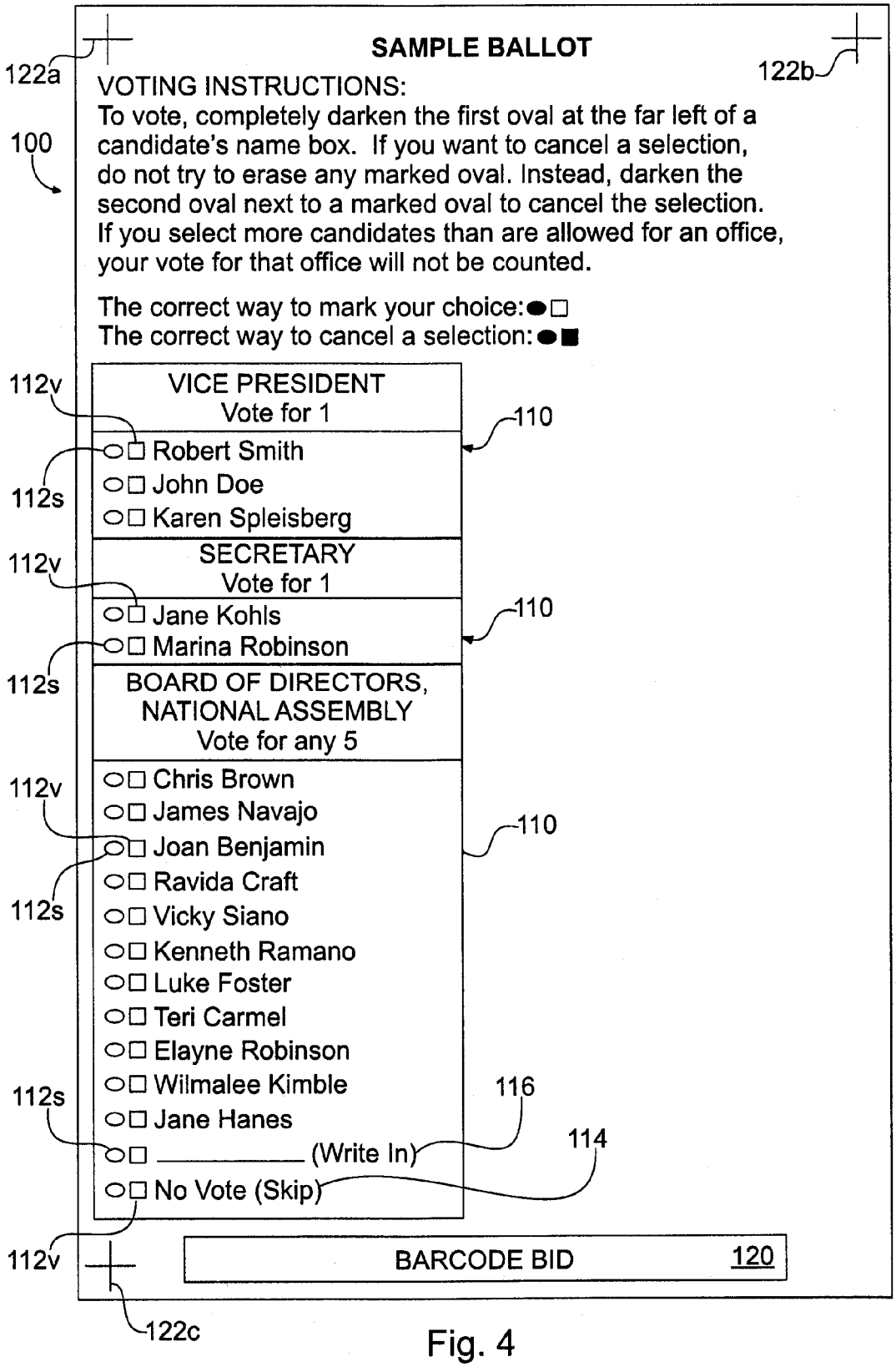
FIG. 4 is a schematic diagram illustrating an alternative example markable sheet formatted as a ballot that is intended to be read by an optical reader.

FIG. 4 is a schematic diagram illustrating an example markable sheet 100 formatted as a ballot as in FIG. 1 above except that the shape of the voiding mark spaces 112V are different from the shape of selection mark spaces 112S. In this particular example, voiding mark spaces 112V are rectangular or square while the selection mark spaces 112S are round, e.g., circular, elliptical or oval. Ballot 100 includes a plurality of contest areas 110 (each having a region wherein "NAME and other features of the contest" information identifying the particular contest is placed and wherein mark spaces for selecting a candidate are placed) and also includes a BID area 120, as described above. Any one or more contest areas 110 may be utilized for straight voting, for ranked voting and/or for cumulative voting, as may be the case for a particular election and/or contest. In all other respects, the use of ballot 100 of FIG. 4 is like that of ballot 100 of FIG. 1. Ballot 100 may include, and preferably does include, plural positional indicia 122 as described above.

While the example ballots illustrated herein are arranged for straight voting, ballots according to the present arrangement may also be used for ranked and/or cumulative voting, and that such ballots are similarly intended to be read by an optical reader. For ranked voting, the contest area 110 is arranged for conducting ranked voting wherein the voter may rank the candidates in his order of preference. Any number of candidates may be ranked, although if the number of candidates is relatively large, it may be desired to only provide for the ranking of the first N selections, where N is a reasonable number of selections, e.g., five or less. Filling one mark space 112S indicates first choice ranking, filling two mark spaces 112S indicates second choice ranking, and so forth, while also filling in a voiding mark space 112V reduces the number by one. The opposite sense, where marking a greater number of mark spaces for a candidate indicates a greater preference, could also be utilized. Thus, the selection mark spaces 112S that are associated with each candidate's name and with each write-in candidate position 116 would equal the number of candidates to be ranked, unless the number is large as stated above. Adjacent each selection mark space 112S is a voiding mark space 112V which when, marked indicates the voiding of the selection mark space 112 with which it is associated.

Optionally and/or alternatively, plural selection mark spaces 1125 may be associated with rank numbers, one for each ranking (e.g., a "1" mark space for first choice, a "2" mark space for second choice, a "3" mark space for third choice, and so forth) for each candidate in a contest. Corresponding voiding mark spaces 112V are also provided so that selection of a mark space 1125 may be voided by marking its associated voiding mark space 112V.

Ranked voting may be utilized for conducting an "instant run-off" where no candidate or an insufficient number of candidates receives sufficient first-choice votes to be elected (e.g., fails to receive a majority of the votes cast) under the election rules in effect. If no candidates win or fewer than the required number win, a run-off election is required. Conventionally the run-off election occurs later in time and incurs the expense of conducting a second election. In an instant run off, so called because the voting needed for the run off are cast in the initial election and so are immediately ("instantly") available. In an instant run-off election, candidate(s) receiving the least first choice votes are eliminated and the voters' second choice rankings of candidates other than those eliminated are then counted to determine the winner(s). One mark space 112 may be provided to skip the entire contest and/or to abstain 114 for the balance of that contest, i.e. to intentionally under vote. The voting apparatus and ballots described herein permit an instant run-off election to be conducted automatically and electronically if no winner emerges from the initial voting.

A contest area 110 of ballot 100 is arranged for conducting cumulative voting wherein the voter may distribute a given number of votes among the candidates in his order of preference, typically where more than one candidate is to be elected in a given contest. Cumulative voting allows the voter to distribute his vote among any one or more of the candidates rather than being limited to voting for or not voting for each candidate equally, as in straight voting. Any desired predetermined number of votes may be permitted, although the number may be limited to a reasonable number, e.g., five of less.

In one example, five votes may be cast (five selection mark spaces 112S may be marked) in the contest and the five votes may be cast for any one or more candidates. Filling more mark spaces 112 for a candidate indicates a greater number of votes, and thus a greater preference, for that candidate. Thus, five mark spaces 112S would be associated with each candidate's name and with each write-in candidate 116. One mark space 1125 may be provided to skip the entire contest and/or to abstain 114 for the balance of that contest, i.e. to intentionally under vote. For each selection mark space 1125 there is an associated voiding mark space 112V which when marked voids the marking of its associated selection mark space 1125, whereby the number of votes marked for a given candidate may be reduced.

Alternatively to providing plural mark spaces 1125, 112V for each candidate for conducting ranked and/or cumulative voting, mark space 1125 may be arranged as a seven-segment mark space wherein selected ones of the seven segment spaces thereof may be marked to define a numeral. For example, marking the two vertical segments at the left or at the right indicates the number "1", marking the top, middle and bottom horizontal segments and the upper right and lower left vertical segments indicates the number "2", marking all seven segments indicated the number "8", and so forth, in like manner to illuminating selected segments of a seven-segment display to display numbers. A voiding mark space 112V may be provided for each seven-segment mark space to void what ever may be marked in the segments of mark space 1125, and optionally an additional selection mark space 1125 may be provided for making a corrected selection.

Figure 5:
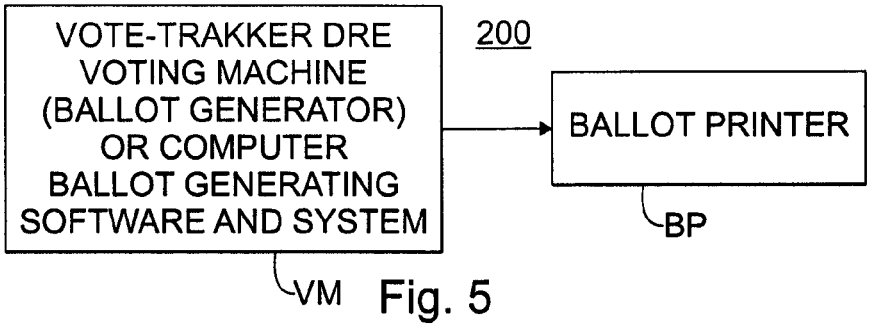
FIG. 5 is a schematic block diagram of an example ballot generating apparatus.

FIG. 5 is a schematic block diagram of an example ballot generating apparatus 200. Apparatus 200 includes a processor for generating ballots 100 from information provided thereto either by election officials entering contest information, candidate information and the like, i.e. for generating ballot form and/or formats for particular jurisdictions and/or sub-divisions thereof. The processor may be the processor included in an electronic voting machine that includes ballot generating capability, such as the VOTE-TRAKKER® direct recording electronic voting machine available from Avante International Technology, Inc. located in Princeton Junction, N.J., described in U.S. Pat. Nos. 7,036,730 and 7,431,209 or may be a computer running suitable ballot generating software.

Ballot printer BP may be a conventional ballot printer that prints ballots provided it is capable of printing the BID number 120 in machine- and/or human readable form and of printing the unique random portion of the BID 120, or may be a printer associated with voting machine VM. The actual format of ballots 100 will be in conformance to the applicable federal, state, county, and/or local legal requirements for election ballots, as is the case for conventional optically-scanned ballots. Thus, standardized paper sizes, e.g., 8½×11 inches or 8½×14 inches or A4 metric paper, may be utilized, and single-page ballot requirements, minimum font size standards, candidate ballot space standards, and the like, will be met, in a customized and/or conventional ballot format. For example, ballots 100 may be conventional ballots such as a Scantron ballot, which has an array of 48×80 elliptical mark spaces on fixed grid pattern on an 8½×11 inch paper ballot, onto which is added BID number 120 in machine- and/or human-readable form as described herein.

Figure 6:
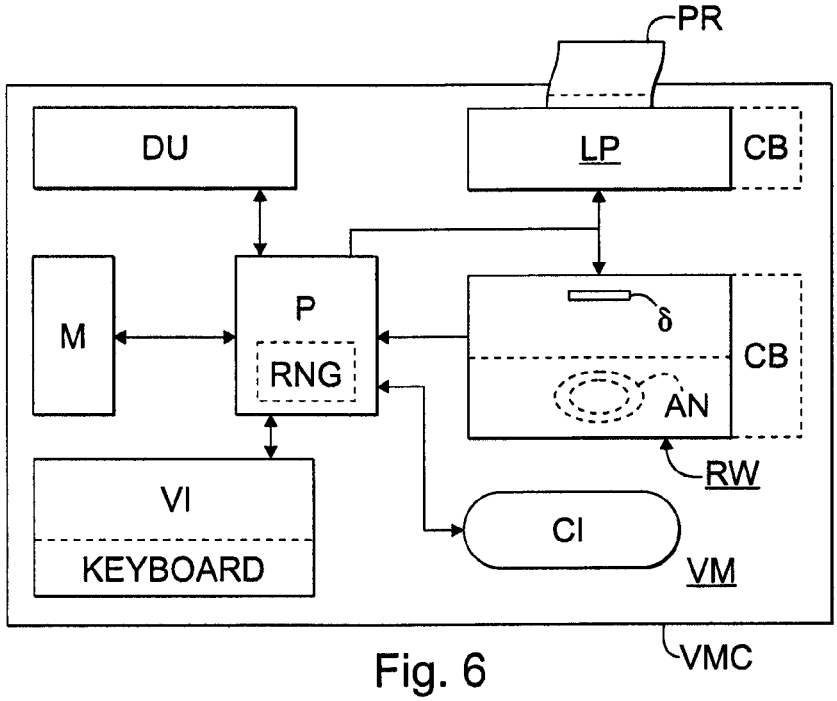
FIG. 6 is a schematic block diagram of an example voting apparatus.

FIG. 6 is a schematic block diagram of an example voting apparatus VM as shown and described in U.S. Pat. Nos. 7,036,730 and 7,431,209 incorporated herein. Voting machine VM includes a processor P for processing information relative to a voter and/or voting and for providing a voting session identifier, a non-volatile memory M for storing and providing such information, a display unit DU for displaying information to the voter, and a voter interface VI whereby the voter can enter information into voting machine VM for processor P and/or memory M. It is noted that the components of voting machine VM are similar to the components of a personal computer and so a conventional personal computer, with or without modification, may be utilized in voting machine VM, although it is likely that conventional computer components, particularly processor P and memory M, may be utilized in conjunction with displays DU and input devices VI adapted to or customized for the voting machine application, for example, for ruggedness, resistance to tampering and/or abuse. In addition, processor P includes a function for providing unique voting session identifiers for each voting session, for example, a random-number or random-character generator RAG or a look-up table or other suitable generator. Voter interface VI may be a touch screen and so would provide display DU and a keyboard.

Memory M may also be of any suitable non-volatile memory type. Suitable memory devices include floppy disks, computer hard disk drives, writeable optical disks, memory cards, memory modules and flash memory modules (such as those utilized in electronic cameras), magnetic and optical tapes and disks, as well as semiconductor memories such as non-volatile random-access memory (RAM), programmable read-only memory (PROM), electronically erasable programmable read-only memory (EEPROM) and the like. Memory M or a separate memory contains the operating system, data base and application software that operates processor P as voting machine VM.

Alternatively, various programming information, a voting session identifier generator or list, voting information, candidate and office information and the like may be provided in firmware, such as in an EPROM, which provides additional resistance to tampering and/or hacking attack. Such firmware may be utilized, for example, for controlling the reading and writing of information to optional smart cards SC, the storing of voting record information in memory M, particularly, a specific memory device such as a memory chip card, an optical disk or tape, or other electronic, magnetic or optical media. Preferably, memory M of voting machine VM includes two independent non-volatile memory devices so that voting record information and a voting session identifier are stored on two separate, independent memory devices for redundancy and preservation of at least one copy of the accumulated voting records in the event one of the memory devices fails or otherwise becomes inoperative. Desirably, the two non-volatile memories are of different types, such as a semiconductor memory and a hard disk, or a memory card and an optical disk, or any other convenient combination.

Voter interface VI may be a standard or custom keyboard, as may facilitate write-in voting, or may be dedicated vote buttons or switches similar to conventional mechanical voting machines, for example, or may be a touch-screen interface associated with display unit DU, and is typically connected to processor P via cabling. Special keys can be provided for voting functions such as "Elect" or "Select" or "Vote," or for "Erase" or "Change," or for "Write-in." Alternative voter interfaces VI may include voice recognition apparatus, Braille keyboards or pen systems with writing recognition interfaces, each preferably with confirmation of the data entered displayed on display unit DU or even aurally via headphones. For a "standard" computer keyboard, for example, it is preferred that the "function keys," i.e. those keys that can be used for a purpose other than voting, such as to access and/or control the operating system and other programs, e.g., the F1-F12 keys, be disabled or rendered inoperative, either by software control or physical means.

In addition, a voter interface VI for allowing visually impaired voters to vote without assistance may employ a modified standard keyboard of which only certain keys are responded to in combination with an aural device. E.g., only the four keys (buttons) at the corners of a numeric keypad or the four areas (buttons) in the four corners of a touch screen may be enabled to indicate possible selections such as vote, skip, next, previous, and the like, with audible voice instructions and confirmation of buttons pressed provided via a headphone. A typical function assignment to the corner keys can include: upper right key="repeat" (to hear voice message again), lower right key="Enter" (to make a selection within the allotted time), lower left key="Cast Vote" (and proceed to the next contest), and upper right key="Increase Speed" (to increase the rate at which contests and/or voice indications are presented). Any or all of these functional keys may be exaggerated in size or otherwise made easily distinguished by tactile feel. Such keyboard/button programming is commonly provided by software.

Display unit DU may be of any suitable type, such as a conventional cathode ray tube or computer display, an LCD display, a touch-screen display or other suitable device, for displaying alphanumeric and/or graphical information, or a set of illuminated buttons, as desired, and is typically connected to processor P via cabling. Display unit DU may also include Braille devices, aural information via headphones, or other devices specially suited for people with handicaps.

Operatively associated with or coupled to processor P and memory M are a printer LP for providing a tangible record of the voting session, e.g., a printed paper receipt and an optional smart card reader/writer RW for writing and/or reading information from/to a smart card. Preferably, local printer LP and optional reader/writer RW are built into the physical container VMC of voting machine VM along with processor P, memory or memories M, display DU and voter interface VI, and that physical container VMC is rugged and sealable for security and to prevent unauthorized access to the components therein, thereby being resistant to tampering. Other voting booth components, such as a privacy curtain, the opening and closing mechanism therefor, or a floor stand, need not be part of voting machine container VMC, but may be permanently or demountably attached thereto as is convenient.

An optional smart card reader/writer RW may be operatively associated with or coupled to processor P and memory M for writing information including at least a unique voting session identifier and a voting record into the memory of a smart card SC and optionally for reading information, such as voter registration and/or identifying information, from a smart card. Each voting session identifier is a randomly-generated unique identifying or serial number or character sequence (e.g., a pseudo-random number) of at least eight characters or digits, and preferably of 12 or more characters or digits. Such voting session identifiers are generated for each voting session of each election, either centrally and then loaded into memories M of voting machines VM or by processor P as each voter participates in a voting session. It may be desirable for the voting session identifiers to include additional characters identifying voting district and/or the polling place and/or the voting machine VM on which the vote associated with the identifying number was cast, and/or the date and time of the voting session, but not the voter, so as to preserve voter anonymity while providing traceability of voting records. If any information particular to an individual voter is stored in the memory of smart card SC, as may be the case where information confirming voter registration or an identifying PIN number, security code or other personal data is utilized, such information is written over or erased or otherwise rendered permanently unrecoverable either before or at the time that voting record and voting session identifier information is stored in the memory of smart card SC by reader/writer RW of voting machine VM.

For optical ballot voting, voting machine VM generates a ballot format 100 for a particular jurisdiction, for example, according to a pre-programmed ballot information and/or in response to the voting jurisdiction information corresponding to the voter's BID number (fields 381-386) as entered via voter interface VI and/or a smart card and reader RW, as the case may be. The ballot format is generated by processor P as described above and in incorporated U.S. Pat. Nos. 7,036,730 and 7,431,209, with a format layout for contests 110 consistent with local election requirements rather than as a series of voting screens. Ballot 100 so generated is printed by printer LP and is provided to the voter, e.g., by hand for provisional voting and/or by mail for absentee voting. Ballots 100 may be printed in advance of an election and/or may be printed during an election on a demand, i.e. as needed, basis.

If optional reader/writer RW is a contact-type reader for use with contact-type smart cards, then the smart card SC is inserted into slot S thereof to be read and/or written to. If reader/writer RW is a wireless or contact-less-type reader for use with wireless or contact-less-type smart cards, then the smart card SC is placed proximate to antenna AN of reader/writer RW to be read from and/or written to. If reader/writer RW is of a type for use with both contact-type and wireless or contact-less-type smart cards, then the smart card SC is inserted into slot S if it is a contact-type smart card and is placed proximate to antenna AN if it is a wireless-type smart card, or is either inserted into slot S or is placed proximate antenna AN if it is a so-called "combos-card" that combines both external contacts and an internal antenna so that it can be read from or written to either via contacts or a wireless communication.

Further, while optional smart card encoder RW need only be able to write information to a smart card, it may also read information stored in a smart card SC and provide same to processor P. Reader/writer RW may also be a decoder to decode information read from a smart card SC in encrypted or encoded form, and/or may also be a coder that encrypts or encodes information being written to the smart card SC. Such encryption and/or encoding may use public key encryption or any other suitable encryption and/or coding arrangement. Optionally, and preferably, reader/writer RW may include a "take-in" or capture mechanism that grabs smart card SC when it is inserted into slot S and, after the voting record and voting session identifier information is stored in the memory of smart card SC, deposits smart card SC into a secure collection box CB operatively associated with reader/writer RW and located in voting machine cabinet VMC. If this option is utilized, and it may be utilized with either contact-type or wireless smart cards SC, a separate collection box CB and action by each voter to deposit his or her smart card SC therein is not needed.

Local printer LP may provide a tangible independent record of each individual voter's voting selections associated with the voter's unique identifying number and/or may be utilized to print ballots 100. Printer LP if utilized for printing voting receipts is preferably of a type that retains no record of the data printed (e.g., is not a daisy wheel or other printer employing a ribbon or other sheet-type ink source from which information printed may be extracted or reconstructed) such as a thermal printer, a dot matrix printer, an ink-jet printer, a bubble jet printer, a laser printer and the like, which are conventional. A specialty or security-type of paper, or other medium making authentication of a printed receipt and/or a printed ballot 100 easier and counterfeiting of altering of same more difficult, can be utilized, thereby reducing the likelihood of counterfeiting or fraud. Desirably, printer LP also prints information identifying the election district, the date and time of voting and similar information that may help to authenticate printed receipt PR and/or optical ballot 100. Preferably, such receipts are collected, e.g., in a collection box CB.

The preferred VOTE-TRAKKER® voting system and apparatus as illustrated by FIG. 4 is provided in incorporated U.S. Pat. Nos. 7,036,730 and 7,431,209. Desirably, the VOTE-TRAKKER® voting system and apparatus provides redundancy for voting record and voting session identifier data in that each vote is recorded by at least one additional independent and verifiable means: to with, by electronic recording in the memory of a smart card separate from the voting machine and the printed record. This apparatus, and the method it performs, can provide 100% transparency of each and every vote and can maintain 100% privacy and confidentiality of each and every voter and vote, although other embodiments may not do so.

Figure 7:
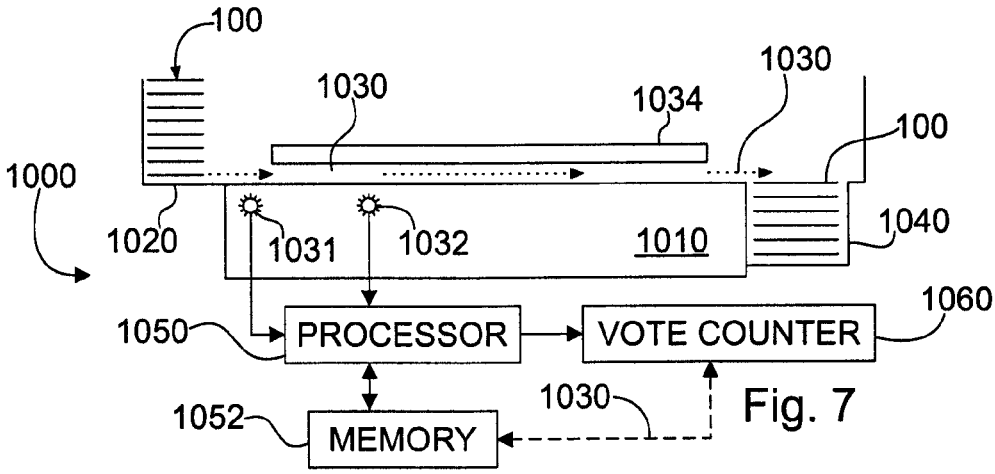
FIG. 7 is a schematic diagram illustrating an example ballot reader for reading optically read ballots of the sorts illustrated in FIGS. 1, 3A-3D and 4.

FIG. 7 is a schematic block diagram illustrating an example ballot reader apparatus 1000 for reading machine-readable ballots 100. Ballot reader apparatus 1000 includes reading device 1010 that has an input container 1020 into which ballots 100 to be read are placed for being fed through transport path 1030 to an output container 1040 into which ballots 100 that have been read as they pass through transport path 1030 are deposited, i.e. are collected. Therebetween, ballot transport path 1030 defines a path through which ballots 100 are transported for being read as they are transported between input container 1020 and output container 1040. Transport path 1030 may include one reader 1031 or may include two readers 1031 and 1032 of reader device 1010 which read, i.e. preferably image, the information and/or markings on ballots 100 as they pass thereby. Preferably, ballots 100 are optically-read ballots 100 of the sorts illustrated in FIGS. 1, 3A-3B and 4, and readers 1031 and 1032 are optical readers. Member 1034 may be a guide for transport path 1030 that also provides a light shield for optical readers 1031, 1032.

Some conventional optical readers have only one optical reader and so depend upon the accuracy of that reader. Optionally, reader 1010 may employ two optical readers 1031, 1032, preferably imagers, wherein one imager 1031 is a primary reader and the second imager 1032 is a backup or redundant reader. Thus, the digitized images provided by the two readers may be compared for verifying the accuracy of the image, or the decoded information from the two images may be compared for verifying both the accuracy of the imaging and the accuracy of the decoding thereof. Decoding of the ballot images from both optical readers 1031, 1032 is programmed against the same preprogrammed template, e.g., a template defined by the BID 120 decoded from the ballot images, i.e. for verifying the correctness of either reading against the one selected preprogrammed template.

Reader 1010 includes one or two readers 1031, 1032 and a processor 1050 that cooperate for reading ballots 100 of different forms without the need to pre-sort the ballots into groups of like form. Specifically, optical reader 1031 and/or 1032 reads ballots 100 for reading the BID number 120 thereon and communicates the BID number 120 to processor 1050. Processor 1050 is responsive to the BID number 120 read from each ballot 100, e.g., decoded from the image of each ballot 100, by reader 1031 and/or 1032 to identify and select the ballot template corresponding thereto. The images of ballot 100 from optical reader 1031 and/or 1032 are decoded for determining the mark spaces 1125, 112V thereon that have been marked in accordance with the ballot template selected by processor 1050 and are stored in memory 1052. Readers 1031 and/or 1032 may produce a true image, i.e. a picture of the sheet, typically in a pixel image format, of sheet 100 or may produce a set of marked/unmarked indications, typically a series of electronic signals that can be processed and stored in a memory, that may be considered an "image" or a "ballot image" of the information marked on sheet 100, i.e. of whether the mark spaces are marked or unmarked.

The BID number 120 read from each ballot 100 by imager 1031 and/or 1032 should include at least the jurisdictional information fields thereof, e.g., fields 381-386, utilized to identify and select the ballot template. Optical reader 1031 and/or 1032 should also read the unique random number field, e.g., field 387, so that the unique random number portion of BID 120 is associated with the stored voting selection information and is available for later verification of the ballot and/or of the correct reading thereof, as well as for tracking of his vote by the voter, e.g., via an Internet or other posting, as described herein. Where BID 120 is on ballot 100 in two different forms, e.g., in machine-readable form and in human-readable form, reader 1000 may have the ability to read both forms of BID 120, e.g., a bar-code reader and an OCR reader, usually in processor 1050.

While an image of the entire ballot 100 is preferred, imager 1031 and/or 1032 need not read portions of ballot 100 other than those containing valid mark spaces 1125, 112V according to the template corresponding to that ballot. The unnecessary portions of ballot 100 not containing valid mark spaces 112S, 112V may either not be read, e.g., where an optical mark reader is employed, or may be read and then discarded, e.g., where a true image is obtained, while retaining the readings of mark spaces 112S, 112V. Only images of the BID and mark space zones need be obtained and stored for tabulating and/or verifying voting by vote counter 1060, although it is preferred that the complete image of the ballot be stored and retained, e.g., in memory 1052. Images of the ballot and/or of the BID and mark space zones may be stored in any suitable electronic format including but not limited to .BMP, .TIFF, .PDF or any other suitable format. If only part of the ballot image is stored, the amount of storage capacity needed to store the information read from each ballot may be substantially reduced because the standardized information, e.g., names of contests, names of candidates, and the like, are not stored.

As a result, ballots 100 placed into input container 1020 do not have to be pre-sorted to be of the same format, but may be of different formats because readers 1031, 1032 in cooperation with processor 1050 determine the proper template to be utilized for reading each ballot 100 according to its format. Specifically, because the information in fields 381-386 of each BID number 120 printed on each ballot 100 define the particular voting jurisdiction (e.g., state, county, municipality, precinct, ward and/or political party), they also define the form of ballot 100 for such jurisdiction. From the BID number 120 read by optical reader 1031 and/or 1032, processor 1050 determines the jurisdiction and the ballot form therefor and supplies the template therefor for use in conjunction with the pattern of mark spaces 112S, 112V marked on ballot 100 for determining the selections made thereon.

Simply put and by way of example, imager 1031 and/or 1032 and processor 1050 decode the BID number 120 from a first ballot 100 of form A and processor 1050 then provides the mark space template for ballots 100 of form A for reading the marked voting selections from first ballot 100 read by optical reader 1031 and/or 1032. The marked voting selections decoded by imager 1031 and/or 1032 and processor 1050 are then stored in memory 1052 and tabulated as votes by vote counter 1060, which may be part of or may be separate from memory 1052, or may be in addition to memory 1052 and both may have the selections stored therein for redundancy. Next, imager 1031 and/or 1032 and processor 1050 decode the BID number 120 from a second ballot 100 of form B and processor 1050 then provides the mark space template for ballots 100 of form B for reading the marked voting selections from second ballot 100 read by optical reader 1031 and/or 1032 and decoded by processor 1050, which decoded marked voting selections are then stored in memory 1052 and tabulated as votes by vote counter 1060. Next, reader 1031 and/or 1032 and processor 1050 decodes the BID number 120 from a third ballot 100 of form C and processor 1050 then provides the mark space template for ballots 100 of form C for reading the marked voting selections from third ballot 100 read by optical reader 1031 and/or 1032 and decoded by processor 1050, which decoded marked voting selections are then stored in memory 1052 and tabulated as votes by vote counter 1060. If the next ballot is of form B, for example, reader 1031 and/or 1032 and processor 1050 decodes the BID number 120 from that ballot 100 of form B and processor 1050 then provides the mark space template for ballots 100 of form B for reading the marked voting selections from that ballot 100 read by optical reader 1031 and/or 1032 and decoded by processor 1050, which read marked voting selections are then stored and tabulated as votes by vote counter 1060, and so forth. The process repeats for each ballot read by reader 1000 wherein the template for each ballot is selected by processor 1050 responsive to the BID number 120 decoded from that ballot, i.e. specifically responsive to the jurisdictional information or other template-defining information defined by BID number 120.

Memory 1052 may also be of any suitable non-volatile memory type. Suitable memory devices include memory cards, floppy disks, computer hard disk drives, writeable optical disks, memory cards, memory modules and flash memory modules (such as those utilized in electronic cameras), magnetic and optical tapes and disks, as well as semiconductor memories such as non-volatile random-access memory (RAM), programmable read-only memory (PROM), electronically erasable programmable read-only memory (EEPROM) and the like. Memory 1052 and/or a separate memory contains the operating system, data base and application software that operates processor 1050 as sheet reader 1000. Preferably, memory 1052 includes two independent non-volatile memory devices so that selection information and the sheet identifier are stored on two separate, independent memory devices for redundancy and preservation of at least one copy of the accumulated records in the event one of the memory devices fails or otherwise becomes inoperative. Desirably, the two non-volatile memories are of different types, such as a semiconductor memory and a hard disk, or a memory card and an optical disk, or any other convenient combination.

Accordingly, an optical reader for reading paper ballots having a jurisdiction identifier thereon and having voting selections marked thereon, comprises a transport path for transporting paper ballots between an input and an output thereof; at least a first optical reader for imaging the identifier and mark spaces of each paper ballot transported on the transport path, and optionally a second optical reader for imaging at least the mark spaces marked on each paper ballot transported on the transport path. A processor receives the identifier read by the optical reader for each paper ballot for selecting a template for reading in accordance with the selected template the voting selections marked on each paper ballot, whereby the voting selections marked on each paper ballot are read in accordance with a template corresponding to the jurisdiction identifier for that paper ballot.

In addition and optionally, processor 1050 may include optical character recognition (OCR) software to provide alphanumeric outputs of the information in the BID field read by reader 1031, 1032 and/or of write-in information in the write-in portions of the voting fields read by reader 1031, 1032 according to the template selected by processor 1050. It is preferred that reader 1000 move ballots through transport path 1030 at the rate of at least about 10-12 inches per second (about 25-30 cm/sec.) so that ballots on either 8½×11 inch paper and/or on A4 paper may be read at a rate of at least about one ballot per second. It is also preferred that readers 1031 and 1032 have a resolution of at least about 100 dpi or greater, and it is desirable in some cases that reader 1000 provide dual-side document scanning.

Reader 1000 may be utilized at a polling place or other voting location for "checking" ballots marked by voters prior to their being voted, i.e. officially deposited into a collection container. This checking may be part of the voting and counting process, i.e. the checking is presented to the voter and/or to the voting system for either or both determining whether the ballot should be cast or rejected. Where reader 1000 is utilized solely for a voter checking his ballot before casting the ballot, vote counter 1060 would be eliminated and no record of the actual voting selections marked need be retained; processor 1050 processes only the BID number 120 and the mark space 1125, 112V regions to select the corresponding ballot template and to verify that the proper number of mark spaces have been marked for each contest and/or question.

Reader 1000 in checking a ballot preferably signals or otherwise provides a notice or indication if a ballot is under voted (i.e. less than the required number of spaces have been marked for each contest/question) or is over voted (i.e. more than the required number of spaces have been marked for each contest/question, which may invalidate a vote in a contest/question or may invalidate an entire ballot) or is otherwise incorrectly marked. Ballot checking may be utilized with straight voting as well as with ranked voting and/or cumulative voting, e.g., indicating if improper ranking has been marked and/or if the wrong number of cumulative votes have been marked. While such checking function advances the goal that ballots reflect voter intent, it can reduce but not eliminate under voting and over voting; however, it will at least give the voter an opportunity to correct such condition or at least indicate an intentional "no vote" if a "No Vote" or "Abstain" mark space 112 is marked.

Ballot checking may avoid or at least mitigate the condition where the intent of the voter cannot be determined because under and over voting can be reduced and/or eliminated by the checking. However, where applicable law allows, under and over voting in cumulative voting contests may be adjusted and/or rectified when the ballot is counted by applying proportioning and/or normalizing rules to the votes actually cast by marking mark spaces, e.g., by adding or subtracting a proportionate weighted vote. Ballot checking may be preformed by a reader 1000 or by an other ballot reader such as a ballot imager based on commercial office imaging equipment.

Reader 1000 utilized for ballot checking may also have a printer associated therewith for providing a tangible voting record, e.g., a printed receipt, for each voted ballot. Desirably, such printed receipt includes the complete BID 120 including the unique random portion 381 so that the receipt may be utilized to track and verify the vote where the voting results are available via an Internet and/or other posting including the BID. Preferably, the BID read from the read ballot is printed on the receipt. If the receipt includes a record of the voter's voting selections, the receipt also provides an immediate confirmation that the ballot can be read and of the voting selections marked, whereby the voter may seek correction of any error and/or omission prior to voting his ballot. Preferably, the receipt is collected.

While the reader arrangement described in the immediately preceding paragraphs is preferred, optical ballots 100 including a BID number as described herein may be sorted and read by conventional readers in the conventional manner. Ballot readers as described herein may utilize all or part of conventional ballot readers and/or may utilize parts of conventional office equipment such as copiers, scanners, facsimile (fax) machines, and other commercial imaging and/or scanning devices, and the like, e.g., for imaging and/or optically reading the information contained on an optically-readable paper ballot.

Examples of conventional ballot readers include the SCANMARK ES2800 reader available from Scantron located in Tustin, Calif. It is noted that such conventional ballot readers employ sensors positioned on a fixed grid pattern (e.g., in columns) corresponding to the fixed grid pattern of the mark-sense spaces of the ballot sheets with which they are utilized, and such readers do not image a ballot and so they cannot identify or determine pixel density and/or location as may be done for a true ballot image as described herein. An example of a conventional optical image scanner includes the PAGESCAN II reader available from Peripheral Dynamics, Inc. located in Plymouth Meeting, Pa. It is noted that this scanner can provide an image of a ballot or other document or sheet, and can be programmed to define multiple image areas. Examples of commercial imaging scanners include types DR5020 and DR5080 available from Canon Electronics, Inc. located in Japan, and type IS330DC available from Ricoh Company located in Japan. Examples of commercial printers suitable for ballot printing include the ImageRUNNER 600 and 105 available from Canon Electronics, Inc., and similar equipment available from Hewlett Packard of Palo Alto, Calif. and Fujitsu of Japan.

In addition, a "trial" ballot reader may preferably be provided at each polling place so that a voter has the opportunity to have his voted ballot scanned privately and to have the voting selections read therefrom be displayed privately so that the voter may confirm the correctness thereof before the ballot is cast. Preferably, the trial ballot scanner should employ the same reading apparatus and method as the ballot scanners that will read the ballot in counting and tabulating the vote, be that an optical mark reader producing indications of marks or an optical imager producing a true image. In any event, the trial ballot reader should be "read only" and have no memory or ability to store or transmit the voting selections from any ballot, whether by template and/or image and/or optical mark reading, thereby to assure privacy. I.e. it is for vote checking only.

Figure 8:
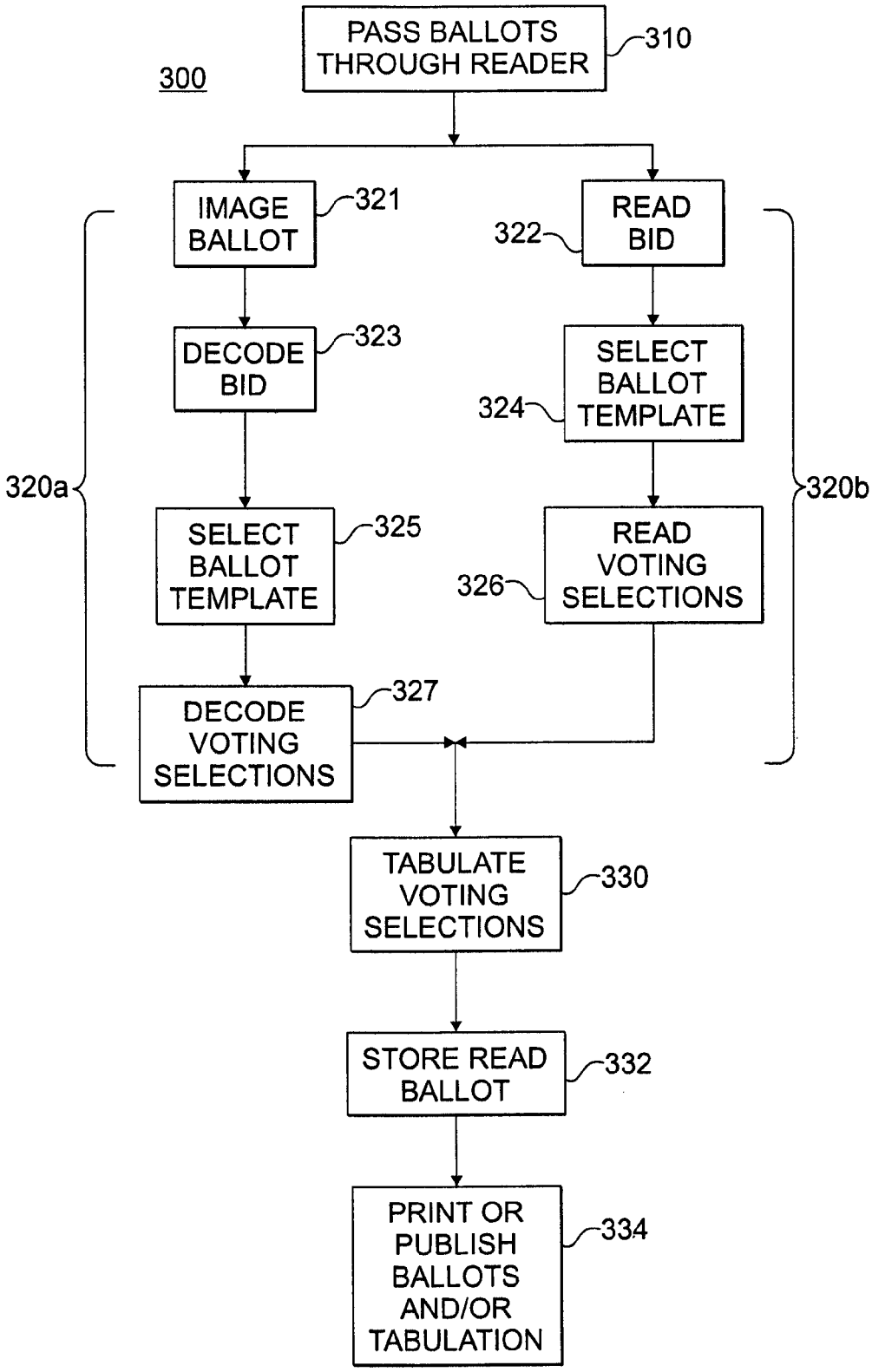
FIG. 8 is a schematic flow diagram of an example ballot reading process compatible with the apparatus of FIG. 7.

FIG. 8 is a schematic flow diagram of an example ballot reading process 300 compatible with the apparatus of FIG. 7. Process 300 commences with passing 310 the voted ballots through a ballot reader, e.g., along a transport path of an optical scan reader, wherein the ballots do not need to be, but may be, sorted according to jurisdictions and/or ballot formats. The ballots are individually and serially read/imaged and the voting information thereon is read/decoded via either of alternative processes 320*a* or 320*b*. Path 320*a* comprises imaging 321 each ballot and then decoding the voting selection information thereon in decoding steps 323-327. Typically, the decoding of the image can be and preferably is done in a single decoding operation with the decoded 323 BID information being employed to select 325 the appropriate template which then is employed to decode 327 the mark spaces 112S, 112V. Alternate path 320*b* comprises reading the ballots in steps 322-326, wherein the BID information read in step 322 is employed to select 324 the appropriate template for reading the voting selection information in reading step 326. In either path, the ballot template (e.g., a set of computer instructions and/or statements and/or data defining a pattern of ballot mark spaces for a ballot) for reading/decoding the voting information is selected responsive to the voting identifier and/or ballot identifier read/decoded in the reading/decoding step 322, 323.

Ballot imaging process 320*a* comprises imaging 321 the ballot to acquire an image of the voting information thereon and then decoding 323 a ballot identifier (e.g., BID) from the ballot image. While the entire ballot identifier (e.g., BID) may be decoded, only that portion thereof that contains jurisdiction information (e.g., ones of fields 381-386) need be decoded; decoding the unique random identifier portion (e.g., field 387) is optional). The decoded identifier correlates to a particular ballot format represented by a ballot template, and the ballot template corresponding to the decoded identifier is selected 325 from a database or other collection and/or set of ballot templates for decoding 327 the voting selection information from the ballot image previously imaged 321. Thus, each ballot of a mixed set of ballots is read (decoded) according to a template corresponding to the particular ballot format to obtain the voting selection information thereon. Decoding the selection marked spaces 112S as being marked includes first determining if each particular mark space 112S is marked and if it is marked, then determining whether its associated voiding mark space 112V is marked, and then counting the selection mark space 112S as marked only if its associated voiding mark space 112V is not marked. An unmarked selection mark space 112S with its associated voiding mark space 112V marked is considered as not being marked.

Ballot imaging process 320*b* comprises reading 322 the ballot to read a ballot identifier (e.g., BID) thereon, typically in a predefined location, area or region of the ballot. While the entire ballot identifier (e.g., BID) may be read, only that portion thereof that contains jurisdiction information (e.g., ones of fields 381-386) need be read; reading the unique random identifier portion (e.g., field 387) is optional). The read identifier correlates to a particular ballot format represented by a ballot template, and the ballot template corresponding to the read identifier is selected 324 from a database or other collection and/or set of ballot templates for reading 326 the voting selection information from the ballot. While the entire ballot may be read 326, only that portion containing voting selection information according to the selected template 324 need be read, e.g., by an optical mark reader. Thus, each ballot of a mixed set of ballots is read according to a template corresponding to the particular ballot format to obtain the voting selection information thereon. Reading the selection marked spaces 112S as being marked includes first determining if each particular mark space 1125 is marked and if it is marked, then determining whether its associated voiding mark space 112V is marked, and then counting the selection mark space 112S as marked only if its associated voiding mark space 112V is not marked. An unmarked selection mark space 112S with its associated voiding mark space 112V marked is considered as not being marked.

It is noted that the foregoing reading/imaging 321, 322, 323, 326, 327 of the BID and voting selections, and the template selecting 324, 325, and/or the tabulating 330 and storing 332, may be performed in "real-time" as each ballot is read, i.e., the voting selections are read/decoded, stored 332 and tabulated 330 substantially contemporaneously with the ballot passing through reader 1010. Alternatively, the BID and voting selections read/imaged 321, 322, 326 may be stored in "real-time" as each ballot passes through reader 1010, and the template selecting 324, 325, the decoding/reading 322, 323, 326, 327 of the stored BID and voting selections, and the tabulating 330 and storing 332 thereof may be performed after some or all of the ballots have passed through reader 1010, i.e. delayed in time.

It is further noted that in reading ballot 100, it is preferred that the ballot image be read/decoded 326, 327 to determine whether or not all of the mark spaces 112 as defined 324, 325 by the appropriate ballot template, and the indicia 122, if any, are present in the ballot image, thereby to enable detection of an anomalous and/or erroneous ballot 100, and/or to detect that a ballot 100 is, e.g., folded, torn, altered or otherwise incomplete or incorrect. Where an indicia 122 is employed to define the orientation of each ballot and a BID is employed to define the ballot form, the ballots may be in any order and orientation, need not be sorted by jurisdiction and/or voting district or the like, and need not be placed in a given orientation prior to being read/imaged and/or decoded 321, 322, 323, 326, 327.

The voting selection information read/decoded 326, 327 is tabulated 330 for counting the vote and determining an election outcome/result. The read/decoded 326, 327 voting selection information may be stored 332, e.g., for later verification, auditing, confirmation and/or comparison with the paper ballots and the like, and may be printed and/or otherwise published 334, in whole or in part, in connection therewith. The steps of tabulating 330, storing 332 and/or printing/publishing 334 may be either with or without the ballot identifier (e.g., BID) and/or other ballot identifier.

In addition, it is sometimes, if not usually, preferred that the printing and/or publishing 334 of voting results be positively blocked prior to a predetermined time, e.g., prior to the end of the time for voting. This, for example, allows absentee ballots received prior to the election to be authenticated, read and/or tabulated prior to the end of the election period while the results thereof are not available until after the time for voting is completed. Advantageously, this may allow election personnel to more efficiently process both absentee ballots and the regular voted ballots.

An advantage may obtain, however, where the tabulated 330 and/or stored 332 voter selection information is associated with the identifier where the identifier is not related and/or relatable to the identity of a particular voter, i.e. the voter remains anonymous. In such case, particular ballots can be inspected against the electronic records without compromising voter anonymity and privacy, including publishing voting results on a ballot-by-ballot basis, e.g., via the Internet, as described in incorporated U.S. Pat. Nos. 7,036,730 and 7,431,209. Such ability to verify that a ballot has been received and has been counted could be desirable for absentee and/or provisional ballots, as well as for general voting.

Figure 9:
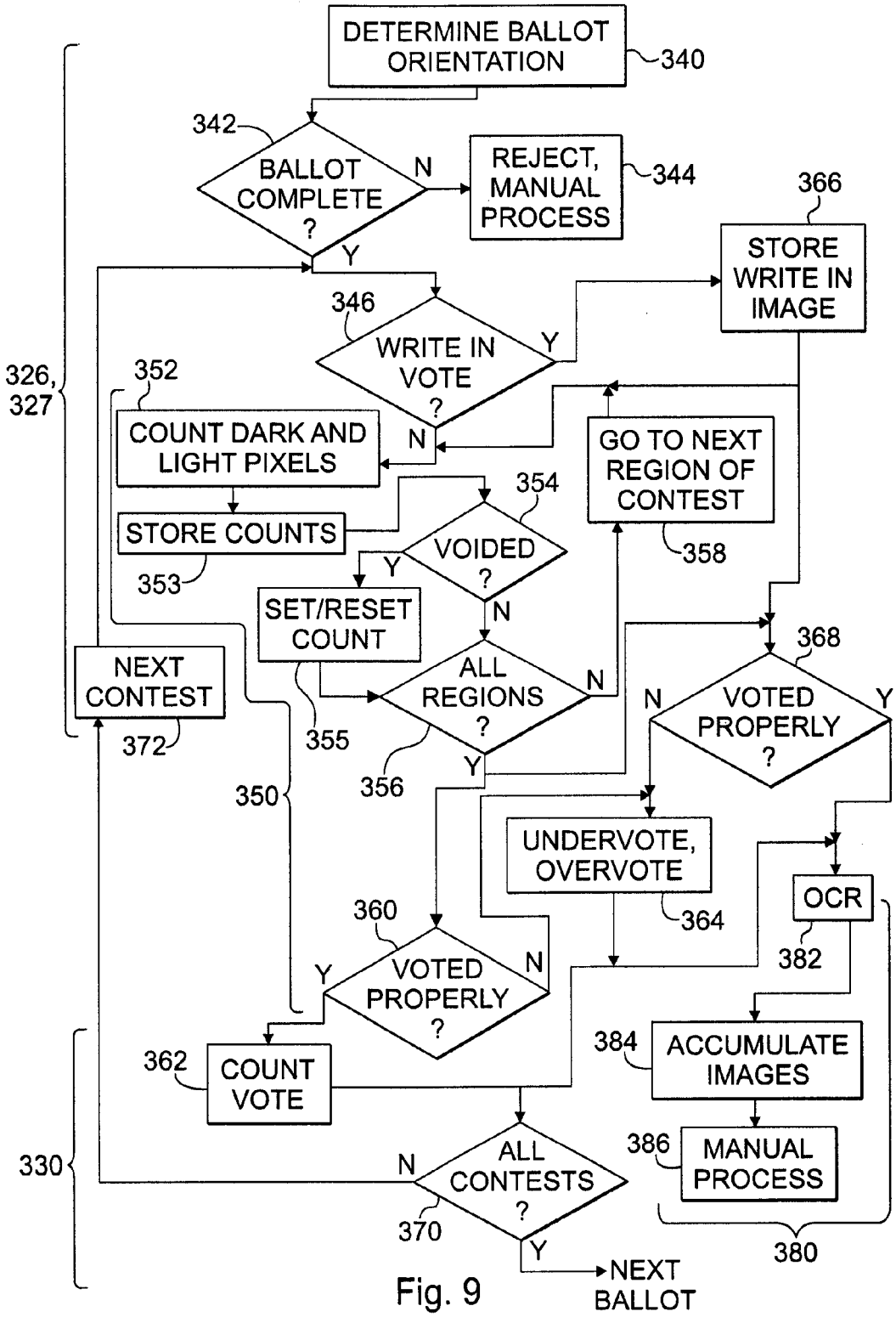
FIG. 9 is a schematic flow diagram illustrating details of a portion of the ballot reading process of FIG. 8.

FIG. 9 is a schematic flow diagram illustrating details of a portion of the ballot reading process 300 of FIG. 8. In particular, an example of details relating to the steps of decoding 327 voting selections, reading 326 voting selections, applying marked voiding mark spaces 112V, and/or tabulating 330 voting selections using the selected 324, 325 ballot template are illustrated. In a preferred embodiment, ballots are imaged, read and/or decoded 320*a*, 320*b* irrespective of the orientation of each ballot as it is passed through the ballot reader and/or irrespective of the jurisdiction, voting district, precinct and the like to which it pertains.

First, the orientation of each ballot is determined 340 from the location(s) of one or more indicia 122 disposed in an asymmetrical pattern on the ballot, and then the ballot image and/or the selected 324, 325 template therefor is electronically oriented to be in the same orientation. Before, after, and/or contemporaneously therewith, the ballot is tested or checked 342 to verify that it is a complete ballot, i.e. that it includes all of the indicia 122 and marking space 112S, 112V outlines that the ballot should include as defined by the selected 324, 325 template, and so is not torn, folded, altered and the like. If the ballot is not complete 342, path "N" is taken and the ballot is rejected, e.g., is physically separated from the other ballots, e.g., for manual verification and processing.

If the ballot is complete 342, the path "Y" is taken and the ballot is tested 346 to determine whether there is any write-in voting selection thereon. If testing 346 finds any one or more write-in voting selections, the path "Y" is taken and, preferably, the portion(s) of the ballot image containing a write-in voting selection(s) are stored 366, preferably along with the ballot BID for later verification, if necessary or desired. Typically, write-in voting selections are processed separately from voting selections from among the nominated candidates or other regular voting selections. Ballot processing then proceeds to the detail steps of decoding 350 the regular voting selections, i.e. those made by marking mark space(s) 112S, 112V. Write-in selections may be processed completely manually, e.g., as where an optical mark reader is employed to read the ballot sheet.

If testing 346 finds no write-in voting selection is present, then path "N" is taken directly to the detail decoding 350 of regular voting selections. Decoding 350 includes a number of steps that determine whether each mark space 112 has been marked to indicate that a voting selection has been made or has not been so marked. For example, the pixels of the ballot image, e.g., in a TIFF or BMP or other bitmapped or pixelated format, for each mark space 112 are tested to determine whether it is a "light" (e.g., not marked) pixel or a "dark" (e.g., marked) pixel. The number of "light" and "dark" pixels for each mark space 112 are counted 352 and the counts of "light" and "dark" pixel are stored 354. Preferably, the ballot BID is associated with the stored counts of "light" and "dark" pixels thereof, e.g., for auditing and/or recount. If a sufficient portion of the tested pixels in a given mark space are "dark" pixels, then that mark space 112 is considered to be marked, e.g., as described below.

The counting of light and dark pixels for all mark spaces 112, i.e. for both selection mark spaces 112S and for voiding mark spaces 112V, may all be done at the outset, so that all of the data needed to count the mark spaces that are marked is available, which results in complete information of the ballot marking being determined and stored. Alternatively, the pixel counts may be done for only the selection mark spaces 1125 followed by pixel counting for those of the voiding mark spaces 112V that are associated with the selection mark spaces 1125 that have been determined to have been marked.

Testing 356 determines whether all of the mark spaces 112 of a contest have been counted 352 and the pixel counts thereof stored 353. If not, path "N" is taken to go 358 to the next region of the contest repeat the pixel counting 352 and storing 354 therefor until all of mark spaces 112 have been processed. I.e. the process just described loops via 356, 358 until all of the mark spaces 112 for all of the contest regions 110 have been counted and processed 350. Typically, when all mark spaces 112 of a contest have been processed, i.e. both the selection mark spaces 1125 and the voiding mark spaces 112V have been pixel counted and processed, the processed voiding mark spaces 112V are tested 354 to determine which ones have been determined to be marked and, if any are so determined, the path Y is followed and the selection mark spaces 112S associated with marked voiding mark spaces 112V are "un-marked" 355, e.g., by resetting their pixel counts to zero or some other low pixel count value indicative of an unmarked selection mark space 1125. Alternatively, the pixel count of such "un-marked" selection mark spaces 1125 may be set to a unique value indicating that its associated voiding mark space 112V was marked. One example thereof is by making negative the actual pixel count of the selection mark space 1125, which has the advantage of preserving the pixel count data for the marked selection mark space 1125 that has been unmarked based upon the marking of its associated voiding mark space 112V.

It is noted that the voided? testing step 354 and the pixel count resetting or setting step 355 that give effect to the marking of voiding mark spaces 112V may be performed, e.g., between steps 353 and 356 or between steps 356 and 360, and/or may be done for mark spaces 112S individually, e.g., "on the fly," or in groups (e.g., for a contest region 110) or as a whole, at any convenient place(s) within counting 350.

When all mark spaces 112 in a contest region 110 have been processed, the path "Y" is taken from testing 356 to determine 360 whether the contest has been voted properly, i.e. whether the proper number of mark spaces have been marked (i.e. after the processing 354-355 for voiding mark spaces 112V is completed). If the proper number of mark spaces 112 have been marked (taking into account the unmarking thereof by the marking of associated voiding mark spaces 112V), the path "Y" is taken and the voting selection for that contest is counted 362. If either too many (over vote) or too few (under vote) mark spaces 112 have been marked, the path "N" is taken and the under vote or over vote is stored 364 for later processing. If an under vote, the voting selections made may be counted 362, if the applicable law allows. Overvotes are generally not counted.

In addition, if there is a write-in voting selection, the fact thereof is tested 368 with the affirmative result of the all regions counted test 356 at path "Y" to determine 368 whether the contest is voted properly considering the presence of a write-in voting selection. If not, then path "N" is taken and an over vote or under vote is recorded 364. If the voting selection is determined 368 to be proper, then path "Y" is taken and the write-in voting selection is processed 380.

Following the counting of a voting selection 362, an under vote or over vote 364 or a "Y" determination 368, testing 370 determines whether all contests for that ballot have been counted and processed. If not, path "N" is taken to the next contest 372 which is then processed 350 and so forth as described, until all contests have been counted and processed 350. If yes, path "Y" is taken and the next ballot is then processed in like manner to that just described until all of the ballots have been processed and the voting selections thereon have been counted and tabulated 330.

Separate processing 380 of write-in voting selections may proceed as follows, typically after all the regular voting selections have been tabulated. Optionally, the write-in voting selections may be converted to alphanumeric characters by optical character recognition (OCR) 382. The stored 366 images of the write-in voting selections are accumulated 384, with their corresponding OCR result, if any, and preferably are displayed for manual processing 386, including validation, by election officials. The display may be on a computer display or the like or may be a printed form, as may be desired and/or required by applicable law.

Preferably, write-in voting selection images are "clipped" from the ballot images and have the ballot BID associated therewith, and plural clipped images are displayed on one screen or printed on one page. Manually processed 386 valid write-in voting selections are counted and tabulated 330 with the total vote. In processing write-in voting selections, either the clipped image is displayed, or if the ballot BID is associated therewith, the entire ballot image may be displayed or the original ballot may be retrieved for use in manual processing 386. Where the ballots are read, not imaged, based upon comparison to a ballot template, only the result of reading the ballot is stored, and so the original ballot is preferably separated and kept for manual processing 386 of write-in voting selections.

A typical ballot image in a pixel or bitmap format may have a file size in the range of 3-500 kilobytes, depending upon the format and the degree of file compression utilized, but could be as large as 1-10 megabytes without file compression. A computer hard drive of the sort typically found in a current commercially available personal computer, e.g., of 100-500 gigabytes capacity, can easily store full-ballot images (of nominal or average 500 kilobyte size) for a population of over 200,000 voters. One or more servers may be utilized for storing ballot images for a population of one million or more voters.

Typically, full ballot images are stored initially on the hard drive of a computer and are later transferred to permanent storage media, e.g., a "write-once, read-many" (WORM) medium such as a CR-R disk, for long-term storage. Reduced images, whether by compression and/or by "clipping" the portions of the ballot image that include mark spaces, write-in voting spaces, identifiers and the like, and other information pertinent to voting selection other than the standard information and candidates names printed on the ballot, may be utilized to reduce the quantity of information that needs be processed on counting and tabulating the vote and/or that needs to be stored. Such techniques can be utilized reduce the size of each ballot image file to as low as 10 kilobytes or less.

Figure 10A:
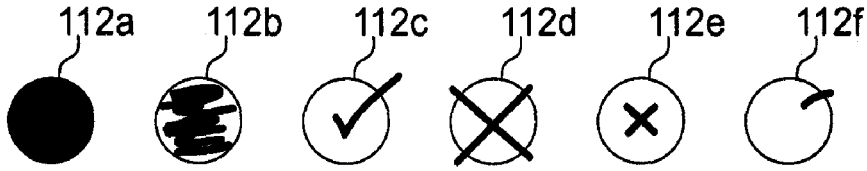
FIGS. 10A, 10B, and 10C are schematic diagrams of mark spaces of a ballot marked in a variety of ways and of details thereof.
Figure 10B:
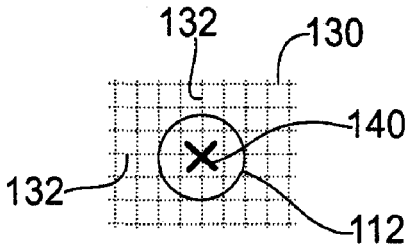
Figure 10C:
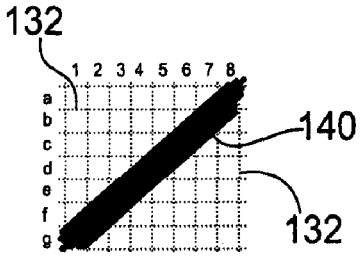

FIGS. 10A, 10B, and 10C are schematic diagrams of mark spaces 112 of a ballot 100 marked in a variety of ways and of enlarged diagrams illustrating details thereof, and are helpful to understanding a preferred aspect for counting voting selections of the method described herein.

FIG. 10A illustrates some of the various ways that a voter may mark a mark space 112 in making a voting selection. For example, mark space 112*a* has been fully marked by the voter so that it is essentially 100% filled in and there is no question that the voter intended to mark that region 112*a* and it should be counted as a vote. Mark space 112*b* is partially marked and may be about 50% filled in, and it is likely the voter intended to mark that region 112*b* and it should be counted as a vote. Similarly, mark spaces 112*c*, 112*d* and 112*e* are marked with a check, a large X and a small x, respectively, and it is likely that the mark was intended and should be counted as a vote. However, mark space 112*f* contains a small mark that may be an intended or unintended mark therein, and so may or may not be counted as a vote.

Each ballot image captured by ballot reader in reading ballots 100 must be read to determine which ones of mark spaces 112 thereon have been marked sufficiently to count as being marked to indicate a voting selection and which ones have not. The ballot reader produces a ballot image, whether of the entire ballot or only of portions thereof selected in accordance with the applicable ballot template, that is preferably in a pixelated or bitmapped format, e.g., a TIFF or a BMP image, or other bitmapped format. Ballot images in such format may be produced directly by a commercially available office copier or scanner or may be converted to such format, if necessary, or may be provided by a specialized ballot scanning apparatus. Optical mark readers typically detect a mark space as being marked or not being marked by comparison to a pre-set fixed level.

FIG. 10B illustrates a reading region 130 of a ballot which contains a marked mark space 112. Based on the applicable ballot template, e.g., the template selected 324, 325 from among the possible ballot templates using the BID number read/decoded 322, 323 from the ballot, a number of reading regions 130 each including one mark space 112 are selected from the ballot image. Each reading region 130 is preferably slightly larger than and includes one mark space 112. Each region includes a large number of pixels 132 as illustrated by the dotted grid lines, e.g., representing an over scan of mark space 112. Mark space 112 includes mark 140, e.g., a mark made by a voter to indicate a voting selection.

For clarity, only a few rows and columns of pixels are illustrated, it being understood that a large number, e.g., 800-1000 pixels is typical. In one embodiment, reading region 130 includes about 900 pixels. Because each reading region 130, whether or not marked by a voter, includes the printed outline of mark space 112, a predetermined number of the pixels representing the mark space 112 outline will be "dark" pixels. In one embodiment, the outline of mark space 112 includes about 100 dark pixels, with a tolerance of about ±40 pixels due to ballot to ballot variations, e.g., printing variations, outline-to-pixel pattern registration differences, reading/imaging differences, scanner lighting variations, sensor noise, and the like.

One preferred arrangement for determining whether a mark space 112 has been marked to indicate a voting selection is as follows. The maximum number of pixels 132 that a mark 140 could darken (i.e. the number of "markable pixels") is determined by subtracting the number of pixels of the outline of mark space 112 from the total number of pixels 132 in reading region 130. For the example embodiment, the number of markable pixels is 900−100=800 pixels.

A predetermined threshold of dark markable pixels (e.g., the "voted threshold") is established for determining that a mark space 112 has been marked (voted). For example, voted thresholds of between about 20% and about 50% of the maximum number of markable pixels 132 have been found satisfactory, and are preferred, although higher or lower voted thresholds are satisfactory and may be utilized. If a higher percentage voted threshold were to be utilized, the effect is that the voter is being required to more fully darken the mark space 112 in order for a voting selection to be considered as such. If a lower percentage voted threshold is established, then mark space 112 outlines having a positive tolerance and/or reading "noise" could determine that a voting selection has been made when none was intended. In some tests, thresholds of about 10% and less were found to produce readings of a voting selection where none was intended.

To determine whether a voting selection has been made in a given mark space 112, the number of pixels of the mark space outline is subtracted from the number of marked pixels, and the difference is compared with the predetermined voted threshold. This provides additional safety margin against erroneous reading because the number of dark pixels of the mark space outline is subtracted both in calculating the voted threshold and in determining the number of pixels that have been read as marked by the voter.

In the example embodiment, a voted threshold of 20% is equal to 160 marked pixels (20% of 800 markable pixels), and a threshold of 50% is equal to 400 marked pixels, in a reading region 130. It is noted that using the lower voted threshold of 20% requires that at least 160 marked pixels be present which is about four times the expected tolerance of 40 pixels of the outline of mark space 112 and so an unmarked mark space 112 will be unlikely to be erroneously determined to be a voting selection.

An advantage obtains where the counts of the numbers of "light" and "dark" pixels are stored for each mark space 112 of each ballot, as is preferred, but is not necessary, as described above. After the ballots are read/imaged, their "light" and "dark" pixels counted and stored, and voting selections counted and tabulated with a given predetermined voted threshold, the predetermined voted threshold may be changed and the voting selections recounted and re-tabulated using the stored "light" and "dark" pixels counts, without having to again scan the ballots. This is performed quickly and electronically, without the need for scanning or otherwise processing the original paper ballots, and ballot images may be inspected in case of a question.

Thus the effect of changing the value of the predetermined voted (marked) threshold on the tabulated election result may be determined, and may be compared with the election result (e.g., the vote margin of the winning candidate) for determining whether that effect is significant with respect to the outcome of the election. Where the ballot BID is associated with the stored pixel counts, as is optional but is preferred, the ballots for which the reading of the voting selection is changed by the changing of the predetermined voted threshold may be identified, and may be obtained for visual inspection by voting officials. Typically, the differences in reading voting selections provided by the foregoing ballot reading and counting arrangement have been found to be relatively small, and so would not be significant in terms of an election result in all but the closest of elections.

Because the counts of dark and light pixels are stored in the pixel-based preferred arrangement, it is quite easy to vary the predetermined threshold for what is and is not a voted (marked) mark space and to determine the variance if either a higher or lower threshold had been utilized (i.e. a higher or lower percentage of filled area of the mark spaces 112). For example, a typical predetermined threshold level might be set at 20%, 25%, 30%, 35% or 40%. Once the votes are read and counted using the predetermined threshold, it is quite easy to perform one or more recounts with the threshold set at a higher or lower threshold level utilizing the stored counts of light and dark pixels without having to re-scan (re-image) and reprocess the ballots.

For example, where the ballots are initially read and decoded utilizing a predetermined threshold of 30%, the results can be tested and compared simply by setting the predetermined threshold to 20% and recounting using the stored counts of light and dark pixels and then to set the predetermined threshold to 40% and again recounting using the same stored counts of light and dark pixels. The differences in vote tallies generated using different predetermined thresholds of light and dark pixels will determine the sensitivity of the vote count to the relative level of marking filling of the vote selection mark spaces.

Further, where the preferred arrangement is employed wherein the ballot identifier (BID) is associated with the ballot image and the stored counts of light and dark pixels, the voting results obtained for each ballot for each predetermined threshold level may be compared and the ballots for which the voting result changes when the predetermined threshold is varied may be identified by their respective ballot identifiers (BIDs) and may then be retrieved for manual inspection, e.g., by an election official and/or a court or other authority conducting an audit and/or examination of the voting result.

Thus, the described arrangement facilitates the identification of those ballots for which voter intent may be in issue and also provides means whereby the ballots in question may be identified and evaluated automatically and without subjective human intervention. If this arrangement had been utilized in the November 2000 presidential election in the United States, for example, then the recounting of votes in certain counties of the state of Florida would have been much quicker and accurate, and may have been freed from the taint and embarrassment of partisan human interpretation.

FIG. 10C illustrates an enlarged view of a portion of reading region 130 which contains a portion of a mark 140 in mark space 112 (or of an outline of a mark space 112). Therein, dashed lines indicate rows a, b, c, . . . and columns 1, 2, 3, . . . of pixels 132 on which a portion of a mark 140 (or a mark space 112 outline) is superimposed, and pixels 132 are designated as "x-y" where "x" is the letter of the row thereof and "y" is the number of the column thereof, e.g., the pixel at row a, column 1, is designated as pixel "a-1." It is seen that while a mark 140 completely fills some pixels 132, it does not either completely fill or completely not fill all pixels 132. Thus a criteria is needed to determine whether any given pixel is "dark" or is "light," i.e. is not dark.

One convenient criteria is that the pixel is considered "light" if the intensity (brightness) of a pixel is greater than 50% of full brightness and is considered "dark" if its intensity (brightness) is less than 50% of full brightness, although any other suitable level could be utilized. Thus, illustrated pixels b-1, c-1, c-4, and f-7, among others, are "light" and illustrated pixels f-3, d-6, c-7 and b-8, among others, are "dark." Other illustrated pixels, such as pixels f-2, e-3, g-3 and e-6, among others, are more than 50% covered by mark 140 and so would be considered "dark" pixels, while illustrated pixels f-1, b-6, f-5 and d-8, among others, are less than 50% covered by mark 140 and so would be considered "light" pixels.

Pixel intensity (brightness) is tested for each pixel and each pixel is determined to be either "light" or "dark" and the total numbers of "light" and "dark" pixels, respectively, are counted for each reading region 130, as described above. Because the processing of each reading region 130 as described above makes provision for variations in reading characteristics, the accuracy of counting of voting selections is not particularly sensitive to the predetermined intensity threshold that is utilized for determining "light" and "dark" pixels. It is noted that the preferred threshold of 50% is symmetrical and tends to avoid a statistical bias towards determining whether any given pixel is a "light" pixel or a "dark" pixel.

Figure 11:
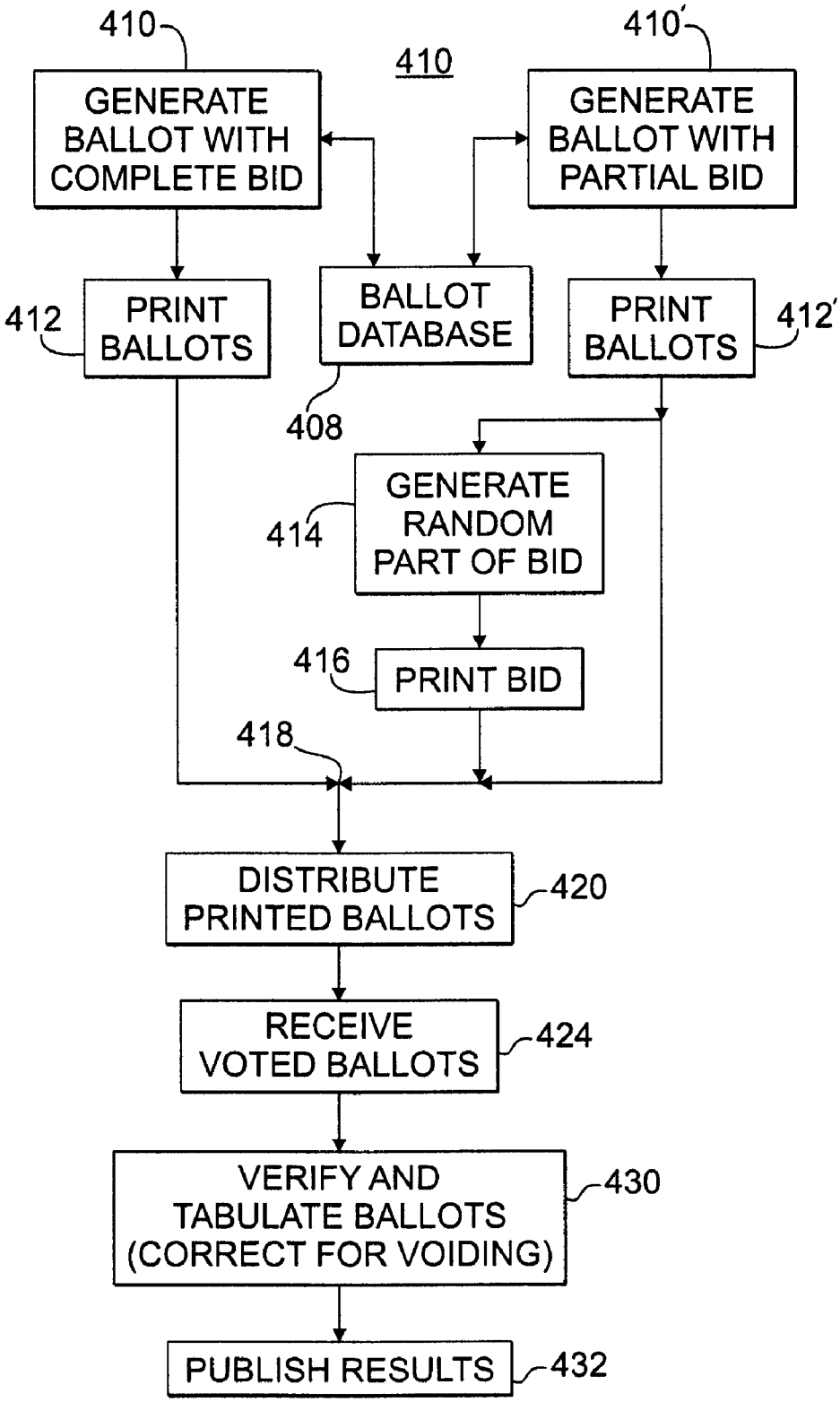
FIG. 11 is a schematic flow diagram of an example process for generating the ballots of FIGS. 1, 3A-3D and 4.

FIG. 11 is a schematic flow diagram of an example process 400 for generating the ballots of FIGS. 1, 3A-3B and 4. In process 400, a ballot including the contests and/or questions to be presented to the voters is generated 410, 410' from information entered by election officials prior to an election. Typically, election officials generate a database 408 of ballot forms (styles) for the various jurisdictions, districts, polling locations and the like, and in the case of a primary, for each political party, each being associated with a particular jurisdictional portion of the ballot identifier (BID). In printing ballots, the appropriate form/style is selected from the database 408 thereof in accordance with the jurisdictional portion of a particular BID, e.g., ballot generation as described herein and/or in incorporated U.S. Pat. Nos. 7,036,730 and 7,431,209.

Ballots may be generated 410 with a complete ballot identifier (BID), i.e. an identifier including the jurisdictional information (e.g., fields 381-386) and a unique random identifier (e.g., field 387), and printed 412 as a set of unique ballots, either in advance of an election and/or "on-demand" in an election. Ballots may be generated 410' with a partial ballot identifier (BID), i.e. an identifier including the jurisdictional information (e.g., fields 381-386), and printed 412' as a set of identical ballots either in advance of an election (e.g., conventional printing) and/or "on-demand" in an election. Such ballots may be utilized directly, i.e. without the unique identifier portion of the BID, or a unique random identifier (e.g., field 387) portion of a ballot identifier may be generated 414 and may be printed 416 on the ballots to provide a set of unique ballots and/or may be printed on labels to be affixed to the printed ballots at a later time. A list of the ballot identifiers utilized on ballots may be retained, e.g., in a database on a computer, for later use in verifying and/or authenticating voted ballots received 424, and may be without compromising voter anonymity and privacy where no record is kept that could relate a particular ballot to a particular voter. Further, printed ballots including the BID may be placed into envelopes, e.g., absentee ballots placed into mailing envelopes, by automated equipment to reduce the possibility of human action that may compromise privacy and/or anonymity.

In either case, the printed ballots with a complete BID and/or with a partial jurisdictional BID are distributed 420 for being utilized by voters in voting in an election in accordance with the applicable election procedure, e.g., by marking their voting selections in the mark spaces provided. It is noted that the ballots may be distributed 420 in advance of an election, e.g., as absentee ballots or as ballots for early voting, may be distributed 420 during an election as the usual ballot for all voters, e.g., at polling locations on an election day or days, and/or may be distributed 420 to particular voters, e.g., to voters voting provisionally.

Absentee ballot envelopes may be printed in like manner to that employed for printing ballots, i.e. either as a batch printing process 412 and/or on demand 412'-416. An envelope ballot identifier (EBID) may be printed on each envelope or later applied, e.g., by label, that includes fields identifying the jurisdiction and ballot type, with or without a unique randomly-generated identifier, in similar manner to the BID utilized on the ballot. The EBID may be utilized to identify the envelope/ballot upon distribution 420, e.g., sending/mailing out to the voter, and upon return 424, and facilitates automated placement of ballots into envelopes as described.

Marked (voted) ballots are received 424, e.g., by election officials, the ballots having been submitted by mail, in-person or other delivery method, e.g., in the case of absentee ballots or ballots for early voting, by deposit in ballot containers or delivery to an election official at a polling location or other designated location, e.g., as the usual ballots voted and/or as provisional ballots. Ballots voted as absentee, early and/or provisional voting ballots are typically sealed in a plain opaque envelope after the voter marks his voting selections thereon and the plain envelope is then sealed inside an opaque outer envelope on which is marked the voter's name and address, the election, jurisdiction, date, and/or other particulars, and a voter signature, and/or the identification and signature of a witness. Each ballot is verified 430, i.e. the information on the outer envelope is utilized by election officials to determine whether the ballot sealed therein should be opened and counted. Such determination may include, e.g., whether the voter is eligible to vote, whether the voter signature on the envelope matches the voter signature in the voter registration records, and/or whether the ballot is a valid ballot for the particular election (possibly including whether the ballot is a duplicate of another vote in the name of the voter).

Upon return 424 of an absentee ballot and before opening it to obtain the ballot therein for counting, the envelope EBID on the outer envelope is read and is utilized for authenticating/verifying 430 the absentee ballot and for indicating that the voter to whom is was provided has voted and/or for disqualifying the absentee ballot if the voter has voted in person during the election, thereby to reduce the likelihood for a voter voting more than once without being detected. Once the absentee ballot is determined 430 to be a valid absentee ballot based upon the EBID and outer envelope, the outer envelope is opened and the inner envelope and the ballot therein are counted 430 as described.

While a record of the BID of ballots sent as absentee ballots may be retained for verifying that the ballot is an authentic absentee ballot as part of it being counted, it is preferred that the BID and EBID be separate and independent of each other and not linked, so that the identity of the voter remains anonymous and his vote remains private. Voter anonymity and/or privacy may also be enhanced where substantial numbers of such ballots are processed together, e.g., where absentee and/or provisional ballots are removed from their envelopes. Ballots not validated may be retained either physically and/or electronically by storing images thereof, and such stored images may be related to the voter registration database, if desired.

The verified (qualified) received ballots are then read as described herein (e.g., see FIGS. 7 and 8) and tabulated 430, without the need for being sorted by election and/or ballot style and/or jurisdiction before reading and tabulating 430, to determine the result or outcome of the voting. Before and/or during the reading and tabulating 430, the ballots may be verified/authenticated by comparing the complete BID number on each ballot against a list of valid BID numbers for the election, e.g., a computer database listing the BID of each issued ballot, and/or by manual inspection by an election official.

The result/outcome of the election is certified and/or published 432 as required by the applicable election laws. Preferably, the tabulating 430 of voted ballots preserves the specific voting selections read from each ballot and the associated BID (e.g., voting record) of that ballot, as well as tallying the vote totals for determining the election outcome, and a listing of the voting selections and BID (voting record) from all ballots may be published where the public can access same, e.g., on a bulletin board, in a printed publication and/or on an Internet web site. Thus, each voter knowing his BID can access the listing and find the vote recorded from his ballot by its BID and can satisfy himself that his vote has been counted and nas been counted correctly and accurately. Where the voter retains a copy of his ballot and/or is issued a voting receipt, such may be utilized for correcting an incorrectly recorded vote and/or an improperly disqualified ballot where permitted by applicable law.

Figure 12:
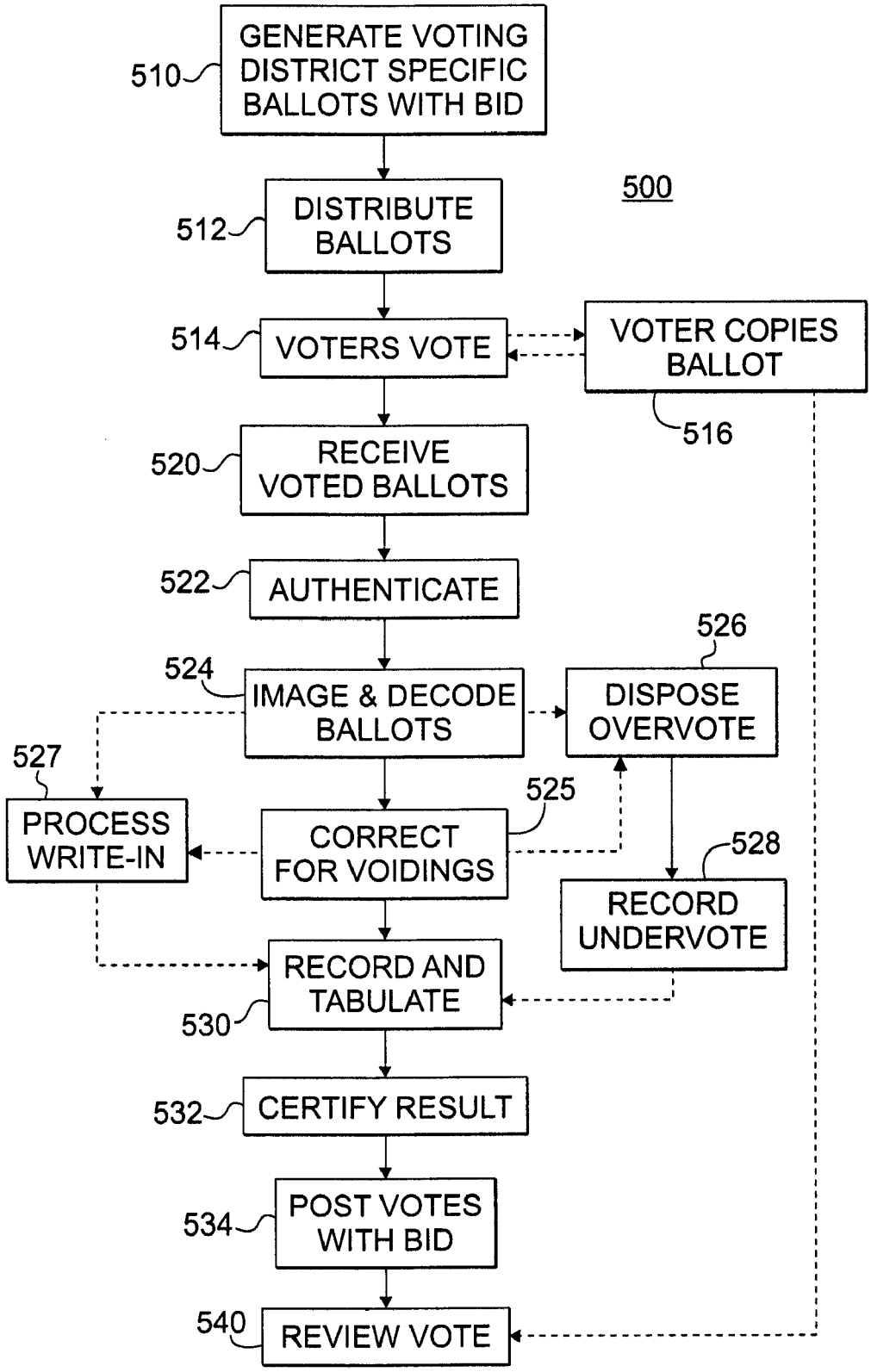
FIG. 12 is a schematic flow diagram of an example voting process utilizing the ballot of FIGS. 1, 3A-3D and 4.

FIG. 12 is a schematic flow diagram of an example voting process 500 utilizing the ballot of FIGS. 1, 3A-3B and 4. Voting district specific ballots are generated 510 and distributed 512 for being voted. Voters vote 514 by marking the mark spaces on the ballot corresponding to their desired voting selections (votes) and submit their ballots in accordance with applicable election procedure. Marking the mark spaces 112 on the ballot corresponding to their desired voting selections (votes) includes marking one or more selection mark spaces 112S and may include marking one or more voiding mark spaces 112V where the voter desires to change a selection marked in an associated selection mark space 112S. A voter may copy 516 his marked ballot for later checking that his vote was counted and was counted properly. Voted ballots are received 520 and the received voted ballots are authenticated 522 before being read and counted. All the foregoing may be as described in relation to FIG. 11.

Authenticated (valid) ballots are imaged (scanned) 524 to read and decode the BID number printed thereon and the voting selections marked thereon, i.e. the voting selections marked on each ballot are read according to a ballot template corresponding to the jurisdictional portion of the BID selected based upon the jurisdictional portion of the BID read 524 from each ballot. As described, ballots are read 524 according to ballot templates selected based upon the BID decoded from the ballot image and so do not need to be sorted by jurisdiction and/or style prior to reading 524. Reading may be by an optical mark reader that detects marked spaces or by an optical imager that produces an image (picture) of the sheet from which the spaces that are marked and are not marked are decoded.

Reading 524 of the ballots typically includes processing, e.g., as described in FIG. 9, and includes correcting 525 the counting of any decoded marked selection mark spaces 1125 for which a voiding mark space 112V is decoded as being marked. Such marked pairs of mark spaces 1125, 112V are counted as if neither has been marked, i.e. the voter did not make that selection. The reading/decoding 524 and correcting 525 are preferably accomplished from the information decoded from the image of the ballot.

Ballots over-voted (i.e. wherein more mark spaces than are permitted to be marked have been marked, after correction for marked voiding mark spaces, if any) may be disposed 526 by being separated or ejected for manual inspection and/or invalidation, and/or the valid portions of the voting selections may be recorded and tabulated 530, depending on the treatment of over-voted ballots under applicable law. Some jurisdictions invalidate only the voting selections made in over-voted contests and other jurisdictions invalidate an entire ballot containing any over-vote. Ballots under-voted (i.e. wherein fewer mark spaces than are permitted to be marked have been marked, after correction for marked voiding mark spaces, if any) may be recorded separately 526 and/or the under-vote may be recorded separately 526 (e.g., for review and/or for statistical purposes), and the voting selections thereon are recorded and tabulated 530, and/or under-voted ballots may be separated for manual inspection, depending on the treatment of under-voted ballots under applicable law. Further, the read and/or imaged information for each under- and/or over-voted ballot may be printed out for review by election officials.

Write-in votes are preferably read and processed 527 by optical character recognition (OCR) software for computer tabulation, and/or ballots having write-in votes may be separated for manual processing (e.g. manual deciphering and posting) 527 and/or inspection and/or verification. Write-in votes, if any, may also be corrected by the voter marking the voiding mark space 112V associated with the write-in selection 1125, and processing such correction 525 is made prior to counting any write-in selection, and prior to determining whether an undervote or an overvote exists, including for contests where a write-in selection has been made. Write-in selections that have been voided by the marking of an associated voiding mark space 112V may also be separately processed 527, if desired.

The corrected 525 voting selections from read 524 ballots are recorded 530 including the BID number from each ballot, i.e. the voting selections and BID of each ballot are recorded and stored as an individual voting record, and the voting selections therefrom are also tabulated 530 to determine the result of voting. Preferably, the information read from each ballot, e.g., voting record of voting selections and BID, are stored in plural separate and independent memory devices, e.g., hard drives, flash memories, optical CD-ROM and the like, e.g., as described in incorporated U.S. Pat. Nos. 7,036,730 and 7,431,209, for preservation with the original paper ballots in accordance with applicable procedures.

When the voting results tabulations are properly verified, the result is certified 532 as official. Thereafter, the certified results may be posted/published 534, e.g., on an Internet web site, including both the tabulated 530 result and/or the voting records including BID of each individual ballot, thereby enabling any voter knowing his BID, e.g., from a ballot copy and/or a printed voting receipt, to review 540 the voting record corresponding to that BID to ascertain whether it was counted and, if counted, whether it was correctly counted. The posted/published 534 voting records can include not only those voting records for ballots that were authenticated 522 and thus counted 524, 530, but may also include the voting records for ballots that were disqualified or otherwise not counted and/or not completely counted and/or the fact that the ballot of that BID was disqualified or was not counted and/or not completely counted.

In connection with the steps of reading 524, correcting 525, recording and tabulating 530 and/or the processing of write-in, under and over-votes 527, 526, 528, for example, election officials may be provided with administrative and management tools, such as user rights and levels of access, passwords and the like, the keeping of logs of events and/or actions performed, functions to export (e.g., by electronic file transfer and/or via floppy disks, CD-ROMs and other tangible media) all or part of the files of vote tabulations, voting records, vote statistics and the like, and/or for the printing of various reports and/or forms, such as vote tallies, voting reports, vote certification forms and the like.

While the BID information may be provided to the voter on a paper ballot and/or on a paper or other identification card, or may be entered by an election official at the election office and/or polling place for printing on a ballot, BID information may be coded into the memory of a smart card and the voting machine may include a smart card reader for reading the coded BID stored therein where the voting machine is utilized to print an optically scan-able ballot including the BID. Identification of the voter at the time for voting may utilize the BID information stored in the voter's smart card, or may be by traditional identification methods, such as signature verification, conventionally utilized by various jurisdictions.

Alternatively, a unique identifier stored in the voting machine may be read into the voter's smart card and may either supplement or replace the voter number stored therein at issuance, whereby the pre-stored voter number may be used to verify registration and/or the unique identifier may be utilized to preserve voter anonymity and privacy. Preferably for voter privacy, only the unique identifier, e.g., BID, is stored in the voter smart card and/or on a printed allot at the completion of a voting session. A database of unique identifiers valid only for a particular election may be pre-loaded into the voting machines and/or vote tabulating machines prior to that election, and/or smart cards may be collected when voted, for security.

Apparatus for reading an optically readable markable sheet, the markable sheet having selection mark spaces thereon and having voiding mark spaces thereon, wherein each voiding mark space is associated with one of the selection mark spaces, and wherein a selection mark space is markable for indicating a selection and the voiding mark space associated with that selection mark space is markable for voiding a selection marked therein, the markable sheet having a sheet identifier thereon that relates to a template defining the locations of the selection mark spaces and the voiding mark spaces on the markable sheet, the apparatus may comprise: a memory storing an image of the markable sheet including the selection mark spaces, the voiding mark spaces and the sheet identifier; a processor decoding the sheet identifier from the image of the markable sheet for selecting the template and decoding the selection mark spaces and the voiding mark spaces from the image of the markable sheet in accordance with the selected template; the processor determining marked selection mark spaces in the decoded selection mark spaces of the markable sheet and marked voiding mark spaces in the decoded voiding mark spaces of the markable sheet in accordance with the selected template, the processor voiding a selection marked in a selection mark space if the voiding mark space associated therewith is marked; and wherein a record of at least the unvoided determined marked selection mark spaces is stored in the memory, whereby the selections marked on the markable sheet are recorded in accordance with a template corresponding to the sheet identifier for the markable sheet and are voided by marks in the associated voidable mark spaces of the markable sheet. Each voiding mark space is preferably adjacent to the associated selection mark space with which it is associated. Each selection mark space may have a particular shape and each voiding mark space has the same particular shape, or each selection mark space may have a particular shape and each voiding mark space has a different shape. Each selection mark space may be a circle, an ellipse, an oval, a square or a rectangle, and each voiding mark space may be a circle, an ellipse, an oval, a square or a rectangle. The processor may store in the memory a record of the determined marked selection mark spaces, the determined marked voiding mark spaces, and the voided selection marks. The processor may tabulate and store in the memory at least the unvoided selections marked on the markable sheet in accordance with the sheet identifier and the selected template. The apparatus may further comprise: an optical imager providing the image of the markable sheet, wherein the image of the markable sheet includes a representation of the selection mark spaces, of the voiding mark spaces and of the sheet identifier; or an optical mark reader providing the image of the markable sheet, wherein the image of the markable sheet includes a representation of the selection mark spaces, of the voiding mark spaces and of the sheet identifier. The memory may include at least two independent non-volatile memory devices, and at least one of the memory devices may include a floppy disk, a computer hard disk drive, a writeable optical disk, a memory card, memory module, a flash memory module, a magnetic tape or disk, an optical tape or disk, a semiconductor memory, a non-volatile random-access memory (RAM), a programmable read-only memory (PROM), an electronically erasable programmable read-only memory (EEPROM) or a combination thereof. The sheet identifier may include a unique identifier for a particular markable sheet, and the processor may store in the memory a record including at least the unvoided selections imaged from the markable sheet and the corresponding sheet identifier and unique identifier thereof from that particular markable sheet. The markable sheet may have a corresponding unique identifier thereon, and the processor may process the unique identifier of the markable sheet for authenticating the markable sheet. The apparatus may be utilized for grading and/or marking an examination, for grading and/or marking a test, for grading and/or marking a school test, for grading and/or marking a university test, for grading and/or marking a professional test, for grading and/or marking an answer sheet, for tallying and/or tabulating a survey, for tallying and/or tabulating a questionnaire, for reading and/or tabulating gaming sheets, for reading and/or tabulating races, for reading and/or tabulating lotteries, or any combination of the foregoing.

A method for decoding an optically readable markable sheet, the markable sheet having selection mark spaces thereon and having voiding mark spaces thereon, wherein each voiding mark space is associated with one of the selection mark spaces, and wherein a selection mark space may be marked for indicating a selection and the voiding mark space associated with that selection mark space may be marked for voiding the selection marked therein, the markable sheet having a sheet identifier thereon that relates to a template defining the locations of the selection mark spaces and the voiding mark spaces on the markable sheet, wherein the method may comprise: storing an image of the markable sheet including the selection mark spaces, the voiding mark spaces and the sheet identifier in a memory; decoding the sheet identifier from the image of the markable sheet for selecting the template and decoding the selection mark spaces and the voiding mark spaces from the image of the markable sheet in accordance with the selected template; determining marked selection mark spaces in the decoded selection mark spaces of the markable sheet and marked voiding mark spaces in the decoded voiding mark spaces of the markable sheet in accordance with the selected template, voiding a selection marked in a selection mark space if the voiding mark space associated therewith is marked; and storing a record of at least the determined marked selection mark spaces that are not voided in a memory, whereby the selections marked on the markable sheet are recorded in accordance with a template corresponding to the sheet identifier for the markable sheet and are voided by marks in the associated voidable mark spaces of the markable sheet. The method may further comprise: imaging the markable sheet, wherein the imaging provides the image of the markable sheet including a representation of the selection mark spaces, of the voiding mark spaces and of the sheet identifier; or reading the markable sheet, wherein the reading provides the image of the markable sheet including a representation of the selection mark spaces, of the voiding mark spaces and of the sheet identifier. The markable sheet may have at least two fiducial marks thereon that define the orientation and scale of the markable sheet, and prior to the decoding the sheet identifier from the image of the markable sheet for selecting the template and decoding the selection mark spaces and the voiding mark spaces from the image of the markable sheet, the method may further comprise: decoding from the image of the markable sheet the respective locations of the at least two fiducial marks; and comparing the decoded respective locations of the at least two fiducial marks from the image of the markable sheet and the respective predetermined locations of the at least two fiducial marks for determining the orientation of the markable sheet, for scaling the image of the markable sheet, or for determining the orientation of the markable sheet and for scaling the image of the markable sheet. The scaling the image may be employed for locating the proper position of the sheet identifier, or for locating the proper positions of the selection mark spaces and the voiding mark spaces, or for locating the proper positions of the sheet identifier, the selection mark spaces and the voiding mark spaces. The image of the sheet may be in a pixelated or bitmapped format including a plurality of pixels; and the decoding the marked selection mark spaces and the voiding marked spaces may include counting at least the number of dark pixels in a predefined region containing a selection mark space, a voiding mark space, or both. The method may further comprise: determining from the counts of dark pixels in the predefined region for each selection mark space and each voiding mark space or both whether the selection mark space is unmarked or is marked and whether the voiding mark space therein is unmarked or is marked; and counting each determined marked selection mark space if its associated voiding mark space is not determined to be marked. The determining from the counts of dark pixels for each predefined region whether the selection mark space and/or voiding mark space therein is marked may comprise: (a) comparing the numbers of dark pixels to a first predetermined value to determine whether the selection mark space and/or voiding mark space is marked; and the method may further comprise: (b) comparing the numbers of dark pixels to a second predetermined value that is higher or lower than the first predetermined value to determine whether the selection mark space and/or voiding mark space is marked; and (c) providing an indication of the difference, if any, in the determinations of step (a) and step (b). The storing a record of at least the determined marked selection mark spaces that are not voided in a memory may include either: storing a record of the determined marked selection mark spaces and the determined marked voiding mark spaces in the memory; or storing the determined marked selection mark spaces and the determined marked voiding mark spaces in the memory, displaying the stored determined marked selection mark spaces and the determined marked voiding mark spaces, and then deleting the stored determined marked selection mark spaces and the determined marked voiding mark spaces from the memory. The storing a record may include: storing the record in at least two independent non-volatile memory devices, and at least one of the memory devices may include a floppy disk, a computer hard disk drive, a writeable optical disk, a memory card, a memory module, or a flash memory module, a magnetic tape or disk, an optical tape or disk, a semiconductor memory, a non-volatile random-access memory (RAM), a programmable read-only memory (PROM), an electronically erasable programmable read-only memory (EEPROM) or a combination thereof. Where two or more selection mark spaces and/or write-in spaces are associated with a choice, each choice having a given number of selections that may be made therein, the method may comprise: counting the number of selection mark spaces and/or write-in spaces for the choice that are determined to be marked as a selection and for which the associated voiding mark space is determined to not be marked as voiding a marked selection mark space; comparing the number of unvoided selections marked to the given number of selections; and if the number of unvoided selections marked equals the given number, then counting each determined marked selection, if the number of unvoided selections marked is less than the given number, then providing an indication of an under selection, and if the number of unvoided selections marked exceeds the given number, then providing an indication of an over selection and not counting the determined marked selection. An indication of an under selection or an over selection or both may be provided, and the method may further comprise: providing at least an image including any under selected choice, any over selected choice, or any under selected choice and any over selected choice for separate processing. Where a write-in selection space is associated with a choice, the method may comprise: determining whether a write-in selection space has been marked; and if a write in selection space has been marked, providing at least an image including the write-in selection for separate processing. The separate processing may comprise: storing the images of write-in selections and/or content of write-in selections; and displaying the stored image and/or content of a write-in selection, accumulated stored images and/or contents of a plurality of write-in selections, or both. The sheet identifier may include a unique identifier for a particular markable sheet, and the storing a record may include storing a record including at least the unvoided selections imaged from the markable sheet and the corresponding sheet identifier and unique identifier thereof from that particular markable sheet. The markable sheet may have a corresponding unique identifier thereon, and the method may further comprise processing the unique identifier for authenticating the markable sheet. Each voiding mark space may be adjacent to the associated selection mark space with which it is associated. Each selection mark space may have a particular shape and each voiding mark space has the same particular shape, or each selection mark space may have a particular shape and each voiding mark space has a different shape. Each selection mark space may be a circle, an ellipse, an oval, a square or a rectangle, and each voiding mark space may be a circle, an ellipse, an oval, a square or a rectangle. The method may be utilized for grading and/or marking an examination, for grading and/or marking a test, for grading and/or marking a school test, for grading and/or marking a university test, for grading and/or marking a professional test, for grading and/or marking an answer sheet, for tallying and/or tabulating a survey, for tallying and/or tabulating a questionnaire, for reading and/or tabulating gaming sheets, for reading and/or tabulating races, for reading and/or tabulating lotteries, or any combination of the foregoing.

An optically readable markable sheet may comprise: a sheet of material having an identifier region with an optically readable sheet identifier therein and having selection mark spaces and voiding mark spaces thereon, wherein the selection mark spaces are markable for making selections and each voiding mark space is associated with a selection mark space and is markable for voiding the marking of the associated selection mark space, wherein marking a selection mark space indicates a selection and marking the voiding mark space associated with a selection mark space indicates not making that selection; and wherein the identifier region, the selection mark spaces and the voiding mark spaces are in defined locations on the optically readable markable sheet, and the sheet identifier, the selection mark spaces and the voiding mark spaces are optically readable. Each voiding mark space may be in a predetermined position relative to the selection mark space which it is for voiding; or each voiding mark space may be in a predetermined position immediately to the right of the selection mark space which it is for voiding; or each voiding mark space may be in a predetermined position immediately below the selection mark space which it is for voiding. The sheet identifier may be unique and may not be related to the identity of an individual person. Each selection mark space may have a particular shape and each voiding mark space has the same particular shape, or each selection mark space may have a particular shape and each voiding mark space has a different shape. Each selection mark space may be a circle, an ellipse, an oval, a square or a rectangle, and each voiding mark space may be a circle, an ellipse, an oval, a square or a rectangle. The sheet identifier may include one or more of a bar code, a two-dimensional bar code, a prescribed font, optical character recognition (OCR) characters, alphanumeric characters, non-alphanumeric characters, and symbols; or the sheet identifier may relate to a template defining the locations of the selection mark spaces and the voiding mark spaces on the markable sheet; or the sheet identifier may be represented by characters that are machine readable and are human readable; or the sheet identifier may be unique and be represented by characters that are randomly generated; or the optically readable markable sheet may comprise a plurality of pages and each of the plurality of pages may have a machine readable indicia representative of a page number thereof; or one of the selection mark spaces may represent an abstention, a no vote or a skip selection; or any combination of any of the foregoing. The optically readable markable sheet may have two or more fiducial marks at respective predetermined locations thereon for defining the orientation and scaling of the optically readable markable sheet. The identifier region and the plurality of choice regions and the selection and voiding mark spaces are preferably in defined locations relative to the two or more fiducial marks. At least three fiducial marks may be located proximate at least three different corners of the optically readable markable sheet for determining the scaling of the image of the optically readable markable sheet in two directions. The optically readable markable markable sheet may have a write-in space for entering a write-in selection therein, and the write-in space may have a voiding mark space associated therewith for voiding a write-in selection marked in the write-in space. The optically readable markable sheet may include a ballot, an examination sheet, a test sheet, an answer sheet, a tally sheet, a tabulation sheet, a survey sheet, a questionnaire, a gaming sheet, a race sheet, a lottery sheet, or any combination of the foregoing. The optically readable markable sheet may be imagable by an optical imager, by an optical mark reader, by an optical scanner, by an imager, or by any combination of the foregoing, for providing an image of the optically readable markable sheet including a representation of the selection mark spaces and marks therein, the voiding mark spaces and marks therein, a write-in selection if any in a write-in space, and the sheet identifier.

While the present invention has been described in terms of the foregoing exemplary embodiments, variations within the scope and spirit of the present invention as defined by the claims following will be apparent to those skilled in the art. For example, while the identifier (e.g., BID number) of a ballot must be machine readable for automatic tabulation of votes, the machine-readable BID may be the same as the desirable human-readable BID, i.e. alphanumeric characters readable by people as well as machines (e.g., readers having OCR) may be utilized.

Moreover, any arrangement described in relation to a particular form of voting (e.g., absentee or provisional voting) may be utilized in relation to any other form of voting (e.g., regular or early voting) as well.

The terms "reader" and "image" are intended to include optical mark readers, optical imagers and other devices that can detect information marked on a ballot or other sheet, and are intended as being interchangeable unless the context indicates otherwise.

Further, the identifier (BID) may include any one or more of the fields described and/or additional or different fields, as may be appropriate and/or desirable. Each identifier (BID) includes one or more fields containing a representation of jurisdictional information and/or a ballot form, and may include one or more fields containing a unique random portion. Herein, an identifier may be or be referred to as a ballot identifier and/or a voting session identifier, e.g., where the ballot is generated with an identifier in a voting session of an election, i.e. in recording a voter's vote or is generated apart from a voting session and any voter, and/or may be referred to as a ballot identifier in relation to a particular voter (even if random and anonymous).

Also, and optionally, for weighted and/or ranked voting, the ballot may provide for the voter to write-in the weighting and/or rank for each candidate and/or response in a marking space 112 provided therefor and the write-in portion may be read and translated into machine readable form manually. Further, the reader may include an OCR function for translating the written weight and/or rank into machine readable form, and in such case, means for writing in the selection in a common font easily understood by the reader may be provided. Voter over-voting errors in making weighting and/or ranking preferences may be proportionately corrected automatically, e.g., normalized to the proper weight, if the law allows. Under votes may be counted insofar as they are voted.

While ballots are generally referred to herein as "paper" ballots, it is understood that while present day sheet ballots are typically of paper or of a somewhat heavier stock, paper ballot as used herein is intended to include paper, heavy paper, card stock, cardboard, plastic, punch card and other forms of ballots on a sheet of material. While sheet ballots are most commonly read by optical scanning when the ballot passes a light source and the marked/unmarked state of the mark regions is sensed by an associated light detector, marking may be detected by other means such as a mechanical and/or electrical sensing and detecting means.

Where ballots are separately processed, such processing may be automated or manual, or may be a combination thereof. Separate processing may be utilized, e.g., where ballots include a write-in vote, an overvote, an undervote, and/or where a ballot appears to be missing voting mark spaces, ballot identifier and/or fiducial marks, and/or wherein such features have not been properly imaged and/or read.

In any of the arrangements described herein, a printer may be associated with a ballot reader, e.g., such as reader 1000 described in relation to FIG. 7, for providing a voting receipt and/or confirmation that a ballot has been properly read. Such receipt may be a simple confirmation of a ballot being readable, or may be a listing of voting selections and/or may include a printout of a full ballot image, or anything in between. In the latter case, it may be desirable for the printed version of the voter's ballot to be submitted as the official vote after the voter has opportunity to verify its accuracy and completeness. The printed ballot version would have fully blackened mark spaces for each voting selection made thereby to further reduce the already extremely low rate of questionable vote counting error typically obtained with the described arrangements.

In addition, while the apparatus and method herein are typically described in relation to voting apparatus having a user interface, e.g., a display and a data entry device such as a touch screen, either or both may be eliminated and/or rendered inoperative, if desired, and replaced by the optical ballot reading apparatus such as that described. Further, the apparatus and method herein may be utilized in fields and applications other than elections and voting, e.g., in the grading/marking of examinations and tests such as school and university tests, professional tests, and the like, wherein the voter is a test taker and an answer sheet replaces the ballot, in the tallying and tabulating of surveys and questionnaires (replacing the ballots), in the reading and tabulation of gaming sheets (replacing the ballots) such as for races and lotteries, and the like.

What is claimed is:

1. Apparatus for reading an optically readable markable sheet, the markable sheet having selection mark spaces and voiding mark spaces thereon, wherein each of the voiding mark spaces is associated with a corresponding one of the selection mark spaces, and wherein a selection mark space is markable for indicating a selection and the voiding mark space associated with that selection mark space is markable for voiding a selection marked in the corresponding selection mark space, the markable sheet also having a sheet identifier thereon that relates to a template defining the locations of the selection mark spaces and the voiding mark spaces on the markable sheet, said apparatus for reading an optically readable markable sheet comprising:

a memory storing an image of the markable sheet including the selection mark spaces, the voiding mark spaces and the sheet identifier;

a processor decoding the sheet identifier from the image of the markable sheet for selecting the template and decoding the selection mark spaces and the voiding mark spaces from the image of the markable sheet in accordance with the selected template;

said processor determining marked selection mark spaces in the decoded selection mark spaces of the markable sheet and marked voiding mark spaces in the decoded voiding mark spaces of the markable sheet in accordance with the selected template, said processor voiding a selection marked in a selection mark space if the voiding mark space associated therewith is marked; and wherein a record of at least the unvoided determined marked selection mark spaces is stored in said memory, whereby the selections marked on the markable sheet are recorded in accordance with a template corresponding to the sheet identifier for the markable sheet and are voided by marks in the associated voidable mark spaces of the markable sheet.

2. The apparatus of claim 1 wherein each voiding mark space is adjacent to the associated selection mark space with which it is associated.

3. The apparatus of claim 1 wherein each selection mark space has a particular shape and each voiding mark space has the same particular shape, or wherein each selection mark space has a particular shape and each voiding mark space has a different shape.

4. The apparatus of claim 1 wherein said processor stores in said memory a record of the determined marked selection mark spaces, the determined marked voiding mark spaces, and the voided selection marks.

5. The apparatus of claim 1 wherein said processor tabulates and stores in said memory at least the unvoided selections marked on the markable sheet in accordance with the sheet identifier and the selected template.

6. The apparatus of claim 1 further comprising:

an optical imager providing the image of the markable sheet, wherein the image of the markable sheet includes a representation of the selection mark spaces, of the voiding mark spaces and of the sheet identifier; or an optical mark reader providing the image of the markable sheet, wherein the image of the markable sheet includes a representation of the selection mark spaces, of the voiding mark spaces and of the sheet identifier.

7. The apparatus of claim 1 wherein the markable sheet has a corresponding unique identifier thereon, and wherein said processor processes the unique identifier of the markable sheet for authenticating the markable sheet.

8. The apparatus of claim 1 wherein said apparatus is utilized for grading and/or marking an examination, for grading and/or marking a test, for grading and/or marking a school test, for grading and/or marking a university test, for grading and/or marking a professional test, for grading and/or marking an answer sheet, for tallying and/or tabulating a survey, for tallying and/or tabulating a questionnaire, for reading and/or tabulating gaming sheets, for reading and/or tabulating races, for reading and/or tabulating lotteries, or any combination of the foregoing.

9. The apparatus of claim 1 wherein the selection mark spaces include a mark space for a skip contest selection, for a no vote selection, for an abstain selection and/or for a write-in selection, and wherein each mark space for a skip contest selection, for a no vote selection, for an abstain selection and/or for a write-in selection has a corresponding one of the voiding mark spaces associated with it, whereby each selection of a mark space for a skip contest selection, for a no vote selection, for an abstain selection and/or for a write-in selection may be voided by marking the corresponding voiding mark space associated therewith.

10. A method for decoding an optically readable markable sheet, the markable sheet having selection mark spaces and voiding mark spaces thereon, wherein each of the voiding mark spaces is associated with a corresponding one of the selection mark spaces, and wherein a selection mark space may be marked for indicating a selection and the voiding mark space associated with that selection mark space may be marked for voiding the selection marked in the corresponding selection mark space, the markable sheet having a sheet identifier thereon that relates to a template defining the locations of the selection mark spaces and the voiding mark spaces on the markable sheet, the method for decoding an optically readable markable sheet comprising:

storing an image of the markable sheet including the selection mark spaces, the voiding mark spaces and the sheet identifier in a memory;

decoding the sheet identifier from the image of the markable sheet for selecting the template and decoding the selection mark spaces and the voiding mark spaces from the image of the markable sheet in accordance with the selected template;

determining marked selection mark spaces in the decoded selection mark spaces of the markable sheet and marked voiding mark spaces in the decoded voiding mark spaces of the markable sheet in accordance with the selected template, voiding a selection marked in a selection mark space if the voiding mark space associated therewith is marked; and storing a record of at least the determined marked selection mark spaces that are not voided in a memory, whereby the selections marked on the markable sheet are recorded in accordance with a template corresponding to the sheet identifier for the markable sheet and are voided by marks in the associated voidable mark spaces of the markable sheet.

11. The method of claim 10 further comprising:

imaging the markable sheet, wherein the imaging provides the image of the markable sheet including a representation of the selection mark spaces, of the voiding mark spaces and of the sheet identifier; or reading the markable sheet, wherein the reading provides the image of the markable sheet including a representation of the selection mark spaces, of the voiding mark spaces and of the sheet identifier.

12. The method of claim 10 wherein the markable sheet has at least two fiducial marks thereon that define the orientation and scale of the markable sheet, and prior to said decoding the sheet identifier from the image of the markable sheet for selecting the template and decoding the selection mark spaces and the voiding mark spaces from the image of the markable sheet, the method further comprising:

decoding from the image of the markable sheet the respective locations of the at least two fiducial marks; and comparing the decoded respective locations of the at least two fiducial marks from the image of the markable sheet and the respective predetermined locations of the at least two fiducial marks for determining the orientation of the markable sheet, for scaling the image of the markable sheet, or for determining the orientation of the markable sheet and for scaling the image of the markable sheet.

13. The method of claim 12 wherein the scaling the image is employed for locating the proper position of the sheet identifier, or for locating the proper positions of the selection mark spaces and the voiding mark spaces, or for locating the proper positions of the sheet identifier, the selection mark spaces and the voiding mark spaces.

14. The method of claim 10 wherein the image of the sheet is in a pixelated or bitmapped format including a plurality of pixels; wherein said decoding the marked selection mark spaces and the voiding marked spaces includes counting at least the number of dark pixels in a predefined region containing a selection mark space, a voiding mark space, or both, further comprising determining from the counts of dark pixels for each predefined region whether the selection mark space and/or voiding mark space therein is marked, said determining including:

(a) comparing the numbers of dark pixels to a first predetermined value to determine whether the selection mark space and/or voiding mark space is marked;

the method further comprising:

(b) comparing the numbers of dark pixels to a second predetermined value that is higher or lower than the first predetermined value to determine whether the selection mark space and/or voiding mark space is marked; and (c) providing an indication of the difference, if any, in the determinations of step (a) and step (b).

15. The method of claim 10 wherein said storing a record of at least the determined marked selection mark spaces that are not voided in a memory includes either:

storing a record of the determined marked selection mark spaces and the determined marked voiding mark spaces in the memory; or storing the determined marked selection mark spaces and the determined marked voiding mark spaces in the memory, displaying the stored determined marked selection mark spaces and the determined marked voiding mark spaces, and then deleting the stored determined marked selection mark spaces and the determined marked voiding mark spaces from the memory.

16. The method of claim 10 wherein the markable sheet has a corresponding unique identifier thereon, said method further comprising processing the unique identifier for authenticating the markable sheet.

17. The method of claim 10 wherein each voiding mark space is adjacent to the associated selection mark space with which it is associated.

18. The method of claim 10 wherein each selection mark space has a particular shape and each voiding mark space has the same particular shape, or wherein each selection mark space has a particular shape and each voiding mark space has a different shape.

19. The method of claim 10 wherein the method is utilized for grading and/or marking an examination, for grading and/or marking a test, for grading and/or marking a school test, for grading and/or marking a university test, for grading and/or marking a professional test, for grading and/or marking an answer sheet, for tallying and/or tabulating a survey, for tallying and/or tabulating a questionnaire, for reading and/or tabulating gaming sheets, for reading and/or tabulating races, for reading and/or tabulating lotteries, or any combination of the foregoing.

20. The method of claim 10 wherein the selection mark spaces include a mark space for a skip contest selection, for a no vote selection, for an abstain selection and/or for a write-in selection, and wherein each mark space for a skip contest selection, for a no vote selection, for an abstain selection and/or for a write-in selection has a corresponding one of the voiding mark spaces associated with it, whereby each selection of a mark space for a skip contest selection, for a no vote selection, for an abstain selection and/or for a write-in selection may be voided by marking the corresponding voiding mark space associated therewith.

21. An optically readable markable sheet comprising:

a sheet of material having an identifier region with an optically readable sheet identifier therein and having selection mark spaces and voiding mark spaces thereon, wherein the selection mark spaces are markable for making selections and each of the voiding mark spaces is associated with a corresponding selection mark space and is markable for voiding the marking of the associated corresponding selection mark space, wherein marking a selection mark space indicates a selection and marking the voiding mark space associated with a corresponding selection mark space indicates not making that selection; and wherein the identifier region, the selection mark spaces and the voiding mark spaces are in defined locations on the optically readable markable sheet, and the sheet identifier, the selection mark spaces and the voiding mark spaces are optically readable.

22. The optically readable markable sheet of claim 21 wherein:

each voiding mark space is in a predetermined position relative to the selection mark space which it is for voiding; or each voiding mark space is in a predetermined position immediately to the right of the selection mark space which it is for voiding; or each voiding mark space is in a predetermined position immediately below the selection mark space which it is for voiding.

23. The optically readable markable sheet of claim 21 wherein the sheet identifier is unique and is not related to the identity of an individual person.

24. The optically readable markable sheet of claim 21 wherein each selection mark space has a particular shape and each voiding mark space has the same particular shape, or each selection mark space has a particular shape and each voiding mark space has a different shape.

25. The optically readable markable sheet of claim 21:

wherein the sheet identifier includes one or more of a bar code, a two-dimensional bar code, a prescribed font, optical character recognition (OCR) characters, alphanumeric characters, non-alphanumeric characters, and symbols; or wherein the sheet identifier relates to a template defining the locations of the selection mark spaces and the voiding mark spaces on the markable sheet; or wherein the sheet identifier is represented by characters that are machine readable and are human readable; or wherein the sheet identifier is unique and is represented by characters that are randomly generated; or wherein said optically readable markable sheet comprises a plurality of pages and each of the plurality of pages has a machine readable indicia representative of a page number thereof; or wherein one of the selection mark spaces represents an abstention, a no vote or a skip selection; or any combination of any of the foregoing.

26. The optically readable markable sheet of claim 21 wherein said optically readable markable sheet has two or more fiducial marks at respective predetermined locations thereon for defining the orientation and scaling of said optically readable markable sheet.

27. The optically readable markable sheet of claim 21 wherein said optically readable markable sheet includes a ballot, an examination sheet, a test sheet, an answer sheet, a tally sheet, a tabulation sheet, a survey sheet, a questionnaire, a gaming sheet, a race sheet, a lottery sheet, or any combination of the foregoing.

28. The optically readable markable sheet of claim 21 wherein said optically readable markable sheet is imagable by an optical imager, by an optical mark reader, by an optical scanner, by an imager, or by any combination of the foregoing, for providing an image of the optically readable markable sheet including a representation of the selection mark spaces and marks therein, the voiding mark spaces and marks therein, a write-in selection if any in a write-in space, and the sheet identifier.

29. The optically readable markable sheet of claim 21 wherein the selection mark spaces include a mark space for a skip contest selection, for a no vote selection, for an abstain selection and/or for a write-in selection, and wherein each mark space for a skip contest selection, for a no vote selection, for an abstain selection and/or for a write-in selection has a corresponding one of the voiding mark spaces associated with it, whereby each selection of a mark space for a skip contest selection, for a no vote selection, for an abstain selection and/or for a write-in selection may be voided by marking the corresponding voiding mark space associated therewith.

* * * * *